US008649713B2

(12) United States Patent
Hori et al.

(10) Patent No.: US 8,649,713 B2
(45) Date of Patent: Feb. 11, 2014

(54) TONER CONTAINER, IMAGE FORMING APPARATUS INCLUDING SAME, AND CONNECTING STRUCTURE FOR CONNECTING TONER CONTAINER AND IMAGE FORMING APPARATUS

(75) Inventors: Eisuke Hori, Tokyo (JP); Yuji Suzuki, Tokyo (JP); Hideki Kimura, Yokohama (JP); Kenji Kikuchi, Yokohama (JP); Noriyuki Kimura, Kawasaki (JP); Nobuo Takami, Kawasaki (JP)

(73) Assignee: Ricoh Company, Limited, Tokyo (JP)

( * ) Notice: Subject to any disclaimer, the term of this patent is extended or adjusted under 35 U.S.C. 154(b) by 329 days.

(21) Appl. No.: 12/875,762

(22) Filed: Sep. 3, 2010

(65) Prior Publication Data

US 2011/0058857 A1 Mar. 10, 2011

(30) Foreign Application Priority Data

Sep. 4, 2009 (JP) ..... 2009-204358
Jun. 11, 2010 (JP) ..... 2010-134544
Jun. 30, 2010 (JP) ..... 2010-148907

(51) Int. Cl.
*G03G 15/08* (2006.01)

(52) U.S. Cl.
USPC ..... 399/262; 399/119; 399/120

(58) Field of Classification Search
USPC ..... 399/119, 120, 262
See application file for complete search history.

(56) References Cited

U.S. PATENT DOCUMENTS 6,826,381 B2 11/2004 Muramatsu et al.
7,693,462 B2 4/2010 Hori et al.
7,787,784 B2 8/2010 Hori
2007/0154243 A1* 7/2007 Taguchi et al. ..... 399/262
2009/0047036 A1 2/2009 Hori et al.
2009/0245882 A1 10/2009 Ozeki et al.
2009/0245887 A1 10/2009 Masuda et al.
2010/0003055 A1 1/2010 Kikuchi et al.
2010/0003058 A1 1/2010 Hori et al.
2010/0111572 A1 5/2010 Hori et al.
2010/0129118 A1 5/2010 Kimura et al.

FOREIGN PATENT DOCUMENTS

JP 4-1681 1/1992
JP 2002-268344 9/2002
JP 4423140 12/2009
JP 4456957 2/2010

* cited by examiner

*Primary Examiner* — Ryan Walsh
(74) *Attorney, Agent, or Firm* — Oblon, Spivak, McClelland, Maier & Neustadt, L.L.P.

(57) ABSTRACT

A toner container includes a cylindrical container body, a cap having a toner outlet, and a shutter. The cap includes a primary positioning hole, formed in an upper front surface perpendicular to a longitudinal direction of the toner container, extending in the longitudinal direction, to determine an installation position of the cap relative to the image forming apparatus, a secondary positioning hole, formed in a lower front surface perpendicular to the longitudinal direction of the toner container, extending in the longitudinal direction forward the toner outlet, to subsidiary determine the installation position of the cap, and a first restriction member to position the cap in a horizontal direction perpendicular to the longitudinal direction, projecting vertically upward from an outer circumferential surface of the cap and symmetrical about a virtual perpendicular line passing through a cross-sectional center position of the primary positioning hole perpendicular to the longitudinal direction.

22 Claims, 44 Drawing Sheets

TONER CONTAINER, IMAGE FORMING APPARATUS INCLUDING SAME, AND CONNECTING STRUCTURE FOR CONNECTING TONER CONTAINER AND IMAGE FORMING APPARATUS

CROSS-REFERENCE TO RELATED APPLICATIONS

This patent specification claims priority from Japanese Patent Application Nos. 2009-204358, filed on Sep. 4, 2009, 2010-134544, filed on Jun. 11, 2010, and 2010-148907, filed on Jun. 30, 2010 in the Japan Patent Office, the contents of which are hereby incorporated by reference herein in their entirety.

BACKGROUND OF THE INVENTION

1. Field of the Invention

The present invention relates to a toner container included in an image forming apparatus such as a copier, a printer, a facsimile machine, a plotter, and a multi-function machine, and a connecting structure for connecting a toner container and an image forming apparatus.

2. Discussion of the Background

Electrophotographic image forming apparatuses such as copiers, printers, facsimile machines, plotters, multi-function machines, or the like typically include toner containers. In general, cylindrical toner containers (bottles) that are removably installable in the image forming apparatuses are used.

Thus, for example, in JP-H04-1681-A and JP2002-268344-A, a toner container (toner cartridge) that is removably installable in the image forming apparatus, and mainly includes a container body (bottle body) and a cap (handle member).

A problem with the arrangement shown in these examples occurs when a user inserts the toner container into the image forming apparatus with the container cap askew, resulting in positional deviation of the toner container relative to the image forming apparatus because the position of the container cap is not determined in the image forming apparatus.

In view of the foregoing, there is market demand for toner containers whose cap is reliably positioned in the image forming apparatus without adversely affecting discharge of the toner.

SUMMARY

In view of the foregoing, one illustrative embodiment of the present invention provides a toner container that is removably installable in an image forming apparatus and includes a cylindrical container body, a cap, and a shutter. The cylindrical container body, having an opening in one end thereof, conveys toner contained in the container body to the opening. The cap, into which the end of the container body having the opening is inserted, has a toner outlet to discharge the toner discharged from the opening of the container body vertically downward. The shutter, slidably held in a bottom portion of the cap, opens the toner outlet by movement from the cap side to the container body side when the toner container is installed in the image forming apparatus, and closes the toner outlet by movement from the container body side to the cap side when the toner container is removed from the image forming apparatus. The cap includes a primary positioning hole, a secondary positioning hole, and at least one first restriction member. The primary positioning hole, formed in an upper front surface perpendicular to a longitudinal direction of the toner container, extends in the longitudinal direction and functions as a main positioning reference to determine an installation position of the cap relative to the image forming apparatus. The secondary positioning hole, formed in a lower front surface perpendicular to the longitudinal direction of the toner container opposite the primary positioning hole, extends in the longitudinal direction forward the toner outlet and functions as a sub positioning reference to determine the installation position of the cap relative to the image forming apparatus. The first restriction member that positions the cap in a horizontal direction perpendicular to the longitudinal direction of the cap projects vertically upward from an outer circumferential surface of the cap and symmetrical about a virtual perpendicular line passing through a cross-sectional center position of the primary positioning hole in perpendicular to the long direction of the toner container.

Another illustrative embodiment of the present invention provides an image forming apparatus that includes a toner container frame, provided in a main body of the image forming apparatus, and at least one toner container, removably installable in the toner container frame. The toner container includes the cylindrical container body, the cap, and a shutter, slidably held on a bottom side of the cap, to open the toner outlet as the cap moves in the toner container frame in a direction in which the toner container is inserted into the toner container frame while the shutter is stopped in the toner container frame, and to close the toner outlet as the cap moves in the toner container frame in a direction in which the toner container is removed from the toner container frame while the shutter is stopped in the toner container frame. The toner container frame includes an insertion portion in which an inserting opening is formed to insert the toner container into the toner container frame, a container holder to hold the container body of the toner container, a cap holder to hold the cap of the toner container, provided in an extreme downstream portion of the toner container frame in a direction in which the toner container is inserted into the toner container frame. The cap holder includes a first reference pin, a second reference pin, and an engaged portion. The first reference pin, to engage the first hole of the cap of the toner container projects inward from an extreme downstream portion of an interior wall of the cap holder in the direction in which the toner container is inserted into the toner container frame. The second reference pin to engage the second hole of the cap of the toner container projects inward from extreme downstream interior wall of the cap holder in the direction in which the toner container is inserted into the toner container frame. The engaged portion, to engage the first restriction member of the cap of the toner container, projecting downward from a ceiling of the cap holder, extends in the direction in which the toner container is inserted into the toner container frame.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
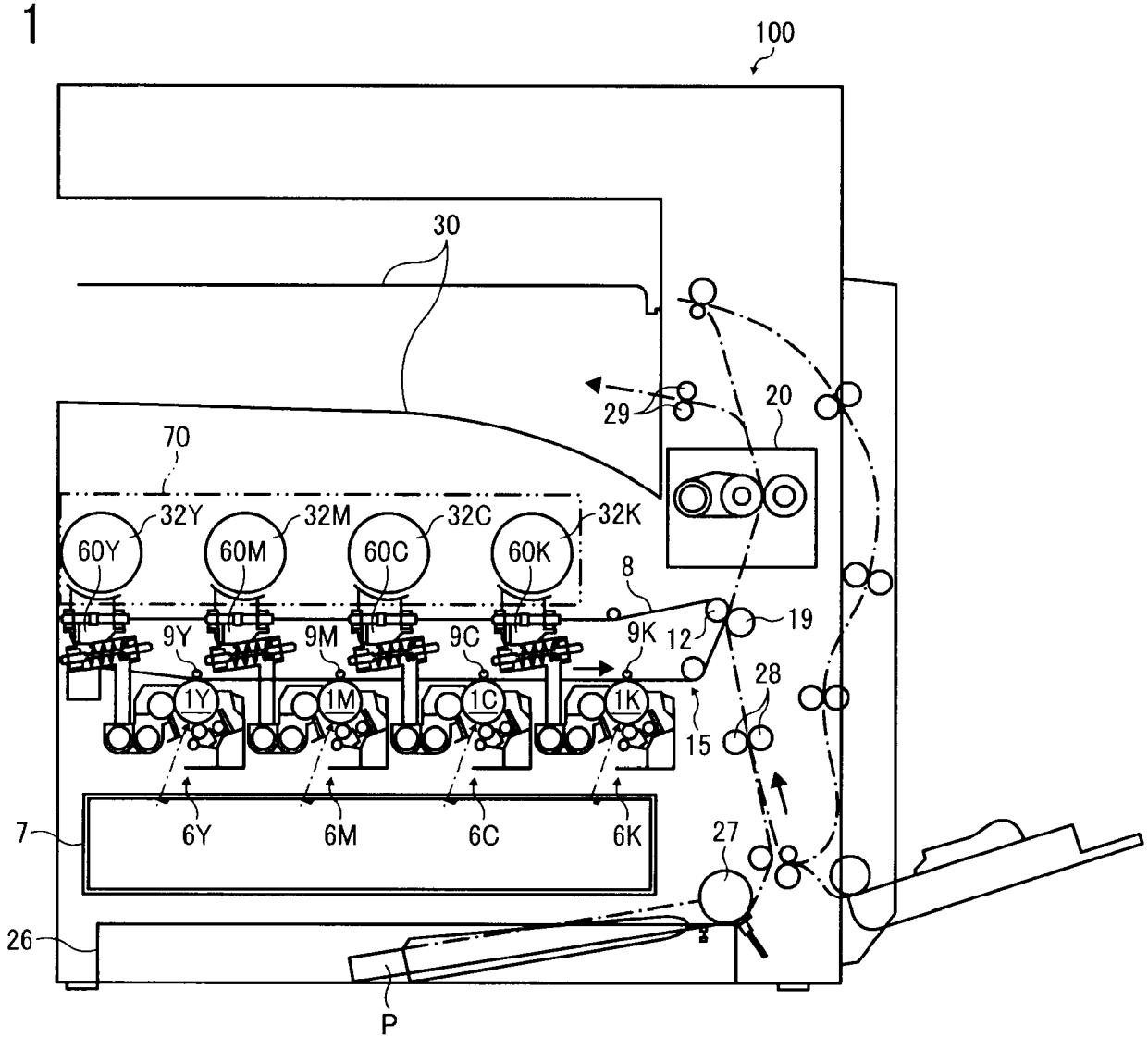
FIG. 1 is an overall schematic view illustrating a configuration of an image forming apparatus according to a first illustrative embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus that is an electrophotographic printer (hereinafter referred to as a printer) according to an illustrative embodiment of the present invention is described. It is to be noted that although the image forming apparatus of the present embodiment is a printer, the image forming apparatus of the present invention is not limited to a printer.

First Embodiment

Referring now to FIGS. 1 through 46, a first embodiment of the present invention is described in detail below.

Initially, structure and operation of the image forming apparatus according to the present embodiment are described. FIG. 1 is a schematic diagram showing a structure of an entire image forming apparatus 100 according to the first embodiment of the present invention. As shown in FIG. 1, in a toner container frame 70 is provided in an upper part of the image forming apparatus 100, and four toner containers 32Y, 32M, 32C, and 32K respectively corresponding to yellow, magenta, cyan, and black are detachably installable in the toner container frame 70 (see FIGS. 4 and 42). The toner container 32Y functions as a toner container.

An intermediate transfer unit 15 is provided beneath the toner container frame 70. The intermediate transfer unit 15 includes an intermediate transfer belt 8. Image forming units 6Y, 6M, 6C, and 6K respectively corresponding to yellow, magenta, cyan, and black are positioned to face the intermediate transfer belt 8. Toner supply devices 60Y, 60M, 60C, and 60K are provided beneath the corresponding toner containers 32Y, 32M, 32C, and 32K. Different color toner contained in the toner containers 32Y, 32M, 32C, and 32K are supplied to corresponding developing devices in the image forming units 6Y, 6M, 6C, and 6K by the corresponding toner supply devices 60Y, 60M, 60C, and 60K.

The image forming units 6Y, 6M, 6C, and 6K are described in further detail below with reference to FIG. 2 in addition to FIG. 1, after which the elements shown in FIG. 1 that are not described above are described. In the following description, since configurations of elements for forming yellow, magenta, cyan, and black images are substantially identical to each other, in some cases, elements for yellow (given the reference character suffix Y) are described as representative.

Figure 2:
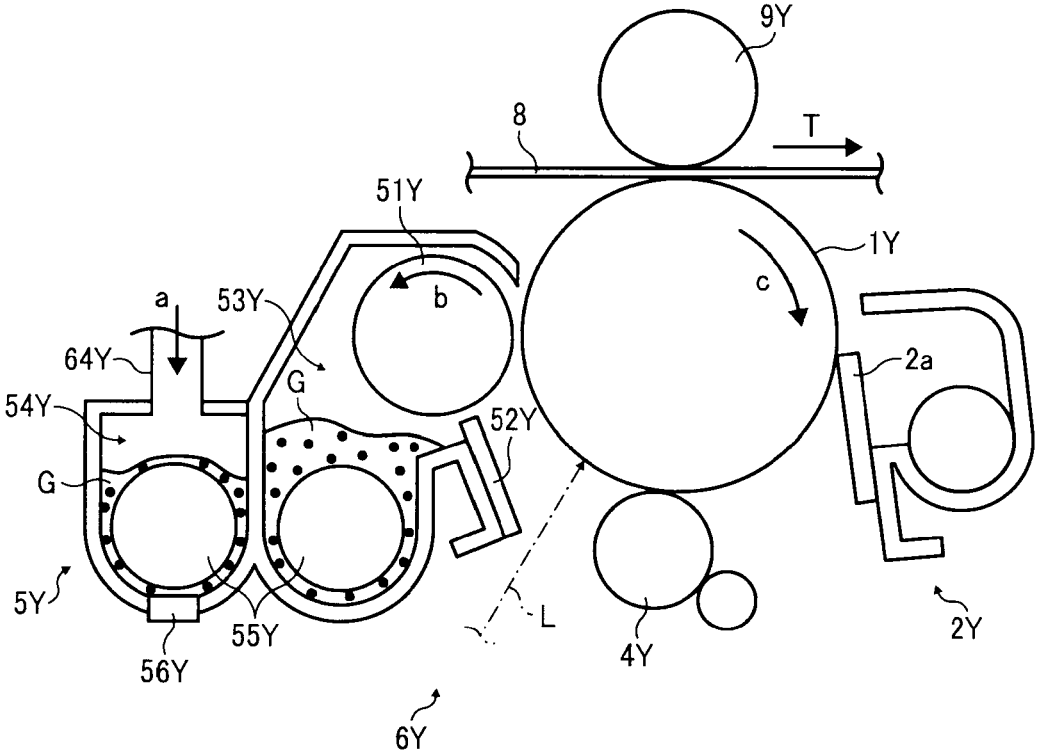
FIG. 2 is a schematic diagram illustrating an image forming unit included in the image forming apparatus shown in FIG. 1.

FIG. 2 is a schematic diagram illustrating the image forming unit 6Y included in the image forming apparatus shown in FIG. 1.

As shown in FIG. 2, the image forming unit 6Y corresponding to yellow includes a photoconductor drum 1Y, and in the vicinity of the photoconductor drum 1Y, a charging device 4Y, a developing device 5Y (developing section), a cleaning device 2Y, and a discharging device (not shown) are provided in the image forming unit 6Y. Image forming processes (a charging process, an exposing process, a developing process, a primary-transfer process, and a cleaning process) are performed on the photoconductor drum 1Y, and a yellow image is formed on the photoconductor drum 1Y.

Each of the image forming units 6M, 6C, and 6K has a structure substantially identical to the structure of the image forming unit 6Y and forms a corresponding color image. Therefore, in the following, the image forming unit 6Y is mainly described while omitting the descriptions of the image forming units 6M, 6C, and 6K.

In FIG. 2, the photoconductor drum 1Y is rotated in a clockwise direction indicated by arrow c, by a driving motor (not shown). Then, the surface of the photoconductor drum 1Y is uniformly charged by the charging device 4Y (the charging process), after which the surface of the photoconductor drum 1Y reaches a portion receiving a laser beam L emitted from an exposure device 7 (see FIG. 1) and an electrostatic latent image corresponding to yellow is formed on the photoconductor drum 1Y with the laser beam L at that position (the exposing process).

Then, the surface of the photoconductor drum 1Y on which the electrostatic latent image has been formed reaches a position facing the developing device 5Y, and the electrostatic latent image is developed at the position. Thus, a yellow toner image is formed (the developing process).

Then, the surface of the photoconductor drum 1Y on which the toner image has been formed reaches a position facing the intermediate transfer belt 8 and a primary-transfer bias roller 9Y, and the toner image on the photoconductor drum 1Y is transferred onto the intermediate transfer belt 8 at that position (the primary-transfer process). At this time, a small amount of toner that has not been transferred onto the intermediate transfer belt 8 remains on the photoconductor drum 1Y.

Subsequently, the surface of the photoconductor drum 1Y reaches a position facing the cleaning device 2Y and the toner remaining on the surface of the photoconductor drum 1Y is mechanically removed by a cleaning blade 2*a* (the cleaning process).

Finally, the surface of the photoconductor drum 1Y reaches a position facing the discharging device and electric charges remaining on the surface of the photoconductor drum 1Y are discharged.

Thus, the image forming process on the photoconductor drum 1Y is completed.

It is to be noted that the above-described image forming process is performed in the image forming units 6M, 6C, and 6K, similar to the image forming unit 6Y. That is, the corresponding photoconductor drums 1M, 1C, and 1K are irradiated with the laser beams L corresponding to image data, emitted from the exposure device 7 positioned beneath the image forming units 6M, 6C, and 6K. Specifically, the exposure device 7 causes light sources to emit the laser beams L and directs the laser beams L onto the corresponding photoconductor drums 1M, 1C, and 1K via plural optical elements while the laser beams L are deflected by a rotating polygon mirror to scan the surfaces of the photoconductor drums 1M, 1C, and 1K, respectively. After the developing process, the toner images formed on the respective photoconductor drums 1Y, 1M, 1C, and 1K are transferred onto the intermediate transfer belt 8 and superimposed one on another thereon. Undergoing theses processes, a multicolor image is formed on the intermediate transfer belt 8.

Returning now to FIG. 1, the intermediate transfer unit 15 includes the intermediate transfer belt 8, four primary-transfer bias rollers 9Y, 9M, 9C, and 9K, a secondary-transfer backup roller 12, plural tension rollers (not shown), and an intermediate transfer cleaning section (not shown). The intermediate transfer belt 8 is supported by plural rollers and is endlessly rotated in a direction indicated by arrow T shown in FIG. 1 by the secondary-transfer backup roller 12.

The four primary-transfer bias rollers 9Y, 9M, 9C, and 9K respectively press against the four photoconductor drums 1Y, 1M, 1C, and 1K via the intermediate transfer belt 8, thus forming primary-transfer nips therebetween. A transfer bias voltage whose polarity is inverted relative to the polarity of the toner is applied to the four primary-transfer bias rollers 9Y, 9M, 9C, and 9K. The intermediate transfer belt 8 sequentially passes through the primary-transfer nips formed between the primary-transfer bias rollers 9Y, 9M, 9C, and 9K and the photoconductor drums 1Y, 1M, 1C, and 1K while rotating in the direction indicated by arrow T shown in FIG. 1. Thus, the toner images on the photoconductor drums 1Y, 1M, 1C, and 1K are primarily transferred onto the intermediate transfer belt 8 and superimposed one on another thereon, forming a four-color (multicolor) toner image.

Then, the intermediate transfer belt 8 onto which the toner images have been transferred and superimposed one on another thereon reaches a position facing a secondary-transfer roller 19. A secondary-transfer nip is formed at the position where the intermediate transfer belt 8 is sandwiched between the secondary-transfer backup roller 12 and the secondary-transfer roller 19. Then, the four-color toner image formed on the intermediate transfer belt 8 is transferred onto a recording medium P (for example, paper) carried to the secondary nip (a secondary transfer process). At this time, a certain amount of toner can remain on the intermediate transfer belt 8, not transferred onto the recording medium P.

Then, the intermediate transfer belt 8 reaches a position facing the intermediate transfer cleaning section and the toner remaining on the intermediate transfer belt 8 is removed at that position. Thus, the secondary-transfer process that is performed on the intermediate transfer belt 8 is completed.

The recording medium P is carried to the secondary nip from a paper feeding section 26 positioned at a lower part of the image forming apparatus 100 via a paper feeding roller 27, a pair of registration rollers 28, and so on.

Specifically, the plural recording media P (multiple sheets of paper) are stacked and stored in the paper feeding section 26. When the paper feeding roller 27 is rotated counterclockwise in FIG. 1, the recording medium P on the top is carried to a position between the pair of registration rollers 28.

The recording medium P carried to the pair of registration rollers 28 is temporarily stopped at a roller nip position of the pair of registration rollers 28 whose rotation is stopped. Then, the pair of registration rollers 28 is rotated again, timed to coincide with formation of the multicolor image on the intermediate transfer belt 8, and thus the recording medium P is carried to the secondary-transfer nip. Then, the multicolor image is transferred onto the recording medium P.

The recording medium P onto which the multicolor image has been transferred in the secondary-transfer nip is carried to a fixing section 20 and the multicolor image on the recording medium P is fixed with heat and pressure from a fixing belt (not shown) and a pressure roller (not shown) of the fixing section 20.

The recording medium P on which the multicolor image has been formed is output to a stack section 30 via a pair of paper output rollers 29. When plural recording media P are output, the output plural recording media P are sequentially stacked on the stack section 30. Thus, a sequence of image forming processes performed in the image forming apparatus 100 is completed.

Next, with reference to FIG. 2, structure and operation of the developing device 5Y in the image forming unit 6Y are described in detail below.

The developing device 5Y includes a developing roller 51Y facing the photoconductor drum 1Y, a doctor blade 52Y facing the developing roller 51Y, developer containers 53Y and 54Y, two developer conveying screws 55Y respectively disposed in the developer containers 53Y and 54Y, and a concentration detector 56Y for detecting a toner concentration in a developer G. The developing roller 51Y includes a magnet (not shown) fixed inside the developing roller 51Y and a sleeve (not shown) that is outermost portion of the developing roller 51 and is rotated around the magnet. The developer G that is two-component developer consisting essentially of carrier particles (toner carrier) and toner particles is contained in the developer containers 53Y and 54Y. The developer container 54Y is connected to a toner dropping route 64Y via an opening formed on an upper side of the developer container 54Y.

Next, operation of the developing device 5Y is described below.

The sleeve of the developing roller 51Y is rotated in a direction indicated by arrow b shown in FIG. 2, and the developer G carried on the developing roller 51Y by a magnetic field generated by the magnet is transported in that direction as the sleeve is rotated. The toner concentration of the developer G in the developing device 5Y is adjusted within a predetermined range. Specifically, toner contained in the toner container 32Y (see FIG. 1) is supplied to the developer container 54Y by the toner supply device 60Y (see FIG. 1) corresponding to the amount of toner consumed in the developing device 5Y. The toner supply device 60Y is described below in detail.

The toner supplied to the developer container 54Y are mixed with the developer G in the developer container 54Y, and the developer G is circulated in the two developer containers 53Y and 54Y while stirred by the developer conveying screws 55Y. While the developer G is moved in the direction perpendicular to the plane of the paper on which FIG. 2 is drawn, the toner particles in the developer G adhere to carrier particles, charged with friction with the carrier particles, and are carried on the developing roller 51Y together with the carrier particles by a magnetic force formed on the developing roller 51Y.

Then, the developer G carried on the developing roller 51Y is transported in the direction indicated by arrow b in FIG. 2 to the doctor blade 52Y. The amount of the developer G on the developing roller 51Y is adjusted to a suitable value by the doctor blade 52Y, after which the developer G is carried to a developing region facing the photoconductor drum 1Y. The toner particles in the developer G are attracted to an electrostatic latent image formed on the photoconductor drum 1Y by an electric field generated in the developing region. As the sleeve rotates, the developer G remaining on the developing roller 51Y reaches an upper part in the developer container 53Y and drops from the developing roller 51Y.

Next, referring to FIGS. 3 and 4, the toner supply devices 60Y, 60M, 60C, and 60K are described below.

Figure 3:
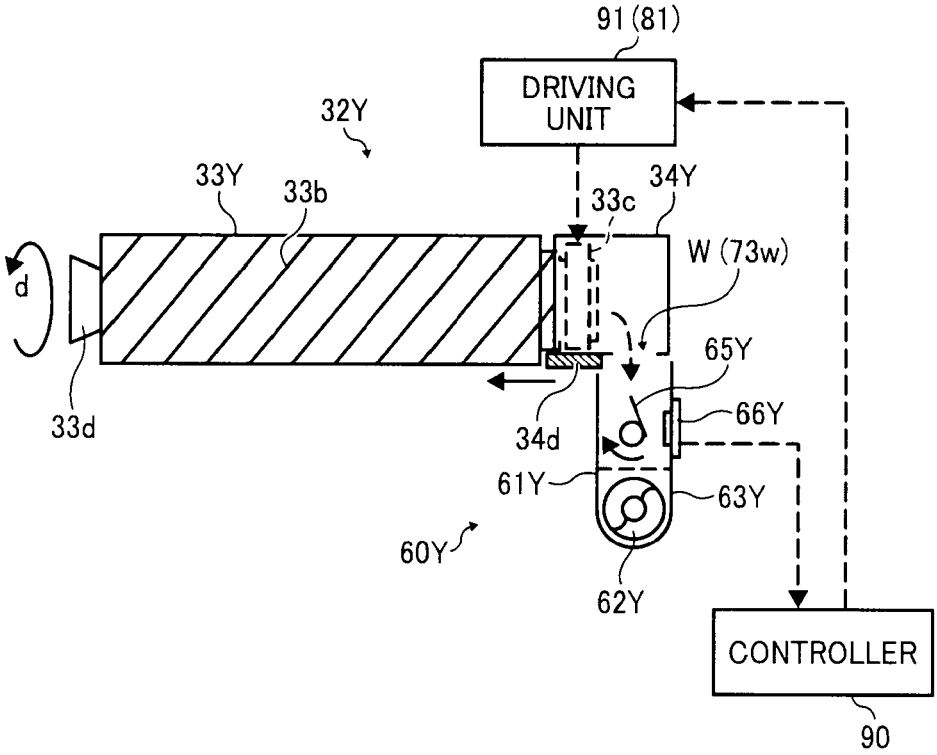
FIG. 3 is a diagram schematically showing supply of toner to the toner supply device from the toner container connected to the toner supply device included in the image forming apparatus shown in FIG. 1.

Herein, FIG. 3 is a diagram schematically showing supply of toner to the toner supply device 60 from the toner container 32Y connected to the toner supply device 60. FIG. 4 is a perspective view of the toner container frame 70 included in the image forming apparatus 100 shown in FIG. 1, respectively. In FIGS. 3 and 4, the respective color toners contained in the corresponding toner containers 32Y, 32M, 32C, and 32K in the toner container frame 70 are suitably supplied to the corresponding developing devices 5Y, 5M, 5C, and 5K by the corresponding toner supply devices 60Y, 60M, 60C, and 60K according to the amount of the corresponding toner consumed. The structure of each of the toner supply devices 60Y, 60M, 60C, and 60K is substantially equal, and the structure of each of the toner containers 32Y, 32M, 32C, and 32K is substantially equal. Therefore, the toner supply device 60Y and the toner container 32Y are described as representative.

Figure 4:
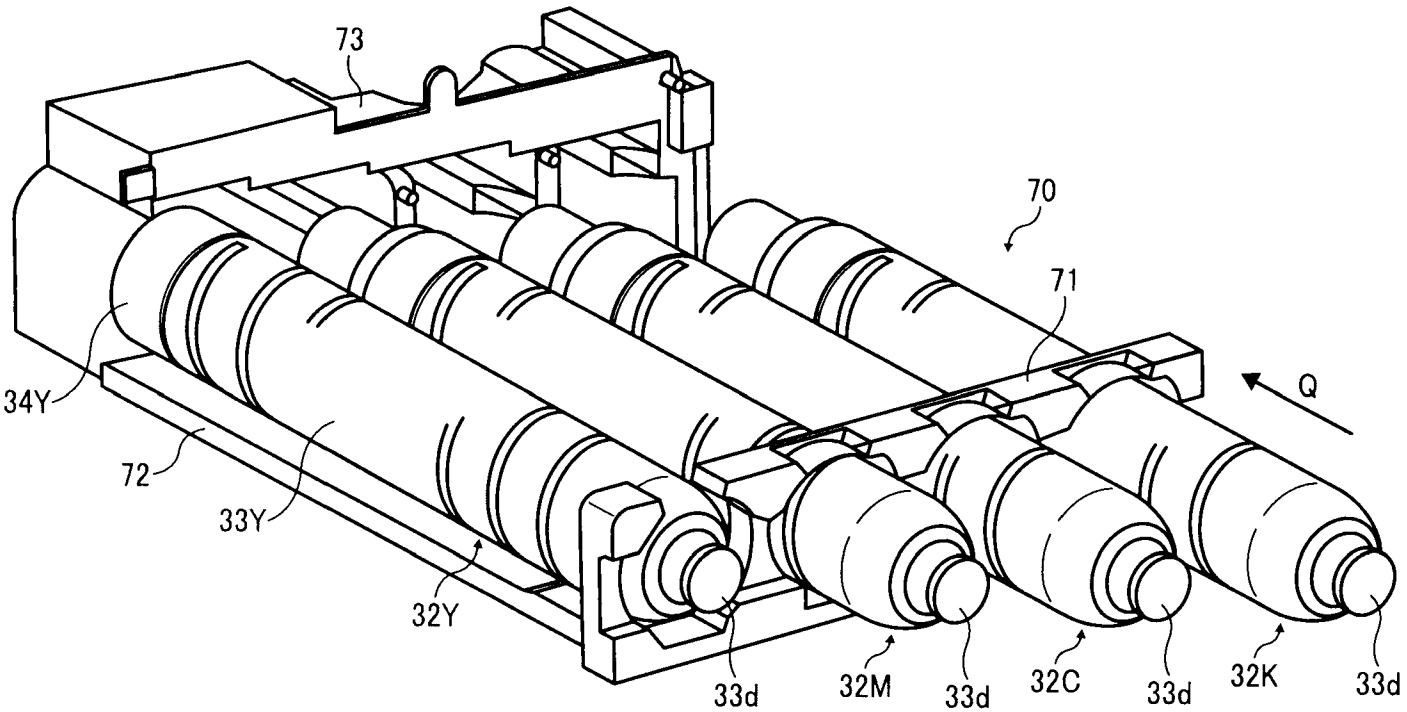
FIG. 4 is a perspective view of a toner container frame included in the image forming apparatus shown in FIG. 1, in which the toner container shown in FIG. 3 is set.

When the toner container 32Y is installed in the toner container frame 70 in a direction indicated by arrow Q in FIG. 4, a shutter 34*d* (shown in FIGS. 3 and 9) of the toner container 32Y is moved in synchronization with the installation of the toner container 32Y, and a toner outlet W (see FIG. 3) of the toner container 32Y is opened. Consequently, the toner outlet W of the toner container 32Y overlaps a toner supply opening 73*w* of the toner supply device 60. Accordingly, the toner contained in the toner container 32Y is discharged from the toner container 32Y through the toner outlet W and the toner supply opening 73*w* and stored in a toner tank of the toner supply device 60Y.

As shown in FIG. 3, the toner container 32Y is a substantially cylindrical toner bottle and includes a container body (bottle body) 33Y formed integrally with a gear 33Yc (33*c*) and a cap 34Y. The cap 34Y is attached to the toner container frame 70 so as not to rotate. The toner outlet W is formed on a lower side of the cap 34Y of the toner container 32Y. In addition, the toner supply device 60Y includes a toner tank 61Y, a toner conveying screw 62Y, a toner conveying tube 63Y, the toner dropping route 64Y (shown in FIG. 2), a toner agitator 65Y, a toner end sensor 66Y (detecting unit), and a driving unit 91. It is to be noted that, in FIG. 3, reference character 33*d* represents a handle part.

In FIG. 3, the container body 33Y is rotatably held by the cap 34Y and is rotated in a direction indicated by arrow d shown in FIG. 3 by the driving unit 91 that includes a driving motor (not shown), a driving gear 81, and the like. By rotating the container body 33Y, spiral protrusions 33*b* protruding inward from an inner circumferential face of the container body 33Y convey the toner contained in the container body 33Y in a longitudinal direction of the toner container 32Y (from left to right in FIG. 3) and discharges the toner from the toner outlet W.

That is, the container body 33Y of the toner container 32Y is rotated by the driving unit 91 as required, thus supplying the toner suitably to the toner tank 61Y of the toner supply device 60. When the service life of each of the toner containers 32Y, 32M, 32C, and 32K has expired, that is, when almost all toner in the toner container 32Y have been consumed, an old one is replaced with a new one.

Figure 42:
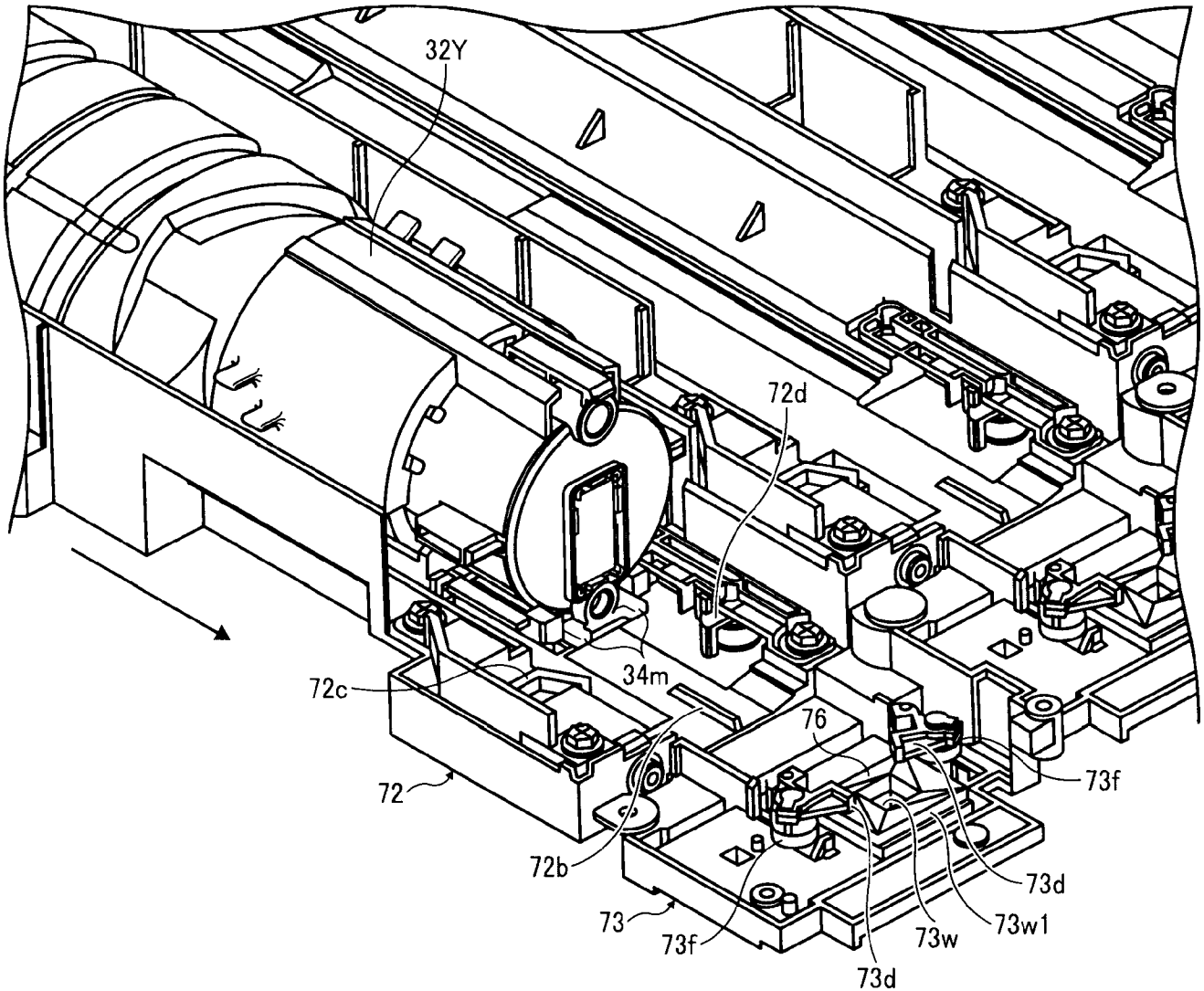
FIG. 42 is a perspective view illustrating a process in which each toner container is fitted into the toner container frame shown in FIG. 4.

Further, the toner tank 61Y is positioned beneath the toner outlet W of the container body 33Y of the toner container 32Y and stores the toner discharged through the toner outlet W from the toner container 32Y via the toner supply opening 73*w* (see FIGS. 3 and 42). The bottom part of the toner tank 61Y is connected to an upstream side in the developer conveyance direction of the toner conveying screw 62Y.

The toner end sensor 66Y is disposed on a wall surface of the toner tank 61Y at a predetermined height from the bottom surface of the toner tank 61Y. The toner end sensor 66Y detects that the amount of the toner stored in the toner tank 61Y becomes less than a predetermined amount. As the toner end sensor 66Y, a piezoelectric sensor can be used.

With reference to FIG. 3, when the toner end sensor 66Y detects a signal indicating that the amount of the toner stored in the toner tank 61Y is less than the predetermined value, the signal is sent to a controller 90. The controller 90 controls the driving unit 91 (including the driving gear 81) to rotate the toner container 32Y for a predetermined period to supply toner to the toner tank 61Y.

When the toner end sensor 66Y continues to detect the signal even if the driving unit 91 repeats rotating the toner conveyance member 32Y3 in the toner container 32Y during a predetermined time period, the controller 90 determines that no toner remains in the toner container 32Y. Then, the controller 90 displays a message that instructs users to replace the toner container 32Y with a new one on a display (not shown) of the image forming apparatus 100.

The toner agitator 65Y (rotating member) is disposed at an inner center position of the toner tank 61Y near the toner end sensor 66Y for preventing the toner stored in the toner tank 61Y from being coagulated. The toner agitator 65Y includes a flexible member (not shown) provided on a shaft, rotates in a clockwise direction indicated by an arrow shown in FIG. 3, and stirs the toner in the toner tank 61Y. In addition, since the tip of the flexible member of the toner agitator 65Y slidably contacts the detecting surface of the toner end sensor 66Y with every a rotational cycle of the toner agitator 65Y, a decrease in the detecting accuracy due to toner adhering to the detecting surface of the toner end sensor 66Y is prevented.

The toner conveying screw 62Y conveys the toner retained in the toner tank 61Y obliquely upward. More specifically, the toner conveying screw 62Y linearly conveys the toner from the bottom side of the toner tank 61Y to the upper side of the developing device 5Y. Then, the toner thus conveyed by the toner conveying screw 62Y drops under its own weight through the toner dropping route 64Y (see FIG. 2) and is supplied to the development device 5Y (developer container 54Y).

Referring now to FIG. 4, the toner container frame 70 includes a cap holder 73 that holds four caps 34Y, 34M, 34C, and 34K of the toner container 32Y, 32M, 32C, and 32K, a bottle holder 72 that holds four container bodies 33Y, 33M, 33C, 33K of the toner containers (bottles) 32Y, 32M, 32C, and 32K, and an inserting portion 71 having four inserting openings 710 through which the toner containers 32Y, 32M, 32C, and 32K are inserted when the toner containers 32Y, 32M, 32C, and 32K are inserted into and detached from the toner container frame 70. The structure of the bottle holder 72 and the inserting portion 71 is described in detail below with reference to FIGS. 32 through 46.

As shown in FIG. 1, when a main body cover (not shown) positioned on the front side of the image forming apparatus 100 is opened, the inserting portion 71 of the toner container frame 70 is exposed. That is, attachment and removal of the toner containers 32Y, 32M, 32C, and 32K are performed from the front side of the image forming apparatus 100 in the longitudinal direction of the toner containers 32Y, 32M, 32C, and 32K, that is, a direction orthogonal to the surface of paper on which FIG. 1 is drawn.

Herein, the length in the longitudinal direction of the bottle holder 72 is almost equal to the length in the longitudinal direction of the container body 33Y. In addition, the cap holder 73 is attached to one side (front end side) of the bottle holder 72 in the longitudinal direction (direction of insertion), and the inserting portion 71 is provided on the other side (back end side) of the bottle holder 72 in the longitudinal direction (direction of insertion).

Therefore, as the toner container 32Y is inserted into the toner container frame 70, the cap 34Y passes through the bottle holder 72, slides on the bottle holder 72 for a certain distance, and then is set in the cap holder 73.

Further, four antennas 73*e* (see FIGS. 38 and 39) dedicated for radio frequency identification (RFID) chips 35 (see FIGS. 5 and 9) are provided on the cap holder 73 of the toner container frame 70. Specifically, the four antennas 73*e* communicate with the RFID chips 35, serving as electronic data storages, installed in respective mounting sections 34*k* (see FIGS. 14 and 15) positioned on a front surfaces of the corresponding toner containers 32Y, 32M, 32C in a direction in which the toner container 32Y is installed into the toner container holder 70. The toner container 32Y, 32M, 32C, and 32K are aligned on the antenna 73*e* so that the RFID chips 35 face the antennas 73*e*, respectively.

The data exchanged between the toner container 32Y, 32M, 32C, and 32K and the image forming apparatus 100 includes, for example, the production serial number of the toner container, the recycle number of the toner container, the type of toner, the production lot number of the toner, the production date of the toner, the manufacturer of the toner, the amount of toner in the toner container, the multicolor of toner, and a usage history of the image forming apparatus 100. Other data may also be included.

Alternatively, after the toner container 32Y is set in the toner container frame 70 in the image forming apparatus 100, the data transmitted from the image forming apparatus 100 to the toner container 32Y is stored in the RFID chip 35.

Referring to FIGS. 5 through 31, configuration and operation of the toner container 32Y are described below.

It is to be noted that, in the toner container 32 and the toner container frame 70, reference character suffixes Y, M, C, and K attached to identical reference numerals indicate only that components indicated thereby are used for forming different single-color images, respectively, and hereinafter may be omitted when color discrimination is not necessary.

Figure 5:
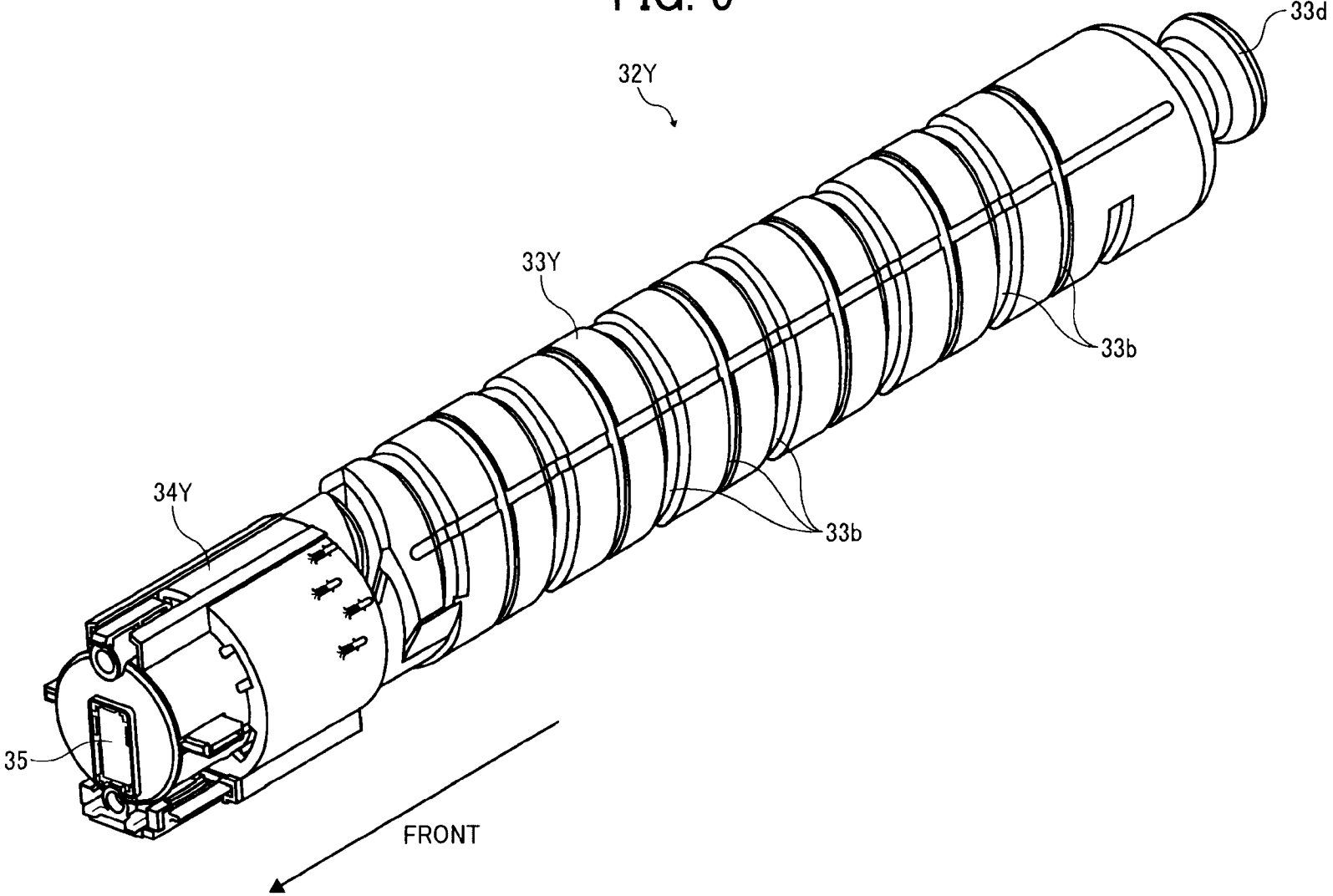
FIG. 5 is a perspective view of the toner container shown in FIG. 3 when view from obliquely above.
Figure 6:
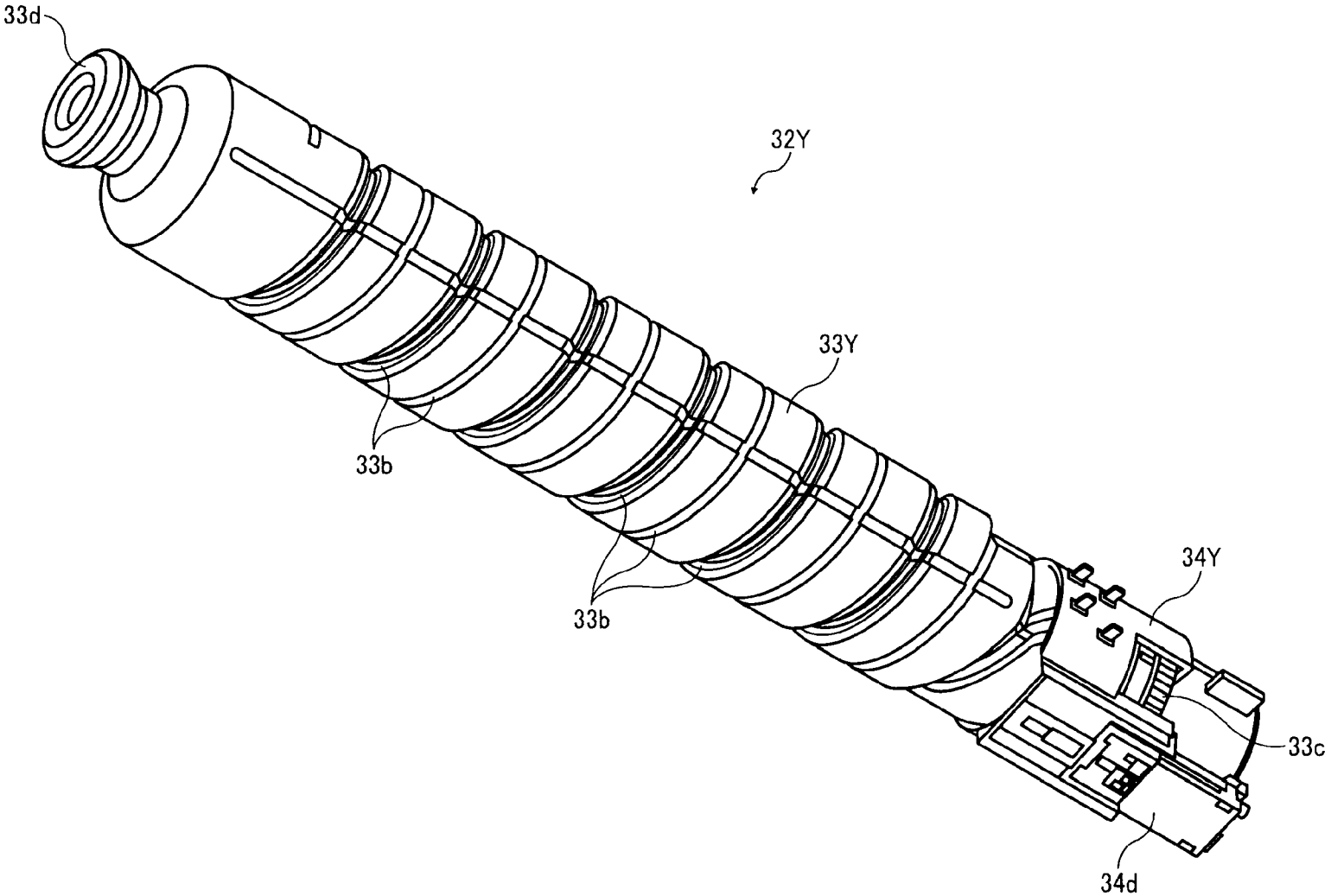
FIG. 6 is a perspective view of the toner container shown in FIG. 5 when view from obliquely underneath.
Figure 7:
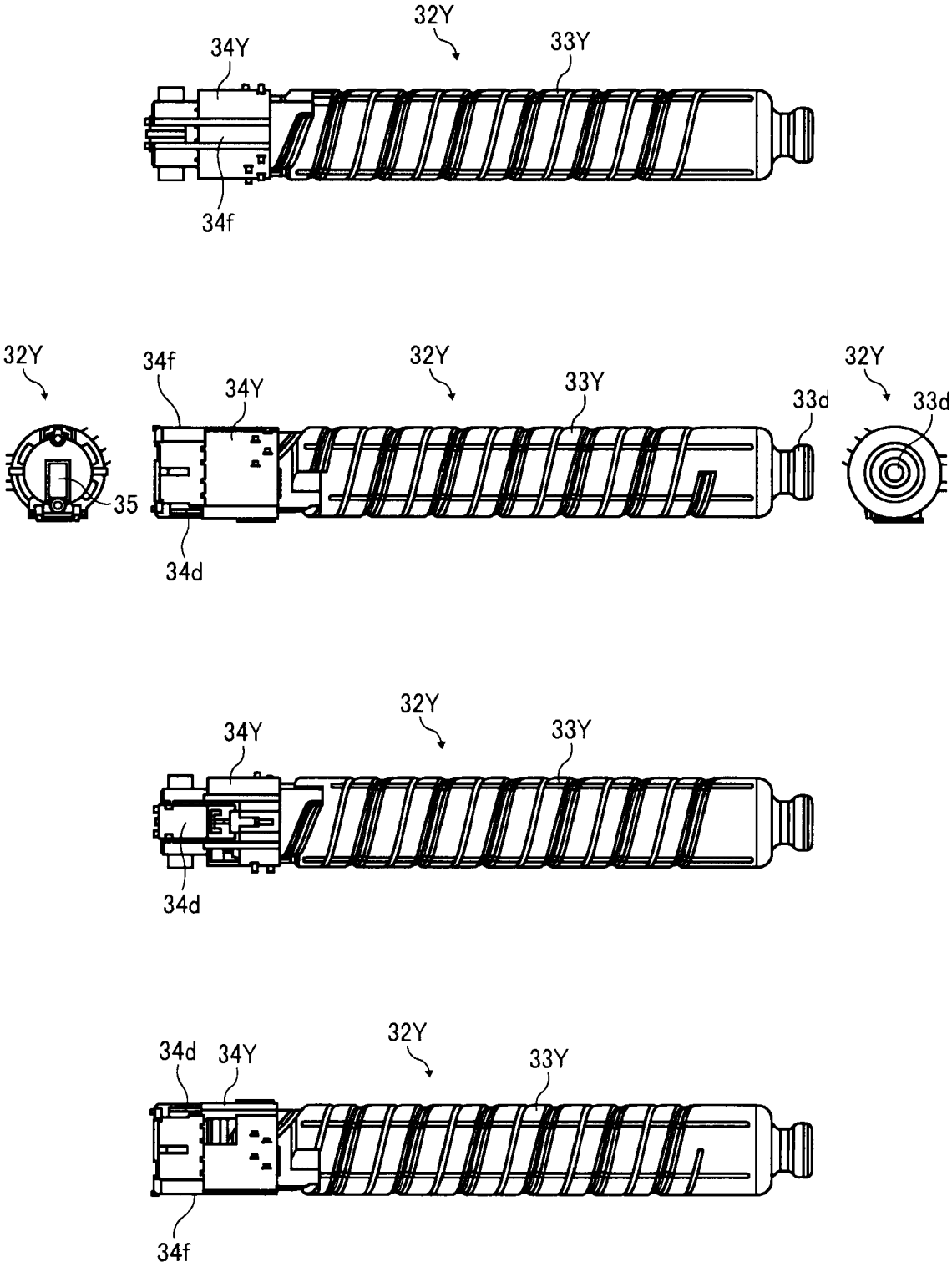
FIG. 7 is a set of six sides views of the toner container shown in FIG. 5, including a topside view, a front view, a left side view, a backside view, a bottom view, and a right side view.

FIGS. 5 and 6 are perspective views of the toner container 32Y, and FIG. 7 is a set of six side views including a topside view, a front view, a left side view, a backside view, a bottom view, and a right side view. It is to be noted that reference character 34*f* in FIG. 7 represents second engaging members.

As shown in FIGS. 5 and 6, the toner container 32Y includes the container body 33Y and the cap 34Y. More specifically, with reference to FIG. 9A, which is an exploded view illustrating the toner container 32Y, the toner container 32Y includes an agitator 33*f*, a cap seal 37, the shutter 34*d*, a shutter seal 36 serving as a seal member, and the RFID chip 35 serving as the electronic data storage, in addition to the container body 33Y and the cap 34Y.

Figure 8:
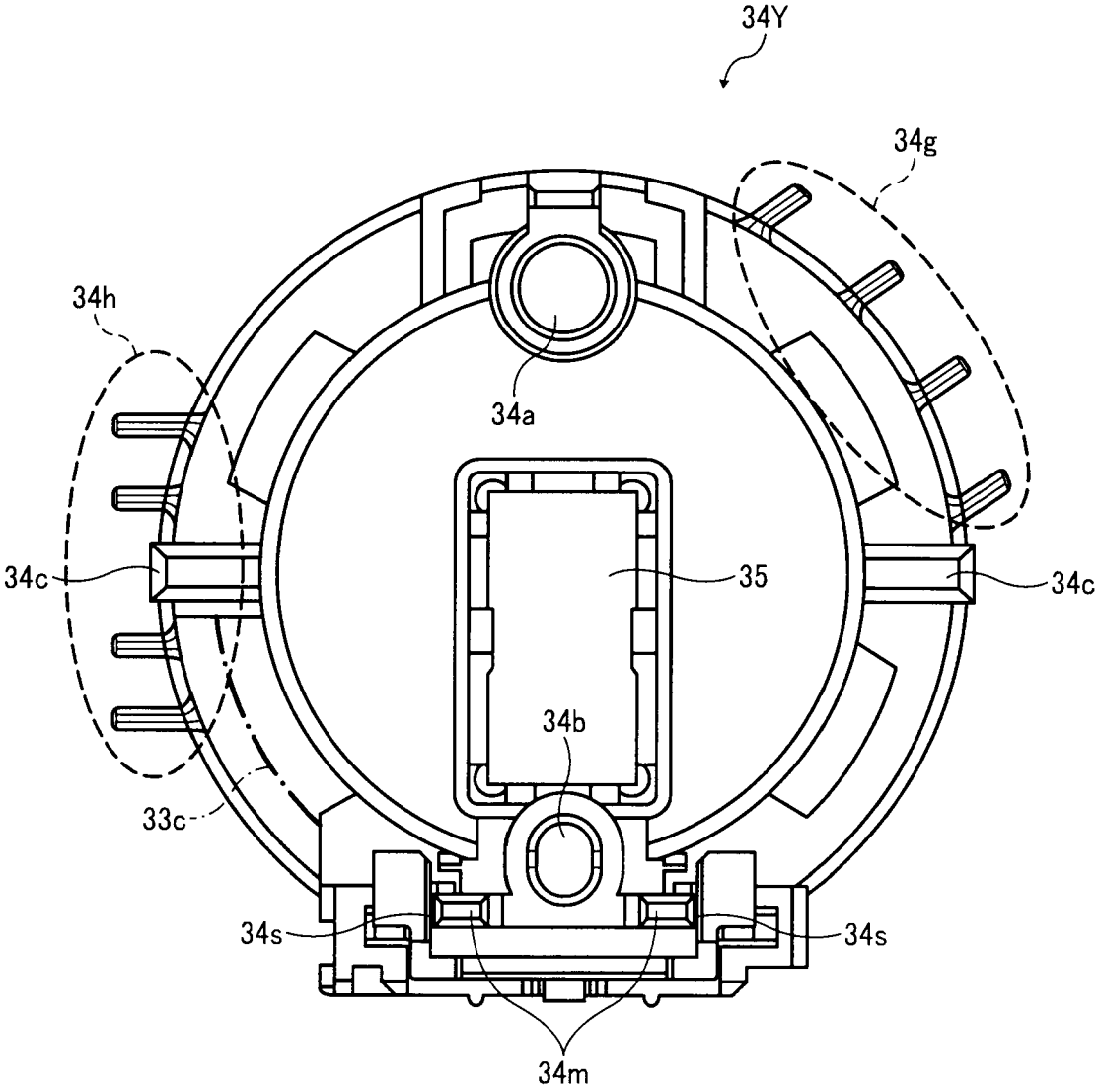
FIG. 8 is a front view of the toner container shown in FIG. 5 when view from a cap side.
Figure 9A:
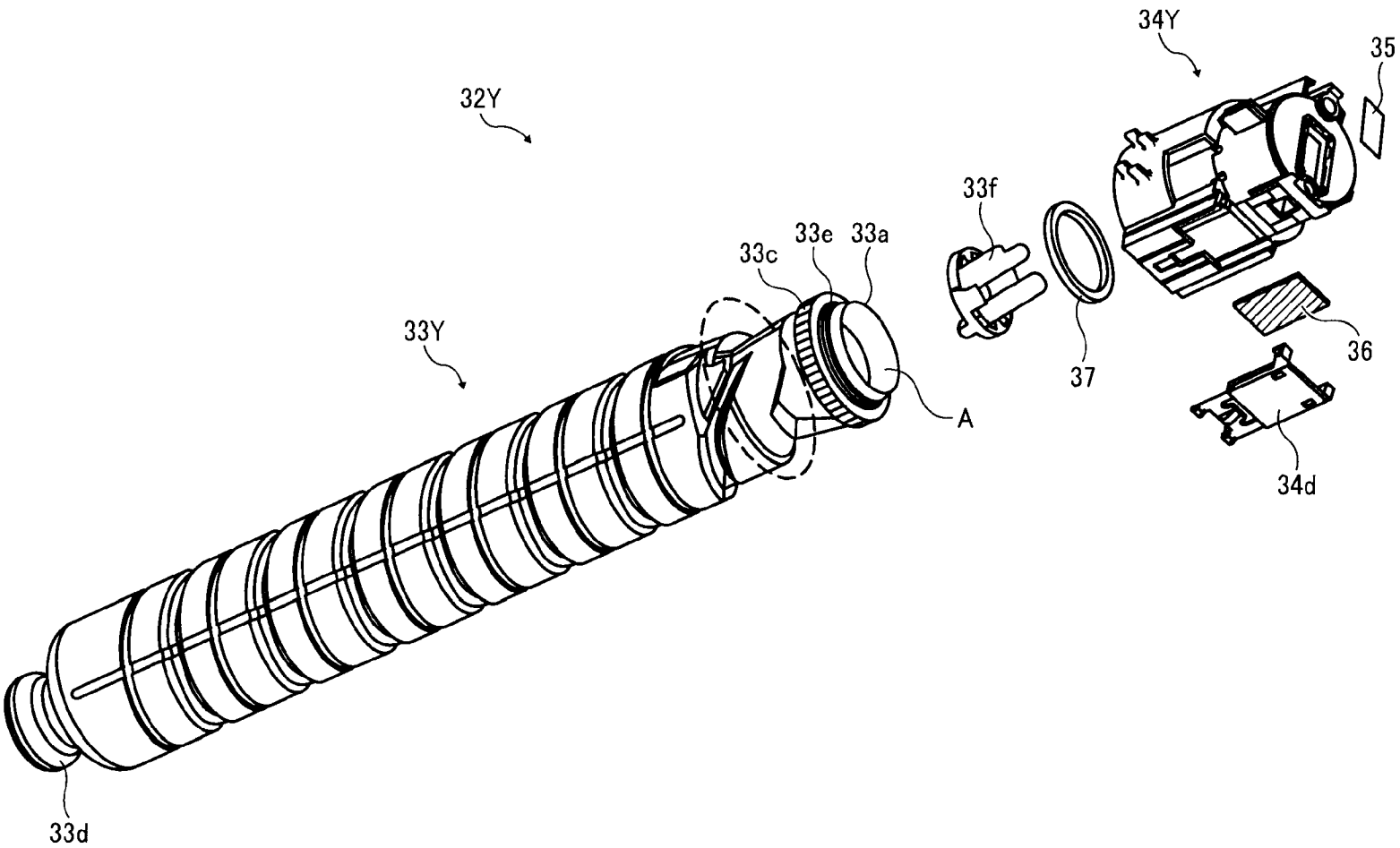
FIG. 9A is an exploded view illustrating the toner container shown in FIG. 5.
Figure 10:
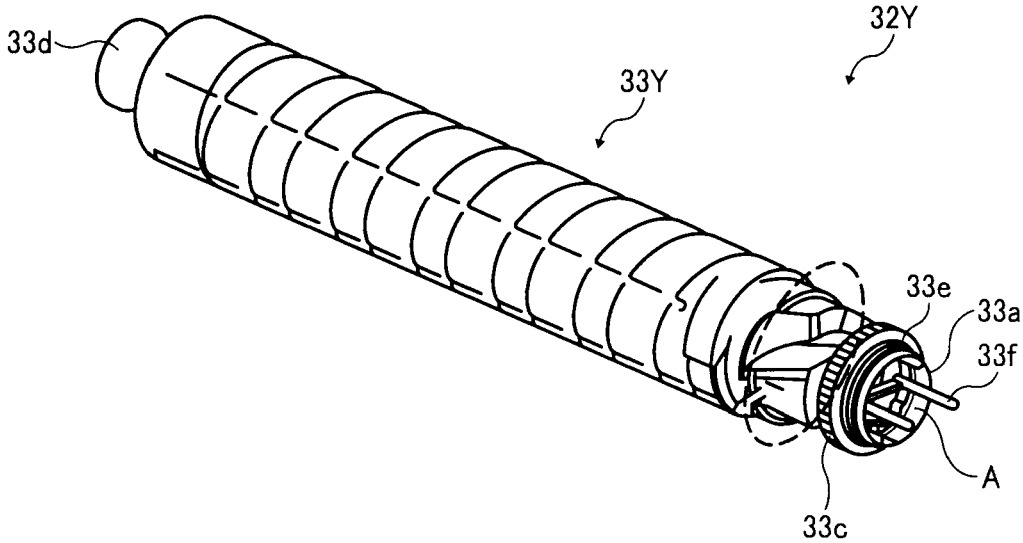
FIG. 10 is a perspective view of a container body included in the toner container shown in FIG. 5 when view from obliquely above.
Figure 11:
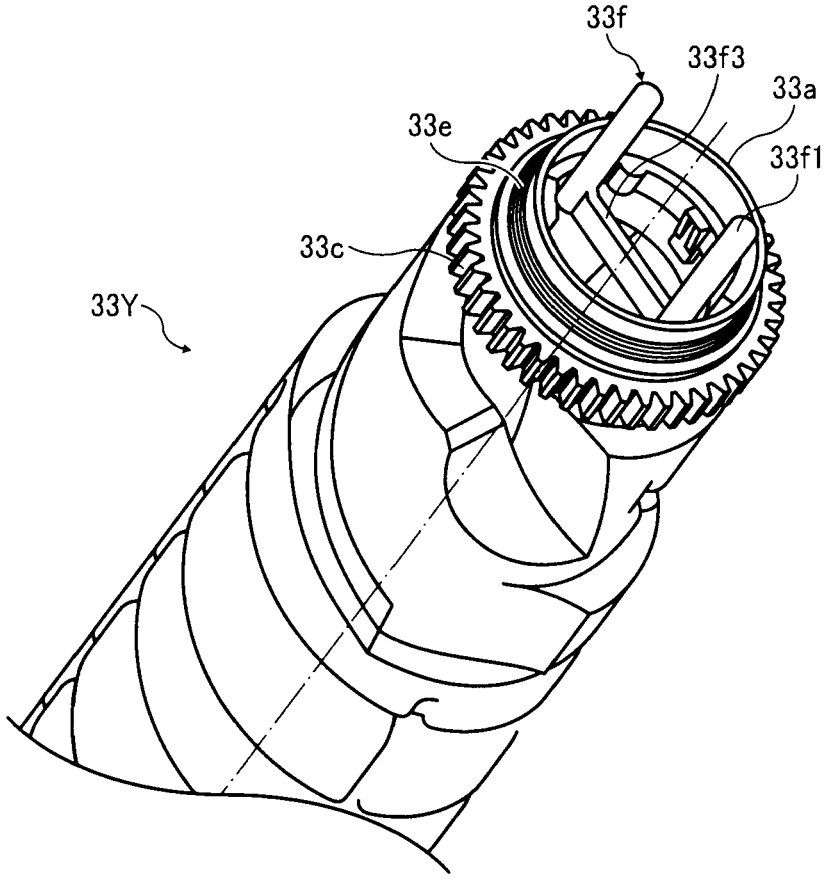
FIG. 11 is an enlarged view illustrating vicinity of an opening of the container body shown in FIG. 10.

FIGS. 8, 9A, and 10 are respectively a front view (from the cap side), an exploded view, and a perspective view of the toner container 32Y, and FIG. 11 is an enlarged view illustrating vicinity of the opening A of the container body 33Y. It is to be noted that, in FIG. 8, reference characters 34*a*, 34*b*, 34*c*, 34*g*, 34*h*, 34*m*, 34*s* respectively represent a primary positioning hole, a secondary positioning hole, lateral protrusions, a first discrimination portion, a second discrimination portion, a projecting member, and a vertical faces.

As shown in FIGS. 9A through 11, an opening A and the gear 33*c* that rotates together with the container body 33Y are provided on the front end side of the container body 33Y (front side of paper on which FIG. 8 is drawn). An end portion of the bottle body 33Y that encloses the opening A is hereinafter referred to as a mouth portion 33*a* of the container body 33Y. In addition, a hollow B and a dropping route C are formed in the cap 34Y (see FIGS. 28A and 52). The opening A is formed in edge face 34*a* (backside end) of the container body 33Y so that the toner in the container body 33Y is discharged to a space (the hollow B) in the cap 34Y.

It is to be noted that, conveyance of toner from the container body 33Y to the hollow B in the cap 34Y (rotation of the toner container 33Y) is performed as required to an extent that the level of toner does not fall below a predetermined limitation line.

As shown in FIG. 11, the gear 33*c* rotates the container body 33Y around a rotary axis (indicated by a broken line in FIG. 11) by engaging the driving gear 81 in the toner container frame 70 of the image forming apparatus 100. More specifically, the gear 33*c* is provided around the opening A and has multiple teeth that are radially arranged relative to the rotary axis of the container body 33Y. In addition, the gear 33*c* is partly exposed from a notch 34*x* (shown in FIG. 22) at the lower left in FIG. 8 (an engagement position) and engages the driving gear 81 in the image forming apparatus 100. Then, the driving force transmitted from the driving gear 81 to the gear 33*c* rotates the container body 33Y in a clockwise direction in FIG. 8. It is to be noted that, in the present embodiment, the driving gear 81 and the gear 33*c* are spur wheel gears.

As shown in FIGS. 5 and 6, the handle part 33*d* that is grasped by the user when the toner container 32Y is inserted into and released from the image forming apparatus 100 is provided on the back end side of the container body 33Y opposite to the front end side where the gear 33*c* is positioned. The user inserts/releases the toner container 32Y into/from the image forming apparatus 100 while holding the handle part 33*d*. At this time, the toner container 32Y is moved in a direction indicated by arrow Q shown in FIG. 5.

Further, the spiral protrusions 33*b* are provided on the inner circumferential face of the container body 33Y. The spiral protrusions 33*b* are spiral grooves in the outer circumferential surface of the container body 33Y when viewed from outside. The spiral protrusions 33*b* are for discharging the toner in the container body 33Y to the opening A by rotating the container body 33Y in a predetermined direction. The container body 33Y is formed together with peripheral elements including the spiral protrusions 33*b*, the gear 33*c*, and the handle part 33*d*, provided on the container body 33Y, by blow molding.

With reference to FIGS. 9A through 11, in the toner container 32Y, the agitator 33*f* that rotates together with the container body 33Y is fitted in the mouth portion 33*a* of the bottle body 33Y that encloses the opening A. The agitator 33*f* including stick members extending from the opening edge of the container body 33Y to the hollow B in the cap 34Y (see FIG. 28A). The agitator 33*f* is rotated together with the opening A of the container body 33Y, and therefore, workability in discharging toner from the opening A can be enhanced.

Figure 12:
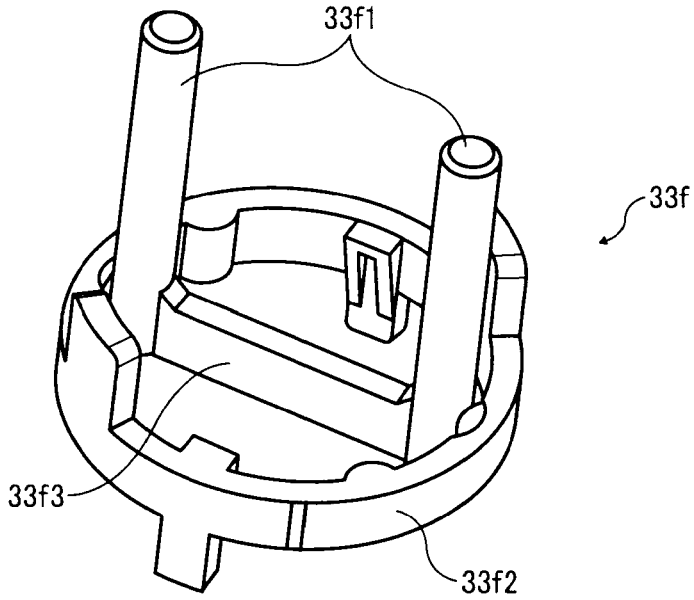
FIG. 12 is a perspective view illustrating an agitator provided in the container body shown in FIG. 11.
Figure 28A:
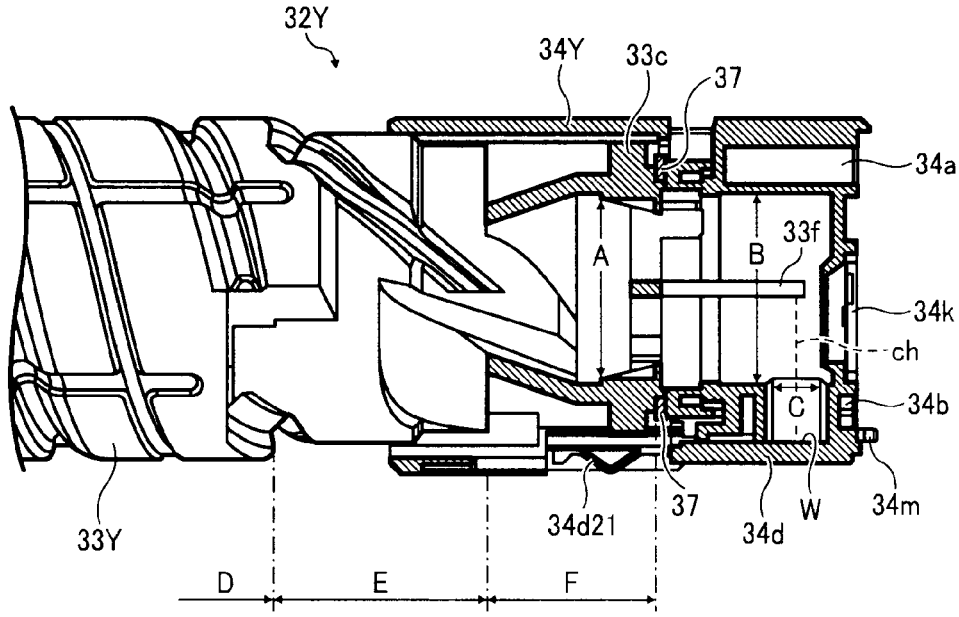
FIG. 28A is a cross-sectional view illustrating vicinity of the cap in the toner container shown in FIG. 9A.

More specifically, as shown in FIG. 12, the agitator 33*f* includes a pair of stick members 33*f*1, a circular engagement edge 33*f*2, and a bridge member 33*f*3. The pair of stick member 33*f*1 protrudes from the circular engagement edge 33*f*2 to the hollow B in the cap 34Y and their phases are shifted 180 degrees from each other. The bridge member 33*f*3 connects together the two stick members 33*f*1. This agitator 33*f* is fitted into the opening A of the bottle body 33Y, and the two cylindrical stick members 33*f*1 soften the toner in the hollow B formed in the cap 34Y while suitably weakening the conveyance force to convey the toner from the opening A of the container body 33Y to the hollow B in the cap 34Y. As a result, the amount of the toner supplied from the opening A of the container body 33Y to the hollow B in the cap 34Y does not become excessive, and therefore, the possibility of clogging of the hollow B in the cap 34Y with toner can be reduced. It is to be noted that, if the stick members **33*f*1 are disposed far from the toner outlet W and the toner dropping route C, the stick members 33*f*1 cannot soften the toner located closed to the toner outlet W because the two stick members 33*f*1 are cylindrical. Therefore, as shown in FIG. 28A, the stick members 33*f*1 are extended to a position just above the toner outlet W (toner dropping route C). More specifically, end portions of the stick members 33*f*1 is extended in the lateral direction in FIG. 28A more than half the diameter of the toner outlet W in that direction that is, their tips are positioned beyond a half line Ch (centerline of the cylindrical toner dropping route C) shown in FIG. 28**A).

In addition, when the amount of the toner supplied from the toner container 32Y to the toner supply device 60Y is relatively small because the amount of the toner consumed in the development device 5Y is relatively small, the container body 33Y of the toner container 32Y rotates for only a short time, and accordingly the container body 32Y rotates only a small angle to an extent that the container body 32Y does not go into 360-degree roll. However, in this case, because the phases of the two stick members **33*f* are shifted by 180 degrees, one of the stick members 33*f*1 can soften the toner positioned close to the toner outlet W (toner dropping route C). Further, in the agitator 33*f* according to the present embodiment, the bridge member 33*f*3 is provided to cross a center position of the circular engagement edge 33*f*2, the toner positioned close to the opening A can be softened by the bridge member 33*f*3**.

Figure 13:
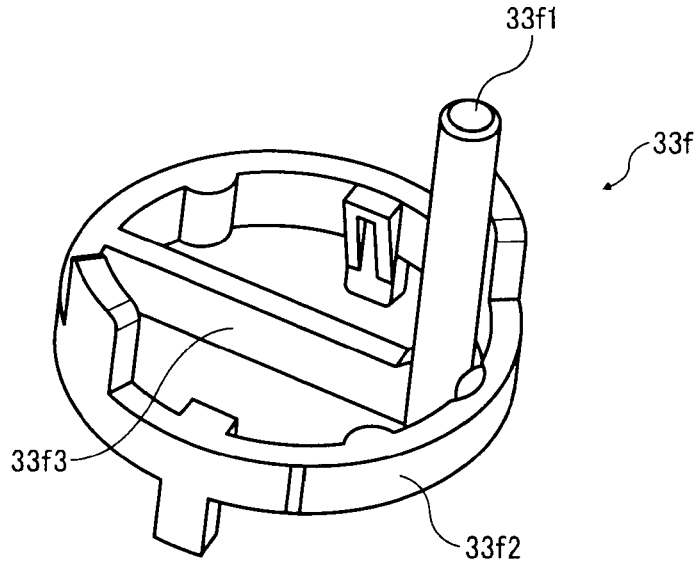
FIG. 13 is a perspective view illustrating a variation of the agitator provided in the container body shown in FIG. 11.

It is to be noted that, although the agitator **33*f* includes two stick members 33*f*1 in the present embodiment shown in FIG. 12, alternatively the agitator 33*f* can include only a single stick member 33*f*1 as shown in FIG. 13, or the agitator 33*f* can include three or greater number of stick members 33*f*1**.

(Variation)

Figure 9B:
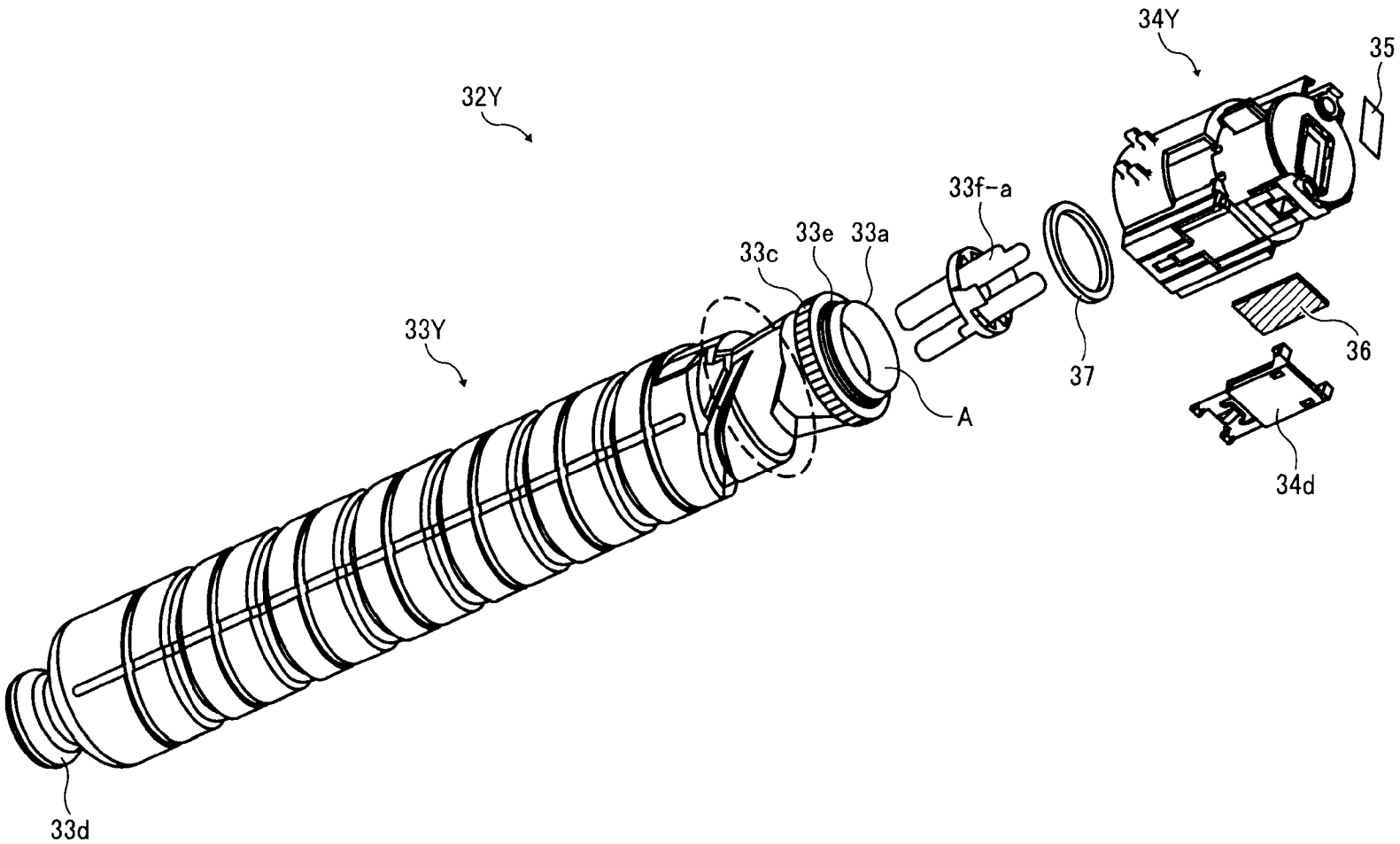
FIG. 9B is an exploded view illustrating a variation of the toner container shown in FIG. 9A.
Figure 28B:
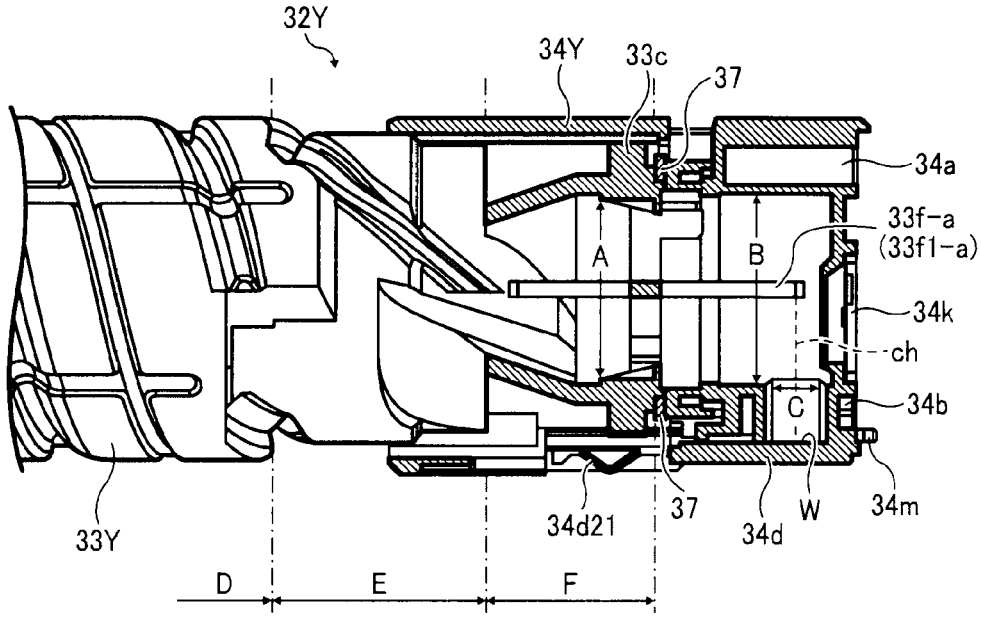
FIG. 28B is a cross-sectional view illustrating a variation of the cap in the toner container shown in FIG. 9B.

It is to be noted that the shape of the agitation member **33*f* is not limited the above-described configuration. For example, as shown in FIGS. 9B and 28B, the toner container 32Y can adopt an agitation member 32*f*-*a* that includes a pair of stick members 33*f*1-*a* instead of the stick members 33*f*1 shown in FIG. 12 as well. The pair of stick members 33*f*1-*a* protrudes from the circular engagement edge 33*f*2 to the hollow B in the cap 34Y and also protrudes inward of the small diameter space D of the container body 33Y from the circular engagement edge 33*f*2, and their phases are shifted 180 degrees from each other. In this variation, the stick members 33*f*1-*a* of the agitation ember 33*f*-*a* can soften the toner in the small diameter space D of the container body 33**Y in addition to the toner in the hollow B.

In this variation, similarly to the agitation member **33*f*, the two cylindrical stick members 33*f*1-*a* soften the toner in the hollow B while suitably weakening the conveyance force to convey the toner from the opening A of the container body 33Y to the hollow B in the cap 34Y, and, because the stick members 33*f*1 are extended to a position just above the toner outlet, the stick member 33*f*1 can soften the toner located close to the toner outlet W. In addition, when the amount of the toner supplied from the toner container 32Y to the toner supply device 60Y is relatively small because the amount of the toner consumed in the development device 5Y is relatively small, the container body 33Y of the toner container 32Y rotates for only a short time, and accordingly the container body 32Y rotates only a small angle to an extent that the container body 32Y does not go into 360-degree roll. However, in this case, because the phase of the two stick members 33*f* are shifted by 180 degrees, one of the stick members 33*f*1 can soften the toner positioned close to the toner outlet W (toner dropping route C). Further, the agitation member 33*f*-1 also includes the bridge member 33*f*3 provided to cross a center position of the circular engagement edge 33*f*2, and therefore, the toner positioned close to the opening A can be softened by the bridge member 33*f*3**.

Although the agitator **33*f*-*a* includes two stick members 33*f*1-*a* in the present variation, alternatively the agitator 33*f*-*a* can include only a single stick member 33*f*1-*a*, or the agitator 33*f*-*a* can include three or greater number of stick members 33*f*1-*a***.

Additionally, with reference to FIGS. 9A and 10, a protrusion **33*e* (hereinafter also "an engagement portion 33*e*") is provided an entire outer circumferential surface of the mouth portion 33*a* of the container body 33Y and engages an inside hook 34*j* (see FIG. 29) so that the container body 33Y and the cap 34Y are connected together. Thus, the container body 33Y engages the cap 34Y rotatably relative to the cap 34Y. Therefore, the gear 33*c* rotates relative to the cap 34**Y.

Further, referring to FIG. 28A, the container body 33Y includes a small-diameter space F positioned close to the gear **33*c* (front end side of the toner container) has an internal diameter A1 smaller than an internal diameter D1 of a containing space D of the container body 33Y in which the spiral protrusions 33*b*** are formed.

A pump-up space E (indicated by a broken line circle shown in FIGS. 9A, 10 and see FIG. 28A) projecting inward from the internal face of the container body 33Y is provided close to the small-diameter space F on the front end side of the container body 33Y. When the toner is conveyed to the opening A by the spiral protrusions **33*b* as the container body 33Y rotates, the toner is pumped up to the small-diameter space F on the front end side of the container body 33Y through the pump-up space E. Then, the toner pumped up to the small-diameter space F is agitated by the agitator 33*f* and is discharged from the opening A to the hollow B in the cap 34**Y.

Turning now to FIGS. 14 through 17, structure and operation of the cap 34Y according to the present embodiment are described below.

Figure 20:
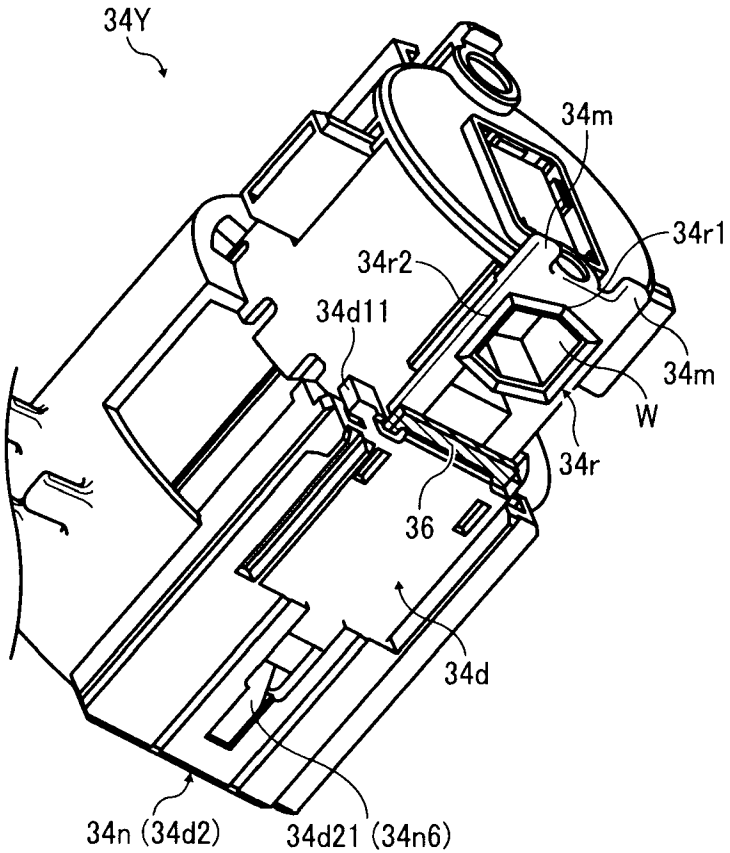
FIG. 20 is a perspective view illustrating the shutter provided on the cap shown in FIG. 18, when the shutter fully opens the toner outlet.

The toner container 32Y includes the shutter **34*d*, the shutter seal 36 serving as a seal member, the cap seal 37, and the RFID chip 35 (electronic data storage) as described above. The mouth portion 33*a* enclosing the opening A of the container body 33Y is inserted into back end side of an insertion opening 34*z* (see FIG. 29) of the cap 34Y, whose interior diameter is larger than that of the hollow B. With reference to FIGS. 20 and 28, the toner outlet W is formed in the lowest portion on the back end side of the cap 34**Y so that the toner discharged from the opening A is discharged outside by dropping under its own weight.

In addition, the shutter **34*d* to open and close the toner outlet W is slidably held on the back end side of the cap 34Y. More specifically, the toner outlet W is opened by moving the shutter 34*d* from the cap 34Y to the container body 33Y (moving from the right to the left in FIG. 28A) and is closed by moving the shutter 34*d* from the container member 33Y to the cap 34Y. The shutter 34*d* opens and closes the toner outlet W by moving together with the toner container 32Y as the container body 33Y is installed into and released from the toner container frame 70 in the image forming apparatus 100**.

Figure 18:
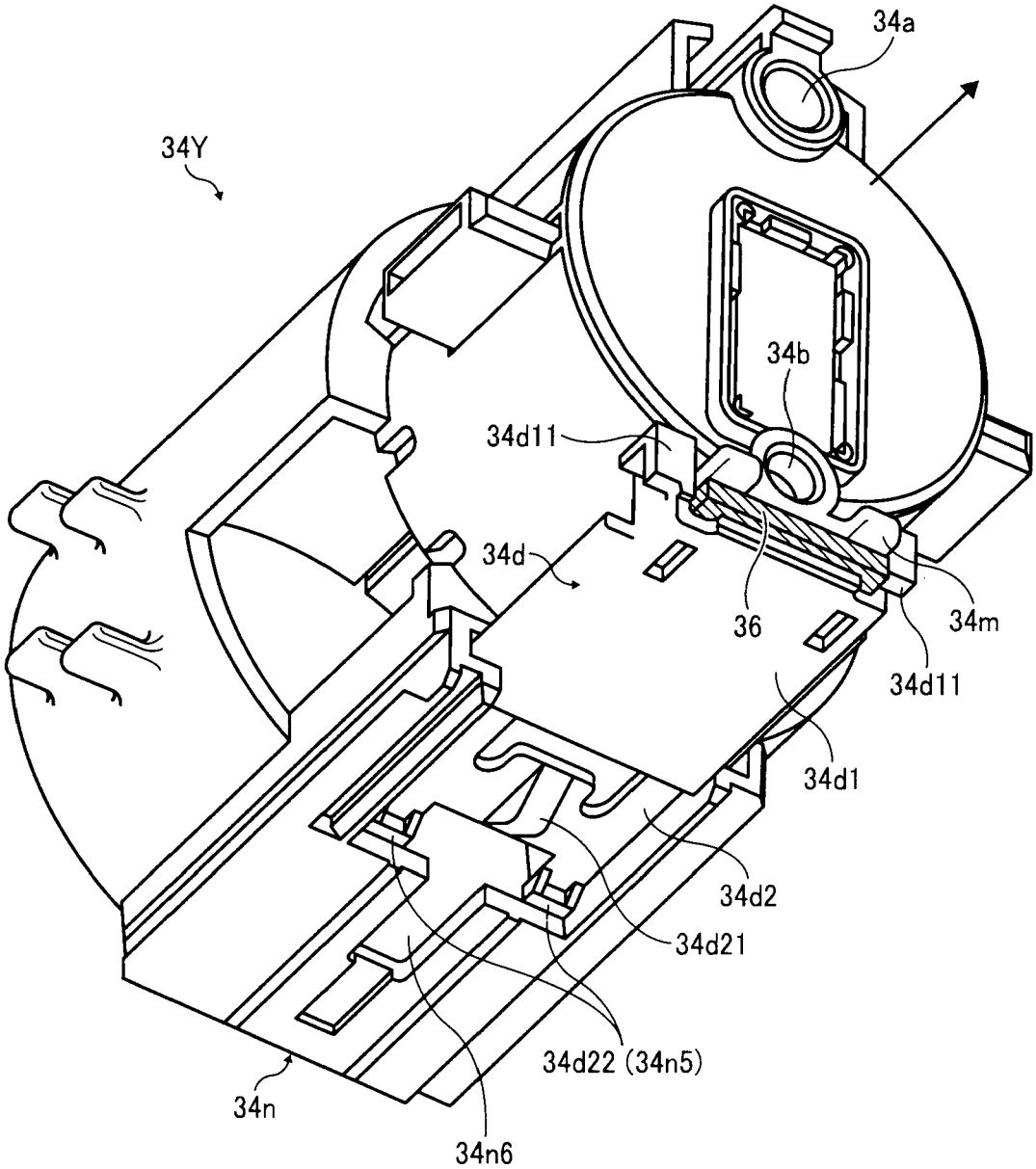
FIG. 18 is a perspective view illustrating a shutter provided on the cap shown in FIG. 14 when viewed from the bottom obliquely, when the shutter fully closes a toner outlet formed in a bottom surface of the cap.
Figure 19:
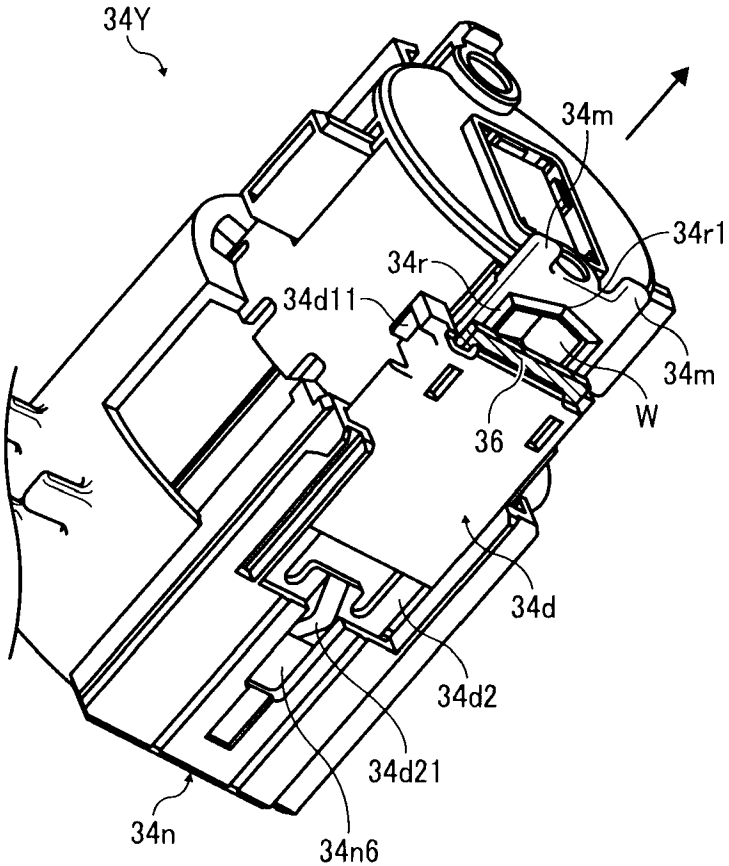
FIG. 19 is a perspective view illustrating the shutter provided on the cap shown in FIG. 18, when the shutter partly opens the toner outlet.

It is to be noted that, FIGS. 18 through 20 show a series of movements when the shutter **34*d*** opens the toner outlet W (from the start to the completion of the opening operation).

Figure 21A:
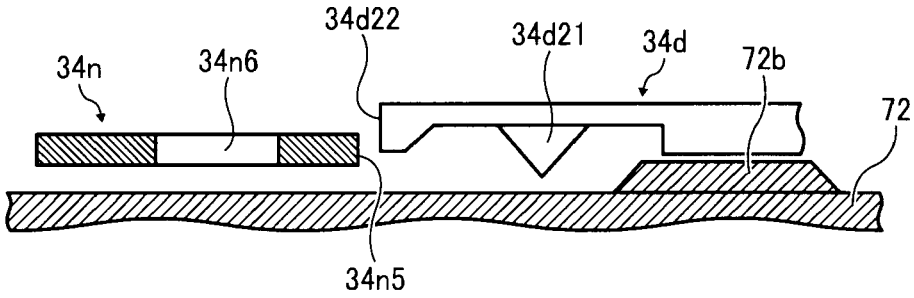
FIGS. 21A through 21C are diagrams schematically showing a process in which the shutter is opened relative to a shutter container of the cap shown in FIG. 16 in synchronization with the installation of the toner container into the toner container frame.
Figure 21B:
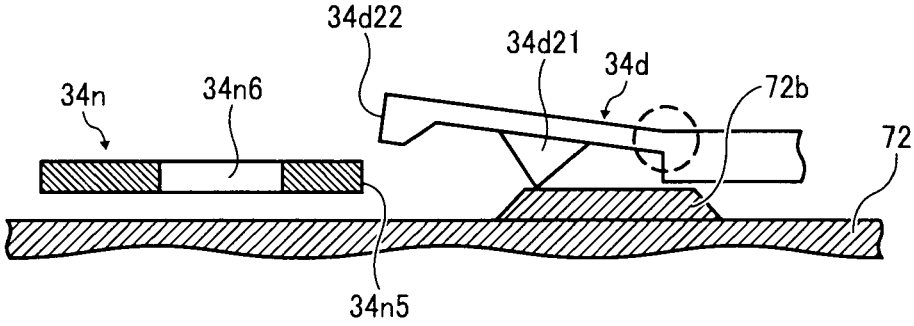
Figure 21C:
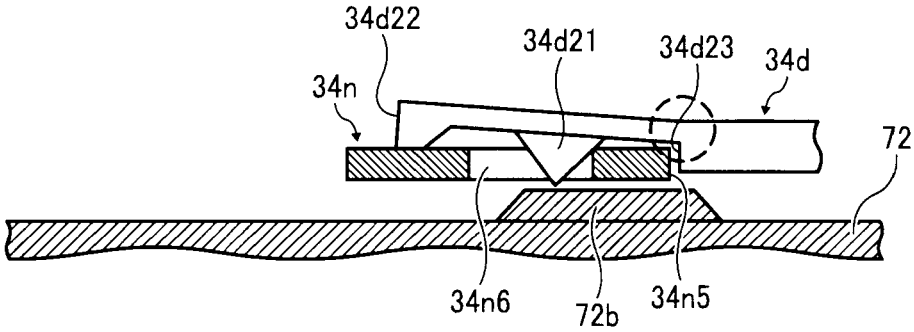

FIGS. 21A through 21C are schematic diagrams illustrating the shutter 34*d* (a shutter deformation portion 34*d*2 shown in FIG. 26) when the shutter 34*d* opens the toner outlet W.

Next, referring to FIGS. 14, 15, 39, and 40, the positioning of the cap 34Y in the cap holder 73 in the image forming apparatus is described below.

Figure 14:
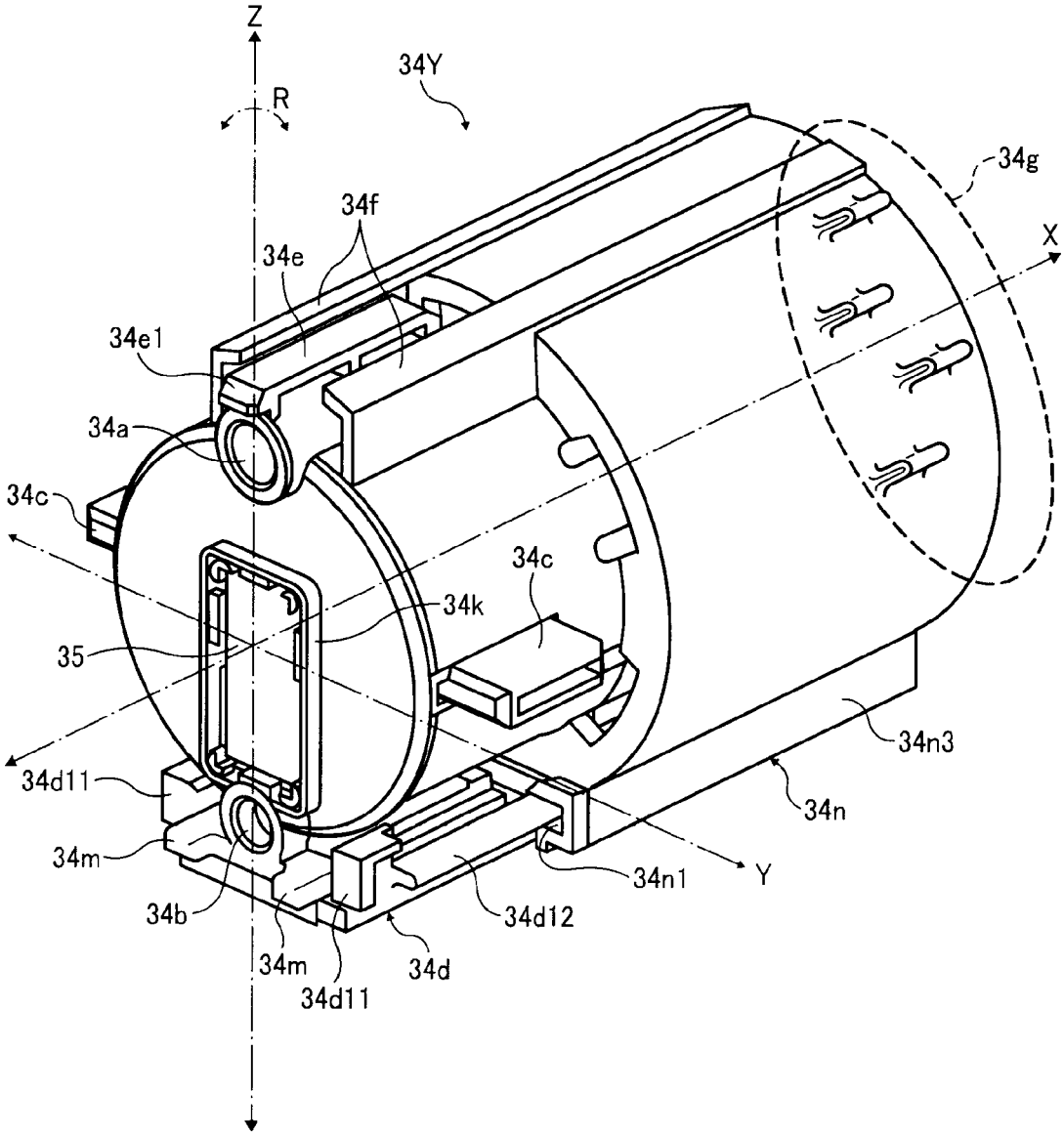
FIG. 14 is a perspective view illustrating a cap included in the toner container shown in FIG. 5 when viewed from the front side obliquely.
Figure 15:
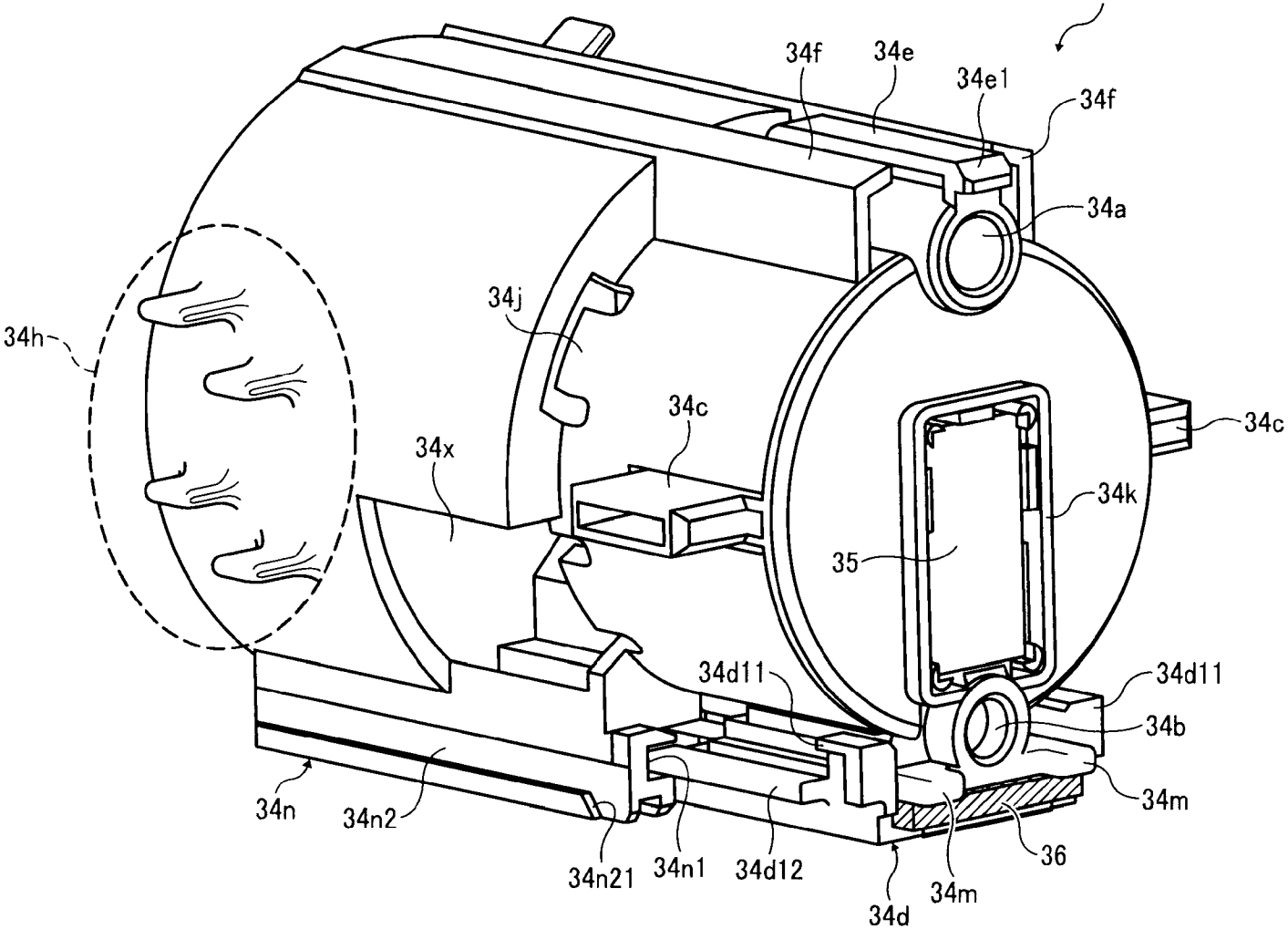
FIG. 15 is a perspective view illustrating the cap shown in FIG. 14 when viewed from another angle.

As shown in FIGS. 14 and 15, a primary positioning hole 34*a* is formed in an upper portion (a ceiling portion) of a front surface of the cap 34Y, that is, a face perpendicular to the longitudinal direction of the toner container 32Y and extended in the longitudinal direction of the cap 34Y. In addition, the primary positioning hole 34*a* is surrounded by a first surrounding wall 34*a*1, and the first surrounding wall 34*a*1 projects forward from the front surface of the cap 34Y in the longitudinal direction. The primary positioning hole 34*a* functions as a main positioning reference to determine an installation position of the cap 34Y of the toner container 32Y relative to the cap holder 73 in the image forming apparatus 100. More specifically, a main reference pin 73*a* of the cap holder 73 (see FIGS. 39 and 40) is fitted into the primary positioning hole 34*a* as the toner container 32Y to which the cap 34Y is attached is inserted into the toner container frame 70.

In addition, a secondary positioning hole 34*b* is formed in a lower portion (a bottom) of the front surface of the cap 34Y, that is, the face perpendicular to the longitudinal direction of the toner container 32Y and is extended in the longitudinal direction of the cap 34Y to an extent not to reach the toner outlet W. In addition, the secondary positioning hole 34*b* is surrounded by a second surrounding wall 34*b*1, and the second surrounding wall 34*b*1 projects forward from the front surface of the cap 34Y in the longitudinal direction. The secondary positioning hole 34*b* functions as a sub-positioning reference to determine the installation position of the cap 34Y of the toner container 32Y relative to the cap holder 73 in the image forming apparatus 100. More specifically, a sub-reference pin 73*b* of the cap holder 73 (see FIGS. 39 and 40) is fitted into the secondary positioning hole 34*b* by moving together with the toner container 32Y as the toner container 32Y is inserted into the toner container frame 70. It is to be noted that the secondary positioning hole 34*b* is elliptical and its vertical diameter is longer than the horizontal diameter thereof.

The position of the cap 34Y is determined by the above-described reference holes 34*a* and 34*b*. Further, with reference to FIG. 8, the positioning holes 34*a* and 34*b* are arranged so that a virtual perpendicular lines respectively passing through center positions of the primary positioning hole 34*a* and the secondary positioning hole 34*b* are aligned with the same straight line and also pass through a center position of the round body of the cap 34Y.

Herein, with reference to FIG. 28A, the depth of the primary positioning hole 34*a* (length of the main reference pin 73*a* in the longitudinal direction) is longer than the depth of the secondary positioning hole 34*b* (length of the sub-reference pin 73*b* in the longitudinal direction). With this configuration, in installation of the cap 34Y of the toner container 32Y into the cap holder 73 of the toner container frame 70, after insertion of the main reference pin 73*a* into the primary positioning hole 34*a* (main positioning reference) is started, insertion of the sub-reference pin 73*b* into the secondary positioning hole 34*b* (sub-positioning reference) is started. Thus, the cap 34Y of the toner container 32Y can be smoothly inserted into the cap holder 73 of the container fame 70.

In addition, because the primary positioning hole 34*a* whose length in the longitudinal direction is longer is provided in the ceiling portion of the cap 34Y so that the primary positioning hole 34*a* does not recess inward from the inner face of the round body of the cap 34Y, adverse effects of the primary positioning hole 34*a* on the conveyance ability (fluidity) of the toner in the cap 34Y can be prevented or reduced.

Further, although the secondary positioning hole 34*b* provided in the bottom portion of the cap 34Y, has such a shorter length that the secondary positioning hole 34*b* can be formed in a relatively short space that extends from the front surface of the cap 34Y to a front end of the toner outlet W, the secondary positioning hole 34*b* can sufficiently function as the sub-positioning reference to determine the position of the toner container 32Y.

With reference to FIGS. 8 and 14 through 17, a first engaging member 34*e* and the pair of second engaging members 34*f*, serving as first restriction members, are formed in the ceiling portion of the cap 34Y so as to position the cap 34Y in a horizontal direction indicated by arrow Y in FIG. 14, perpendicular to the longitudinal direction (indicated by arrow X) of the cap 34Y in the cap holder 73 in the image forming apparatus 100 indicated by arrow Y. Both of the first engaging member 34*e* and the second engaging members 34*f* project upward from the outer circumferential surface of the cap 34Y (indicated by arrow Z shown in FIG. 14) symmetrically relative to a virtual perpendicular line passing through the center position of the primary positioning hole 34*a* in cross sectional view perpendicular to the longitudinal direction, that is, a cross sectional view in parallel to the front surface of the cap 34Y shown in FIG. 8. In addition, the first engaging member 34*e* and the second engaging members 34*f* are extended along the ceiling of the round body of cap 34Y in the longitudinal direction indicated by the arrow X in FIG. 14 (in the direction orthogonal to the surface of paper on which FIG. 8 is drawn). In addition, the first engaging member 34*e* and the second engaging members 34*f* engage corresponding engaged portions 73*m* (projecting portions) in the cap holder 73 (see FIGS. 38 and 39). Therefore, the cap 34Y is inserted into or released from the cap holder 73 while the horizontal position of the cap 34Y is restricted by the first engaging member 34*e* and the second engaging members 34*f* respectively engaged with the engaged portions 73*m*. Then, in the state in which the cap 34Y is set in to the cap holder 73, the horizontal position of the cap 34Y is restricted.

More specifically, the first engaging member 34*e* (restriction member) is provided just above the primary positioning hole 34*a* and is almost rectangular in a cross sectional view perpendicular to the longitudinal direction. Further, the first engaging member 34*e* has a projecting engagement portion 34*e*1 that projects forward from the first surrounding wall 34*a*1 of the primary positioning hole 34*a*. As shown in FIG. 14, the projecting engaging portion 34*e*1 has a tapered tip, that is, its front side end is smaller than the backside end thereof.

Figure 39:
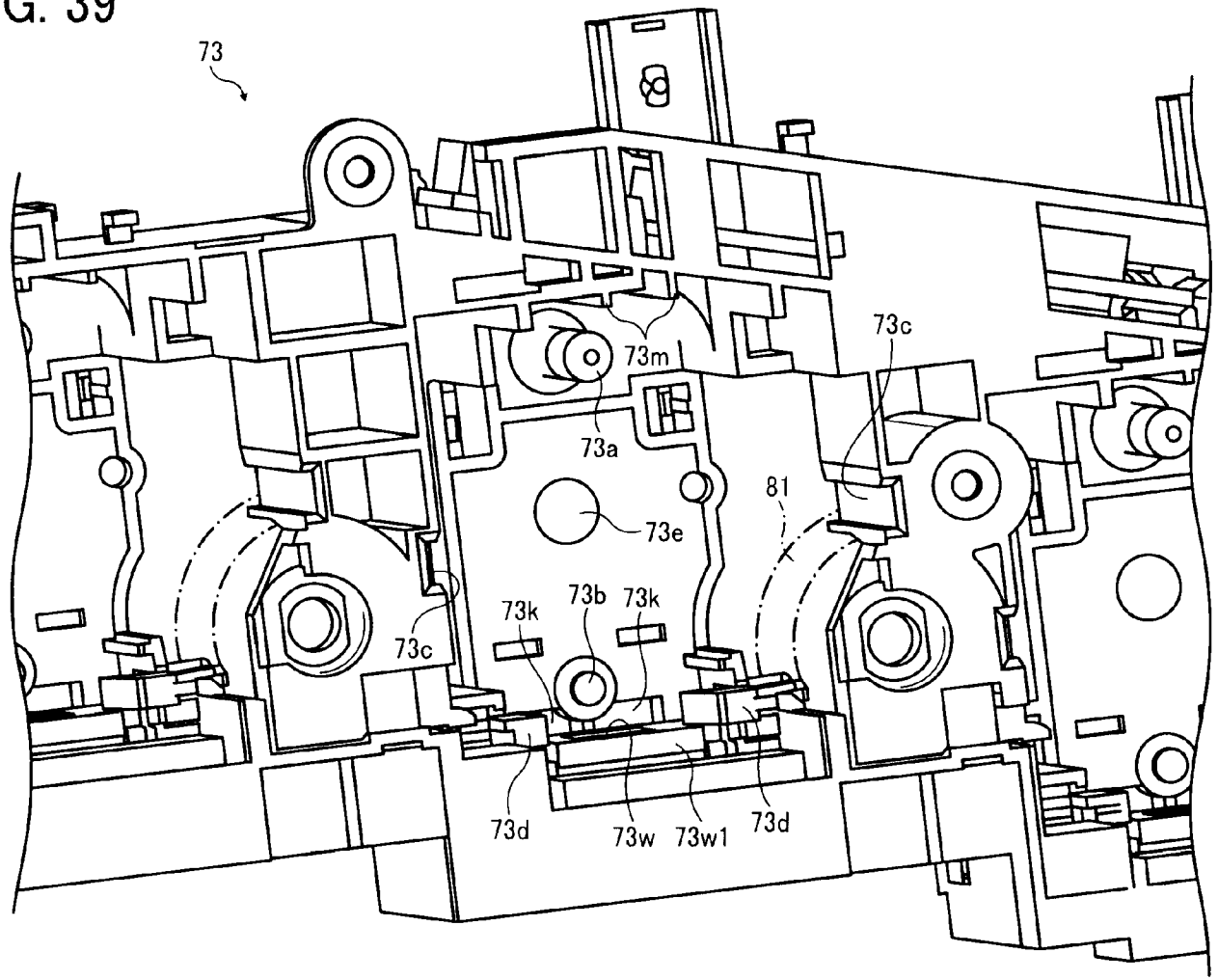
FIG. 39 is an enlarged perspective view illustrating the vicinity of the front wall of the cap holder shown in FIG. 38 when viewed from another angle.

On the other hand, the second engaging members 34*f* (restriction member) are formed so as to sandwich the first engaging member 34*e* from both side, and each engaging member 34*f* is L shaped when viewed in a cross sectional view perpendicular to the longitudinal direction (viewed from a front side of the cap 34Y shown in FIG. 8). In FIGS. 14 and 39, the first engaging member 34*e* engages the two engaged member 73*m*, that is, the first engaging member 34*e* is fitted between the two engaged portion 73*m*, and the second engaging member 34*f* engages the engaged portions 73*m*, that is, the two second engaging members 34*f* sandwich the two engaged portions 73*m* from outside. Herein, in installation of the cap 34Y into the cap holder 73, the tapered projecting engaging portion 34*e*1 projecting forward from the edge of the primary positioning hole 34*a* engages the engaged portions 73*m* before the second engaging members 34*f* engage the respective engaged portions 73*m*, and thus the cap 34Y can be smoothly installed into the cap holder 73.

With reference to FIGS. 37 through 42, the cap holder 73 includes four cap-surrounding portions (frames) 731Y, 731M, 731C, and 731K that surround the caps 34Y, 34M, 34C, and 34K of the toner container 32Y, 32M, 32C, and 32K, respectively. The lateral grooves 73*c* that engages the corresponding pair of the lateral protrusions 34*c* of the cap 34Y of the toner container 32Y are recessed from both sidewalls of the corresponding cap-surrounding portion 731Y in the cap holder 73 and is extended in the direction of insertion. In addition, the engaged portion 73*m* that engages the first engaging member 34*e* and the second engaging member 34*f* projects downward from a ceiling of the cap-surrounding portion 731Y of the cap holder 73, extending in the direction of insertion.

Further, with reference to FIGS. 14 through 17, the pair of lateral protrusions 34*c*, serving as a second restriction member, is formed on both sides on the outer circumferential face of the cap 34Y so as to position the cap 34Y in a rotation direction indicated by arrow R in FIG. 14 of the cap holder 73 in the image forming apparatus 100. The lateral protrusions 34*c* (second restriction member) protrude from lateral sides of the cap 34Y horizontally so as to be arranged in a virtual horizontal line passing through a center position of the line connecting the center position of the primary positioning hole 34*a* and the center position of the secondary positioning hole 34*b*, when viewed in a cross sectional view perpendicular to the longitudinal direction, and is extended in the longitudinal direction, a direction orthogonal to the surface of paper on which FIG. 8 is drawn.

Figure 38:
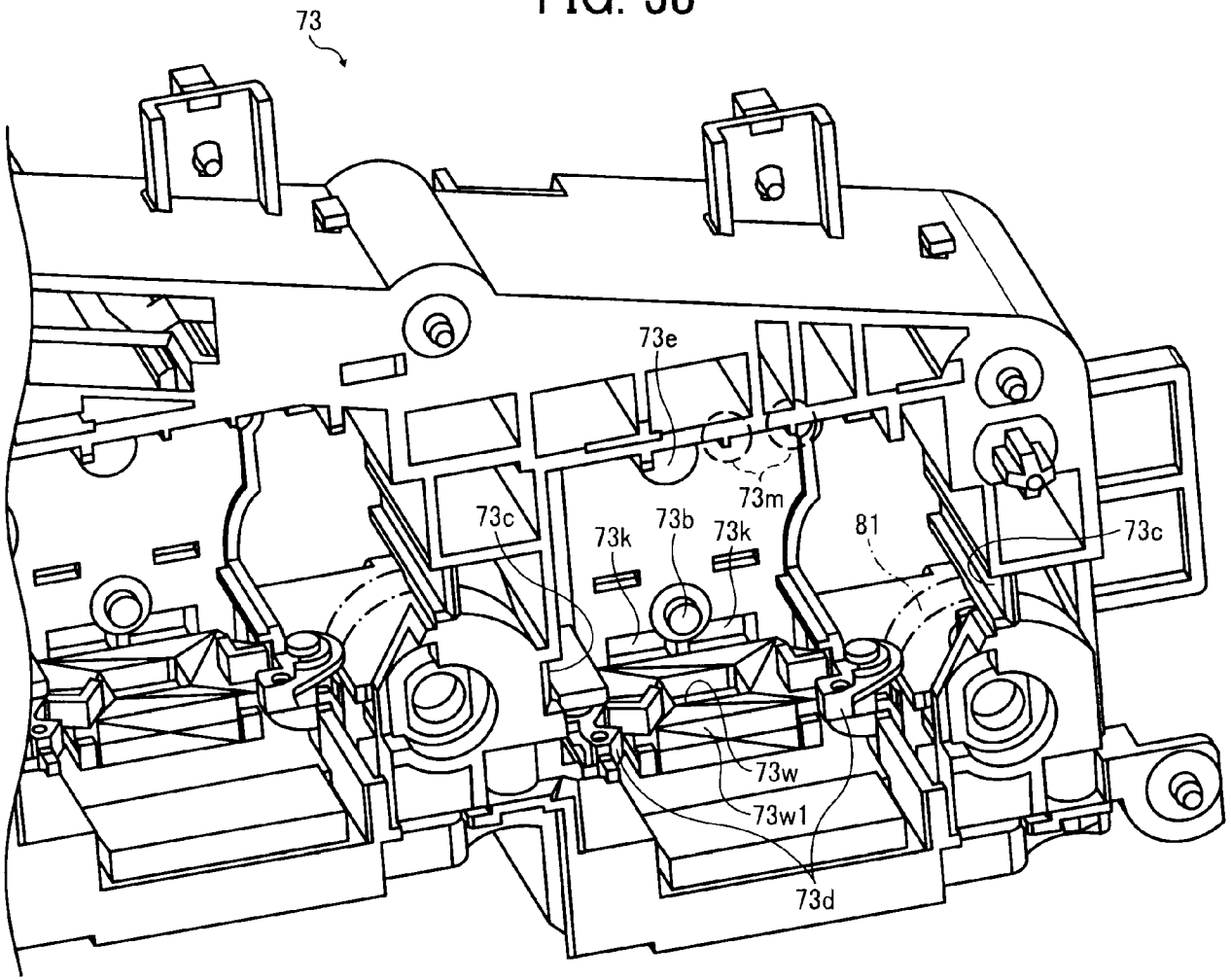
FIG. 38 is an enlarged perspective view illustrating vicinity of a front wall of the cap holder shown in FIG. 37.

With this configuration, the cap 34Y is installed into the cap holder 73 while the position of the cap 34Y in the rotation direction is restricted by the two lateral protrusions 34*c* (second restriction members) engaged with lateral grooves 73*c* (groove) of the cap holder 73 shown in FIG. 38. Then, in the state in which the cap 34Y is set in the cap holder 73, the position of the cap 34Y in the rotation direction is restricted by the engagement between the lateral protrusions 34Y and the lateral grooves 71*c*. More specifically, as shown in FIG. 14, front end tip portions 34*c*1 of the lateral protrusions 34*c* are tapered and their front side ends are smaller than the back side ends thereof.

As described above, in installation process of the cap 34Y into the cap holder 73, initially, the first engaging member 34*e* engages the engaged portions 73*m*, then, the second engaging members 34*f* engage the engaged portions 73*m*. Subsequently, the two lateral protrusions 34*c* whose front side tip 34*c*1 is tapered engage the lateral grooves 73*c*. Accordingly, the cap 34Y can be smoothly installed into the cap holder 73 while the position of the cap 34Y is reliably restricted by the restriction members 34*e*, 34*f*, and 34*c*.

With reference to FIGS. 14 and 15, the RFID chip 35, serving as the electronic data storage, is set in the mounting section 34*k* provided on the front surface of the cap 34Y. The mounting section 34*k* to accommodate the RFID chip 35 is enclosed by an outer rib (frame) 34*k*1 protruding forward from the front surface of the cap 34Y and is positioned between the primary positioning hole 34*a* and the secondary positioning hole 34*b*.

The RFID chip 35 is kept at a position facing the antenna 73*e*, a predetermined distance away from the antenna 73*e* in the cap holder 73*e* in the state in which the cap 34Y is set in the cap holder 73 of the toner container holder 70. Thus, the RFID chip 35 contactlessly communicates with the antenna 73*e* (wireless communication).

Herein, because the RFID chip 35 is mounted between the primary positioning hole 34*a* (main positioning reference) and the secondary positioning hole 34*b* (sub-positioning reference) in the present embodiment, the position of the RFID chip 35 can be determined with a higher degree of accuracy relative to the antenna 73*e* of the cap holder 73. Accordingly, the communication failure caused by positional deviation of the RFID chip 35 relative to the antenna 73*e* (antenna for RFID chip) can be prevented.

It is to be noted that the projecting engaging portion 34*e*1 and the two projecting members 34*m* project forward more than the outer rib 34*k*1 of the mounting section 34*k* surrounding the RFID chip 35. Therefore, even when the user puts the toner container 32Y on a given object with the cap 34Y on the lower side, because the mounting section 34*k* accommodating the RFID chip 35 contacts the object directly, the RFID chip 35 is less likely to receive damage directly and be broken.

With reference to FIGS. 14, 15, and 30A through 30D, compatibility (color discrimination) of the toner containers 32Y, 32M, 32C, and 32K is described below.

FIGS. 30A through 30D show the vicinity of the inserting openings 710Y in inserting portions 71Y, 71M, 71C, and 71K in the inserting portion 71 (shown in FIG. 4) of the toner container frame 70.

As shown in FIGS. 14 and 15, the discrimination portions 34*g* and 34*h* used for identifying compatibility are provided on the outer circumferential surface of the cap 34Y. When the toner container 32Y is properly inserted into the toner container frame 70, respective discrimination protrusions (clawed shape members) of the discrimination portions 34*g* and 34*h* engage corresponding recessed engagement portions 71*g* and 71*h* formed in the insertion portion 71 of the toner container frame 70 shown in FIGS. 30A through 30D.

It is to be noted that, in the description below, the discrimination protrusion portions 34*g* and 34*h* and the engagement portions 71*g* and 71*h* for yellow, magenta, cyan, and black are respectively given reference character Y, M, C, and K positioned between the reference numeral and the reference character g or h.

Figure 30A:
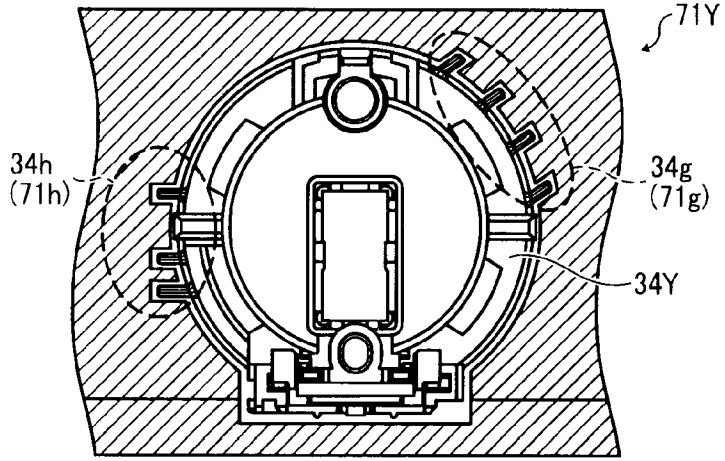
FIGS. 30A through 30D show vicinity of inserting openings in inserting portions of the toner container frame shown in FIG. 4 when the respective color of the toner containers are set in the inserting opening.
Figure 30B:
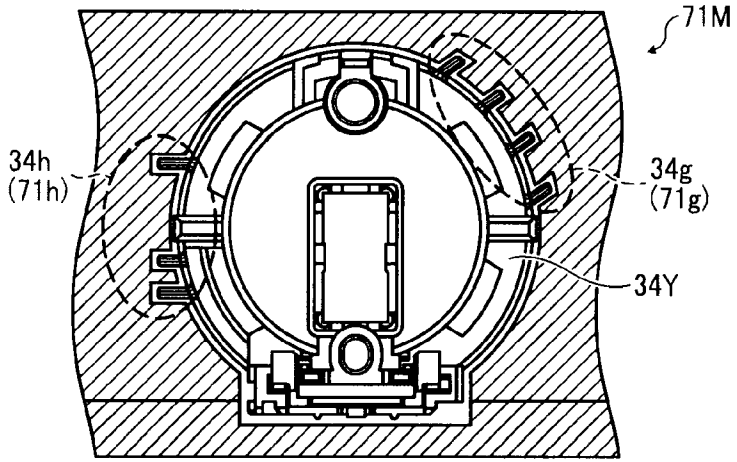
Figure 30C:
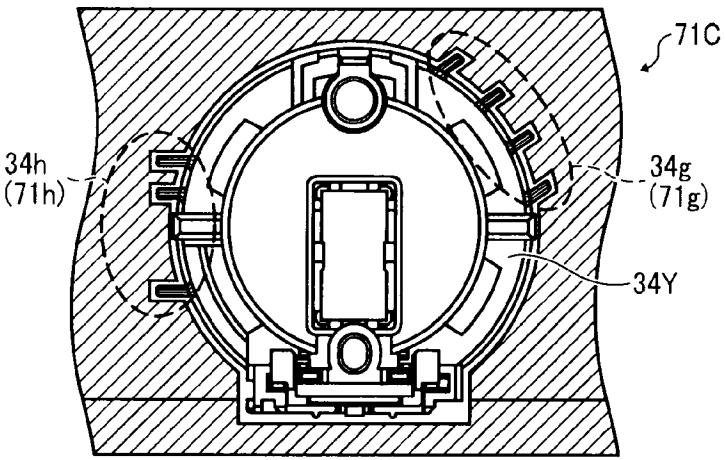
Figure 30D:
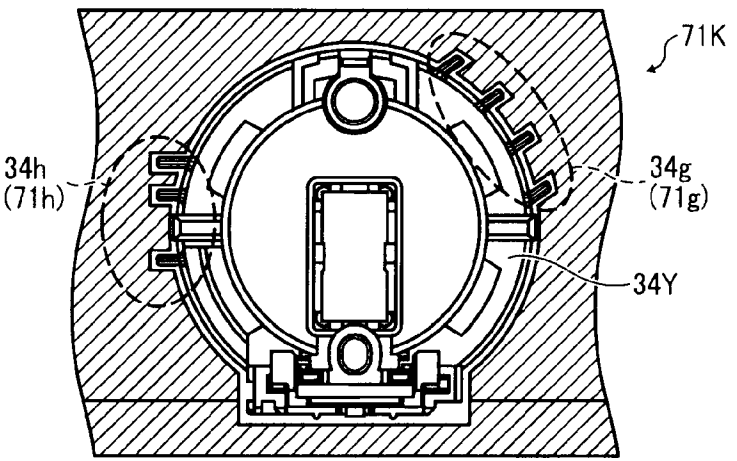

More specifically, in FIG. 30A, the discrimination portions 34Yg and 34Yh on the cap 34Y (yellow) is formed so that the discrimination protrusions of the description portions 34Yg and 34Yh are fitted into only the recessed engagement portions 71Yg and 71Yh provided around the inserting opening 710Y formed in the inserting portion 71Y of the toner container frame 70. In FIG. 30B, the discrimination portions 34Cg and 34Ch on the cap member 34C (cyan) is formed so that the discrimination protrusion of the description portions 34Cg and 34Ch are fitted into only the recessed engagement portions 71Cg and 71Ch provided around the inserting opening 710C formed in the inserting portion 71C of the toner container frame 70. In FIG. 30C, the discrimination protrusion portions 34Mg and 34Mh on the cap member 34M (magenta) is formed so that the discrimination protrusions of the discrimination portions 34Mg and 34Mh are fitted into only the recessed engagement portions 71Mg and 71Mh provided around the inserting opening 710M formed in the inserting portion 71M of the toner container frame 70. In FIG. 30D, the discrimination protrusion portions 34Kg and 34Kh on the cap member 34K (black) is formed so that the discrimination protrusions of the discrimination portions 34Kg and 34Kh are fitted into only the recessed engagement portions 71Kg and 71Kh provided around the inserting opening 710K formed in the inserting portion 71K of the toner container frame 70.

As described above, because arrangement of the discrimination protrusions in the discrimination portions 34Yg and 34Yh used for yellow (see FIGS. 8 and 9), the discrimination portions 34Mg and 34Mh used for magenta, the discrimination portions 34Cg and 34Ch used for cyan, and the discrimination portions 34Kg and 34Kh used for black are positioned differently from each other, each of the recessed engagement portions 71Yg and 71Yh, 71Mg and 71Mh, 71Cg and 71Ch, and 71Kg and 71Kh can engage only the corresponding color of the toner container 32 among the toner containers 32Y, 32M, 32C, and 32K in accordance with the identification of the discrimination portions 34Yg and 34Yh 34Mg and 34Mh 34Cg and 34Ch, and 34Kg and 34Kh. Accordingly, because the discrimination portions 34Cg and 34Ch can prevent the toner container 32Y, 32M, or 32K that contains toner other than cyan toner from being inserted into the connected to the toner container frame 71C (for cyan), failure that the desired color image cannot be formed can be prevented. That is, due to the discrimination portions 34*g* and 34*h*, the setting (color discrimination) error of the toner container 32 in the toner container frame 70 can be prevented.

Herein, the discrimination portions 34*g* and 34*h* can have the respective color identification by cutting off some of the discrimination protrusions formed therein differently in accordance with the color of toner contained in that toner container 32. When the certain protrusion from a total of eight protrusions is cut off from the discrimination portions 34*g* and 34*h* formed on the cap member 34 as shown in FIG. 8 with a cutting jig, (e.g., nippers or cutters), various types of the discrimination portions 34*g* and 34*h* can be formed. In the present embodiment, the four different discrimination portions 34*g* and 34*h* can be formed as shown in FIGS. 30A through 30D. In this configuration, in manufacturing process, manufacturing multiple different types of molds in accordance with the number of the type of the toner containers 32 (cap members 34) is not required. Instead, the cap members 34Y 34C, 34M and 34K for compatibility can be manufactured by using only one type of the mold, and therefore, the manufacturing cost of the multiple types of the toner containers 32 can be reduced. It is to be noted that, in the present embodiment, although the four types of the cap members 34 are formed as shown in FIGS. 30A through 30D, other types of cap members can be formed with a different combination of the discrimination protrusions by cutting off unnecessary discrimination protrusions differently.

Figure 31A:
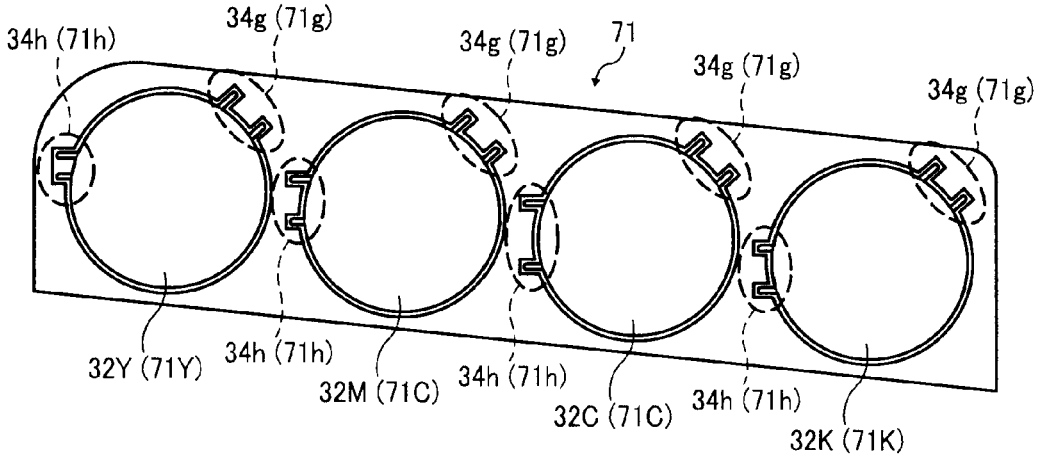
FIGS. 31A through 31C shows variations of the inserting portions shown in FIGS. 30A through 30D when variations of the toner containers are set in the insertion openings of the insertion portions.
Figure 31B:
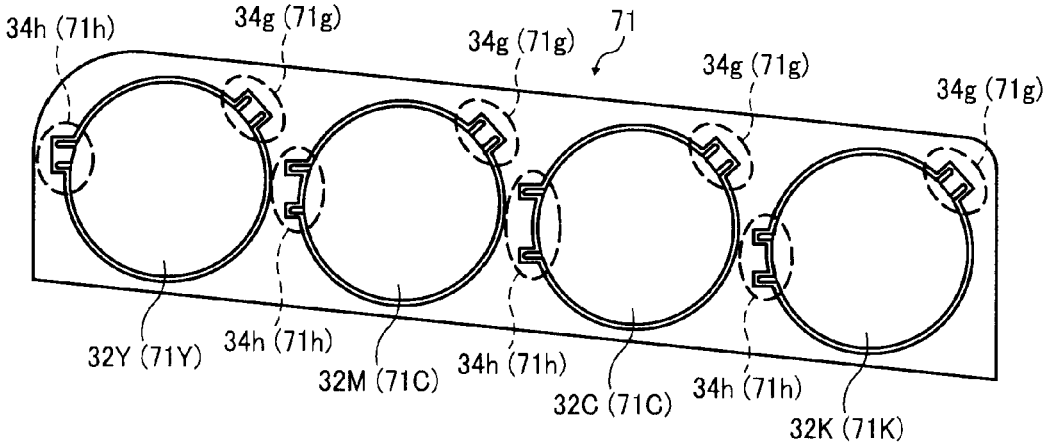
Figure 31C:
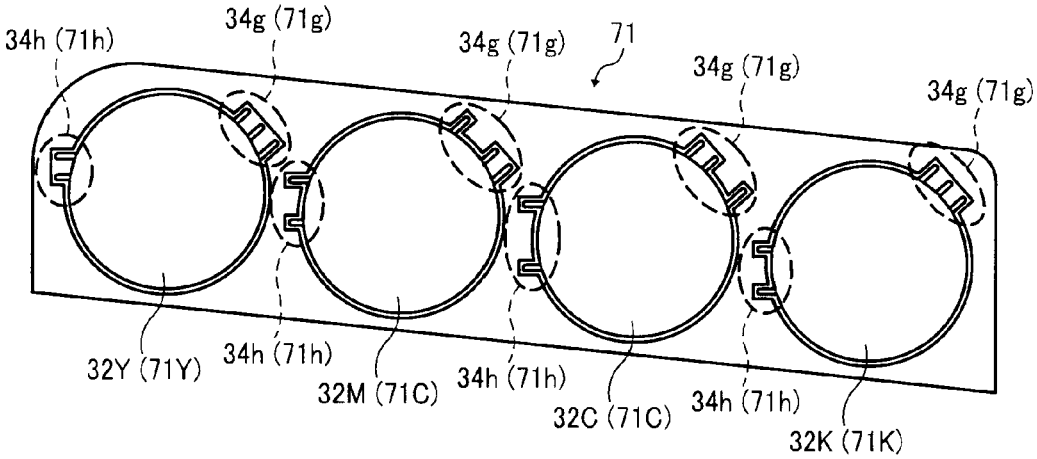

FIGS. 31A through 31C shows variations of the inserting portions 71, and the toner containers 32Y, 32M, 32C, and 32K are differently arranged in the inserting portions 71 shown in FIGS. 31A through 31C. In FIGS. 31A through 31C, wherever the discrimination protrusions in the discrimination portions 34*g* and 34*h* are arranged, the discrimination portion 34*g* (recessed engagement portion 71*g*) does not interfere with the discrimination portions 34*h* (recessed engagement portion 71*h*) provided adjacent to the inserting opening 710 in the inserting portions 71. The four inserting openings 710Y, 700M, 710C, and 710K in the inserting portion 71 are arranged not in horizontal but arranged obliquely, so that the upper discrimination portion 34*g* (34Yg) of, for example, the toner container 32Y for yellow is located higher than the lower discrimination portion 34*h* (34Mh) of the adjacent toner container 32M for magenta. It is to noted that when viewed from a front side in the cross sectional view, perpendicular to the longitudinal direction in FIGS. 31A through 31C, the respective protrusions (clawed shape members) of the discrimination portions 34*g* project outward from the outer circumferential surface of the cap member 34 in parallel to each other, and the respective protrusions (clawed shape members) of the discrimination portions 34*h* project outward in parallel to each other.

In addition, the discrimination portions 34*g* and 34*h* are arranged so as to sandwich a center vertical line of the respective cap members 34 when vied from front side shown in FIG. 8. That is, one of the discrimination protrusions of the discrimination portions 34*g* and 34*h* are located on the right side of the center vertical line of the cap member 34 (see FIG. 31) and the other of the discrimination protrusions of the discrimination portions 34*g* and 34*h* are located on the left of the center vertical line. Accordingly, when any of the incorrect toner container 32M, 32C, and 32K is inserted into the opening 710Y in the inserting portion 71Y of the container frame 70, deformation of the incorrect toner containers 32M, 32C, or 32K caused by the force localized to one side of the cap member 34M, 34C, 34K, exerted from the discrimination protrusions pressing against the vicinity of the recessed engagement portions 71*g* and 71*h* of the inserting portion 71Y can be prevented. That is, when any incorrect toner container 32M, 32C, or 32K is inserted into the opening 710Y in the inserting portion 71Y of the container frame 70, the pressing force exerted from the respective discrimination protrusions of the 34*g* and 34*h* can be distributed to the vicinity of the inserting opening 710Y of the toner container frame 70 on both sides in a balanced manner in the cap member 34M, 34C or 34K. In order to accomplish the effect, it is preferable that the discrimination portions 34*g* and 34*h* are separated from each other with differences between the angle positions thereof on the circumferential surface of the cap 34Y shifted ranging from 120° to 240°.

It is to be noted that, in FIGS. 14 and 15, the shutter 34*d* includes a pair of handle parts 34*d*11 and a pair of the shutter sliders 34*d*12, and a shutter container 34*n* of the second container body 34Y2 includes a pressing rail 34*n*2, a front side tip portion 34*n*21 of the pressing rail 34*n*2, and a pressure receiving face 34*n*3.

With reference to FIG. 15, the notch 34*x* is formed on the outer conferential surface of the cap 34Y, and the gear 33*c* in the container body 33Y is partly exposed from the notch 34*x* when viewed from outside. In the state in which the toner container 32Y is set in the toner container frame 70, the gear 33*c* exposed from the notch 34*x* of the cap 34Y engages the driving gear 81 provided in the cap holder 81 (see position broken line in FIG. 38), and therefore, the container body 33Y is rotated with the gear 33*c* by the driving gear 81.

Figure 16:
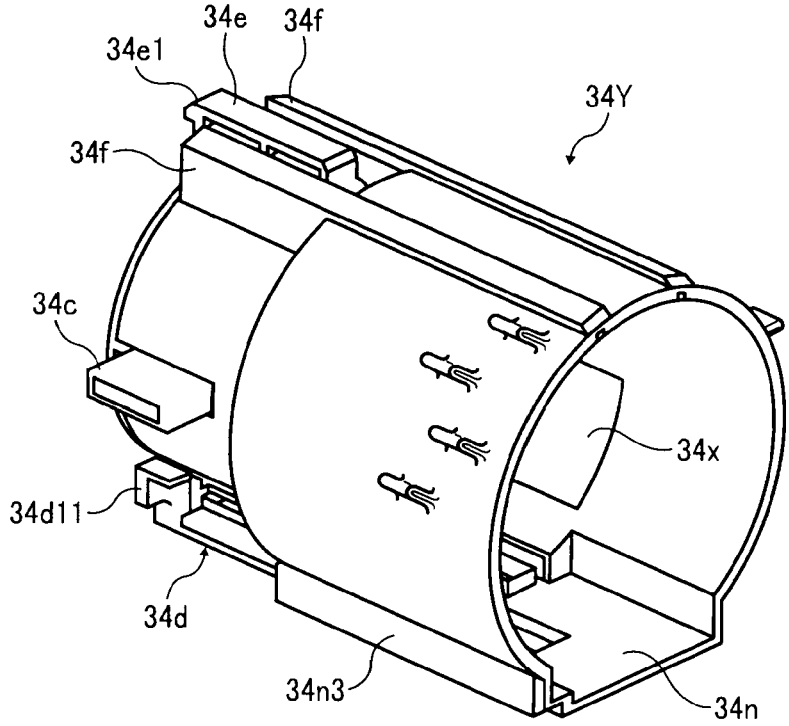
FIG. 16 is a perspective view illustrating the cap shown in FIG. 14 when viewed from connection side in which the cap connects the container body in the toner container.
Figure 17:
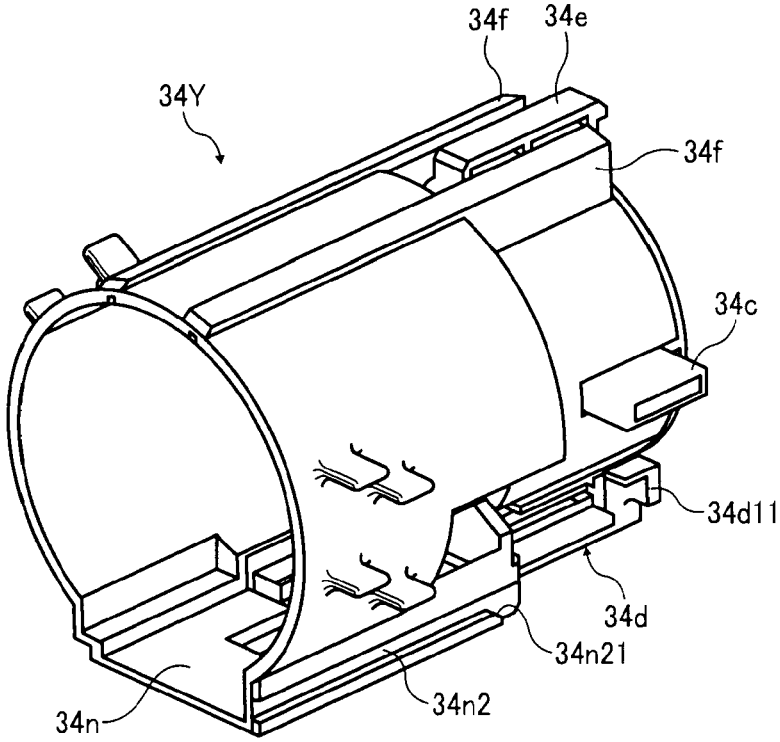
FIG. 17 is a perspective view illustrating the cap shown in FIG. 14 when viewed from another angle of the connection side shown in FIG. 16.

With reference to FIGS. 16 and 17, the shutter container 34*n* (containing space) is formed in the lowest space of (a second cap body 34Y2 shown in FIG. 25 of) the cap 34Y. The shutter container 34*n* (containing space) is for containing a part of the shutter 34*d* (shutter deformation portion 34*d*2 in the shutter 34*d* see FIG. 26) when the shutter 34*d* opens the toner outlet W. The space forming the shutter container 34*n* is a substantially rectangular parallelepiped projecting downward from the insertion opening 34*z* shown in FIG. 29. (The shutter container 34*n* is defined by a bottom side faces of the second cap body 32Y2 and the insertion opening 34*z*.)

Figure 22:
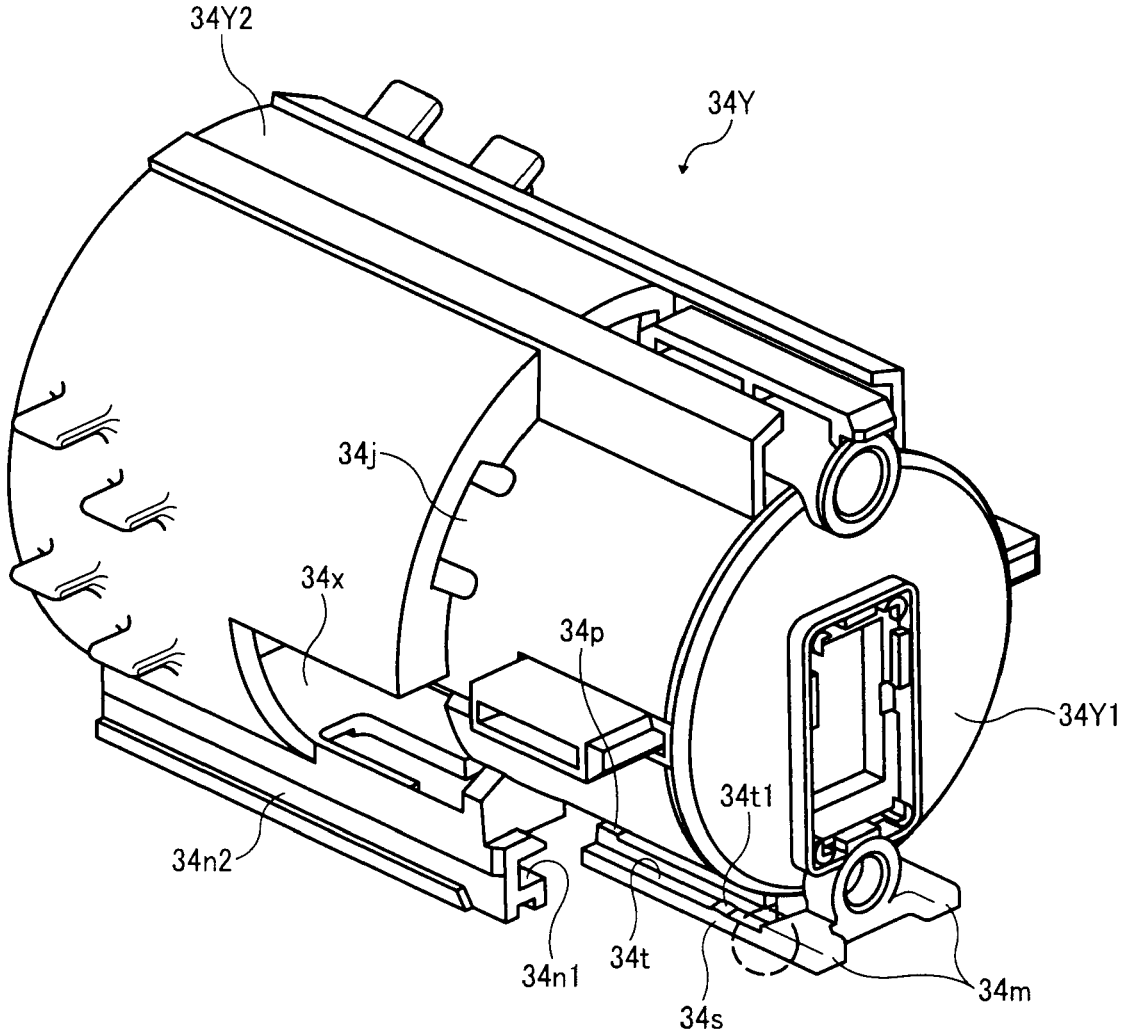
FIG. 22 is a perspective view illustrating the cap when viewed from the angle shown in FIG. 15, when the shutter is detached from the cap.

The shutter container 34*n* accommodates the shutter deformation portion 34*d*2 in a deformation state, meaning that the shutter deformation portion 34*d*2 is elastically deformed (pivoted) upward around a connection portion with a main shutter portion 34*d*1 shown in FIG. 22. Herein, with reference to FIGS. 14 and 15, the slide groove 34*n*1 functioning as an outside rail to guide the shutter member 32*d* to open and close with a shutter rail 34*t* (see FIG. 22) functioning as an inside rail is formed on an interior wall of the shutter container 34*n*. It is to be noted that the configuration and operation of the shutter 34*d* are described in further detail later.

Figure 34:
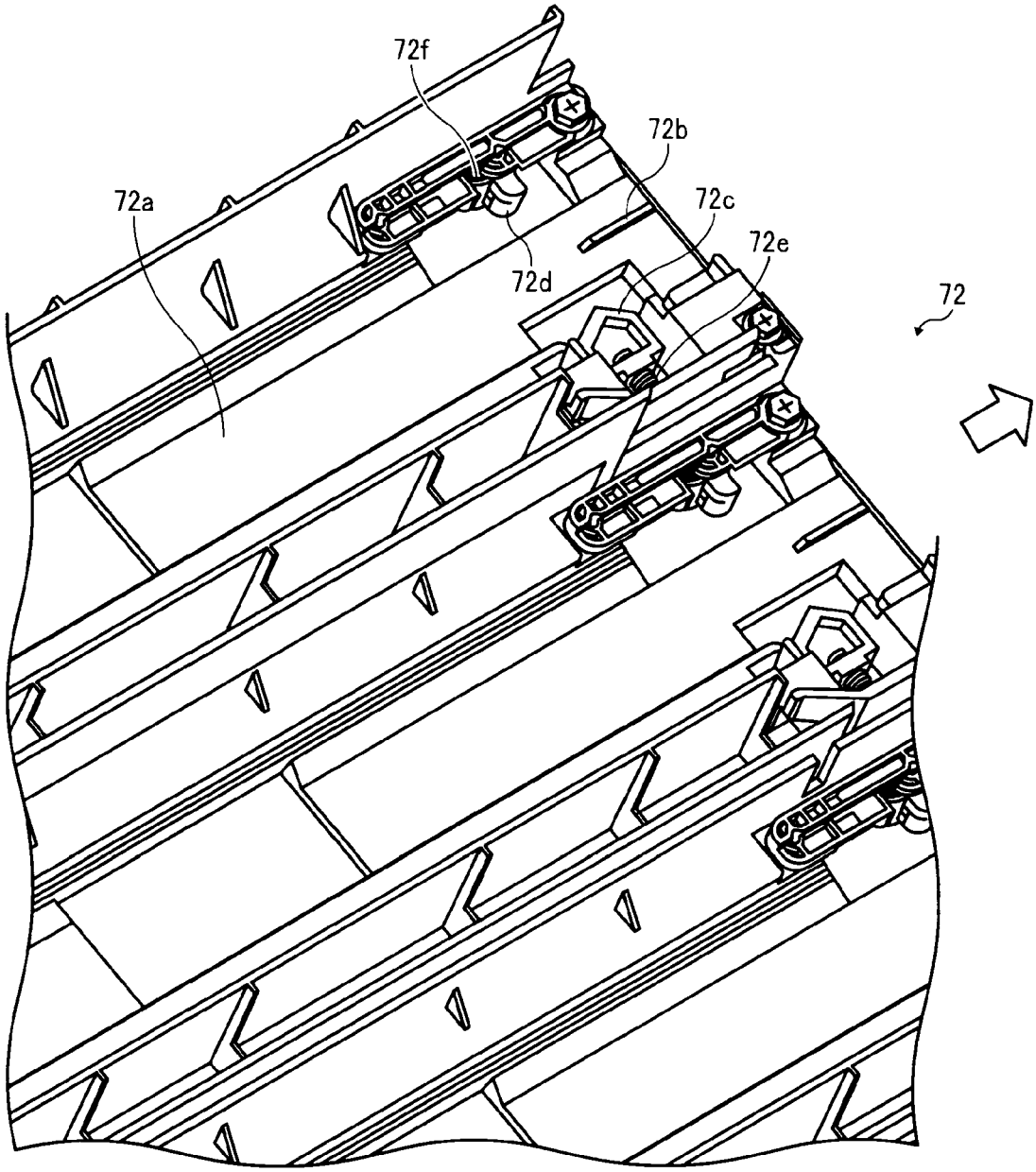
FIG. 34 is an enlarged perspective view illustrating the bottle holder close to front end shown in FIG. 32.

In addition, with reference to FIG. 15, the pressing rail 34*n*2 is formed on one side of an outer surface of the shutter container 34*n*. Referring to FIGS. 34 and 42, a pressing member 72*c* is formed on the bottle holder 72 and is pressed by a compression spring 72*e*. The pressing rail 34*n*2 engages the pressing member 72*c* on the bottle holder 72 to determine the position of the cap 34Y passing above the bottle holder 72 while the toner container 32Y is inserted into the toner container frame 70. The pressing rail 34*n*2 is a recessed portion (groove) and is extended in parallel to the longitudinal direction of the toner container 32Y (direction of insertion). That is, the pressing rail 34*n*2 on the side face of the shutter container 34*n* is formed of a recessed portion, an upper projecting portion, and a lower projecting portion. Further, the pressing rail 34*n*2 extends an entire length of the shutter container 32*n*, and the pressing rail 34*n*2 does not have a wall portion but opens on each end. A front side tip portion 34*n*21 of the lower projecting portion of the pressing rail 34*n*2 is tapered, that is, in the front side tip portion 34*n*21, a tip front edge of the lower projecting portion of the pressing rail 34*n*2 is sloped.

Further, with reference to FIG. 14, the pressure receiving face 34*n*3 is formed on the other side on the outer surface of the shutter container 34*n*. In FIGS. 34 and 42, a pressure receiving member 72*d* is formed in the bottle holder 72 and slides on the pressure receiving face 34*n*3 to determine the position of the cap 34Y passing above the bottle holder 72 while the toner container 32Y is inserted into the toner container frame 70.

With this configuration, when the toner container 32Y installed into the toner container frame 70 and just before the cap 34Y is installed into the cap holder 73, or when the toner container 32Y released from the toner container frame 70 and just after the cap 34Y is released from the cap holder 73, the pressing rail 34*n*2 is pressed by engaging the pressing member 72*c* biased by the compression spring 72*e*. Then, the pressure receiving face 34*n*3 receives the pressing force while sliding on the pressure receiving member 72*d*.

Undergoing these processes, the position of the cap 34Y just before inserted into the cap holder 73 or just after released from the cap holder 73 can be restricted.

Figure 29:
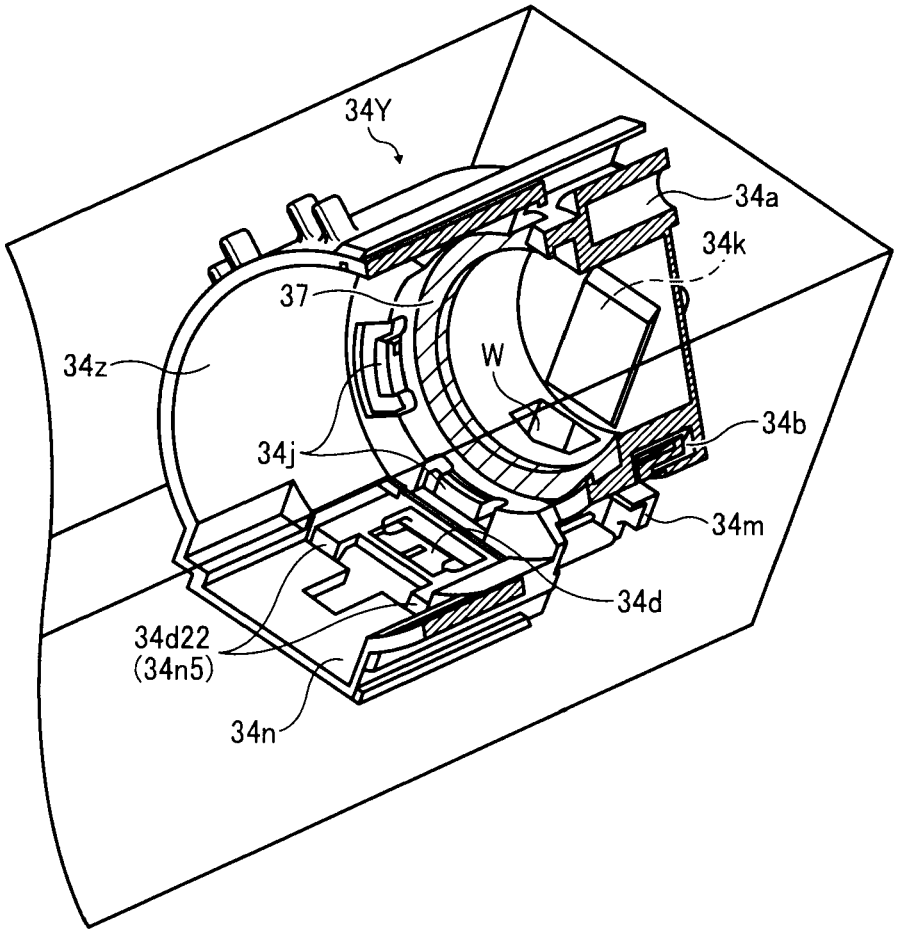
FIG. 29 is a perspective view illustrating an inner portion of the cap in the toner container shown in FIG. 5.

Herein, the cap 34Y communicates with the container body 33Y through the opening A, and the toner discharged from the opening A is discharged through the toner outlet W (movement indicated by arrow s shown in FIG. 3). More specifically, in the present embodiment, with reference to FIG. 28A, the lateral cylindrical hollow B (space) extends in the longitudinal direction (lateral direction in FIG. 28A). In FIG. 29, the inner diameter of the hollow B is set smaller than an inner diameter of the insertion opening 34*z* into which the front face of the container body 33Y is inserted. In addition, the toner dropping route C that is a cylindrical hollow extends from a lower face of the lateral cylindrical hollow B to the outermost face of the toner outlet W and has a predetermined cross-sectional area, functioning as a predetermined flow channel area (flow channel cross-sectional area).

With this configuration, the toner discharged from the opening A of the container body 33Y to the hollow B in the cap 34Y is smoothly discharged outside (to the toner tank 61Y) by dropping under its own weight.

With reference to FIGS. 22 through 25, the cap 34Y (in which the shutter 34*d* and the shutter seal 36 are detached) is constituted of a first cap body 34Y1 and a second cap body 34Y2 by welding. More specifically, in a manufacturing process, the lateral protrusions 34*c* and a shutter support section 34Y1B (lower portion) provided in the first cap body 34Y1 are fitted into corresponding notches 34Y2*b* and 34Y2*c* of the second cap body 34Y2, and then, the first cap body 34Y and the second cap body 34Y2 are bonded together (welded) so that an inner face 34Y2*a* of the second cap body 32Y2 is in direct contact with an engagement portion 34Y1*c*.

Figure 24:
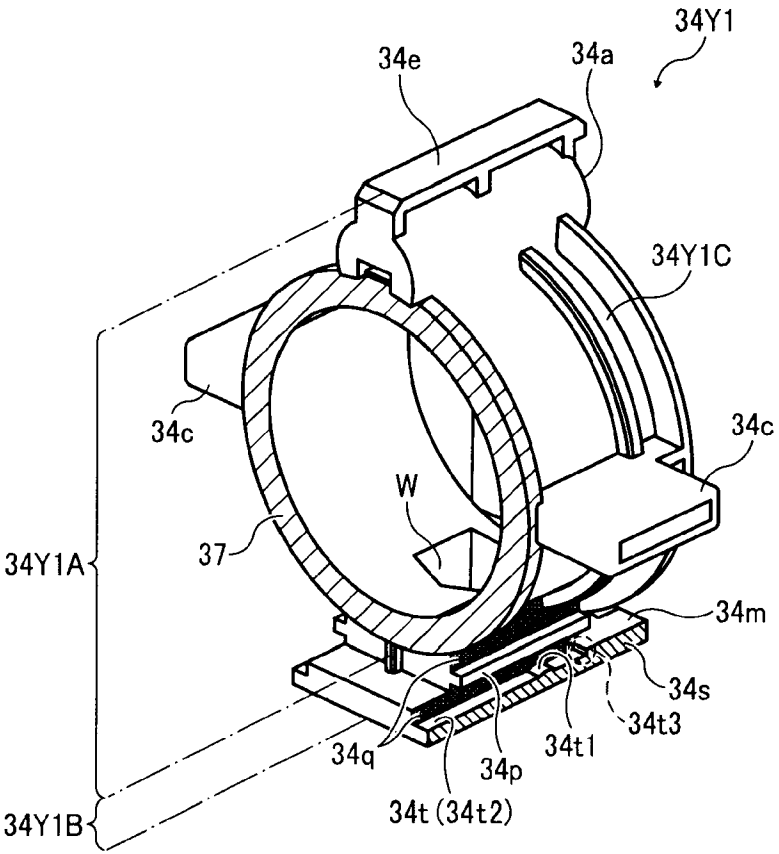
FIG. 24 is a perspective view illustrating the first cap body in the cap shown in FIG. 23 when viewed from another angle.
Figure 23:
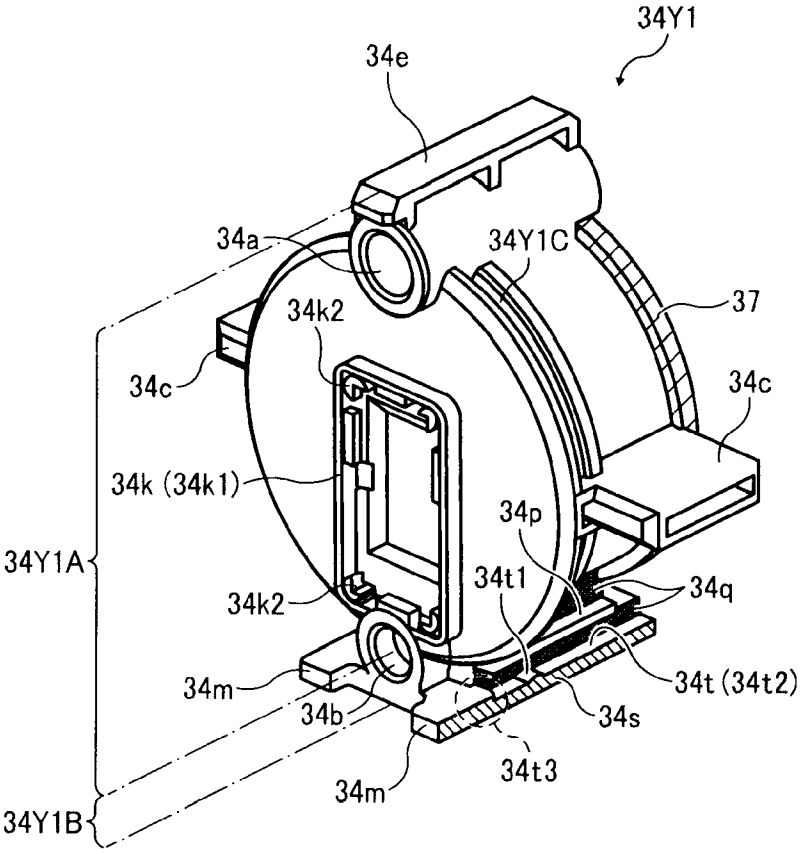
FIG. 23 is a perspective view illustrating a first cap body in the cap shown in FIG. 22.
Figure 25:
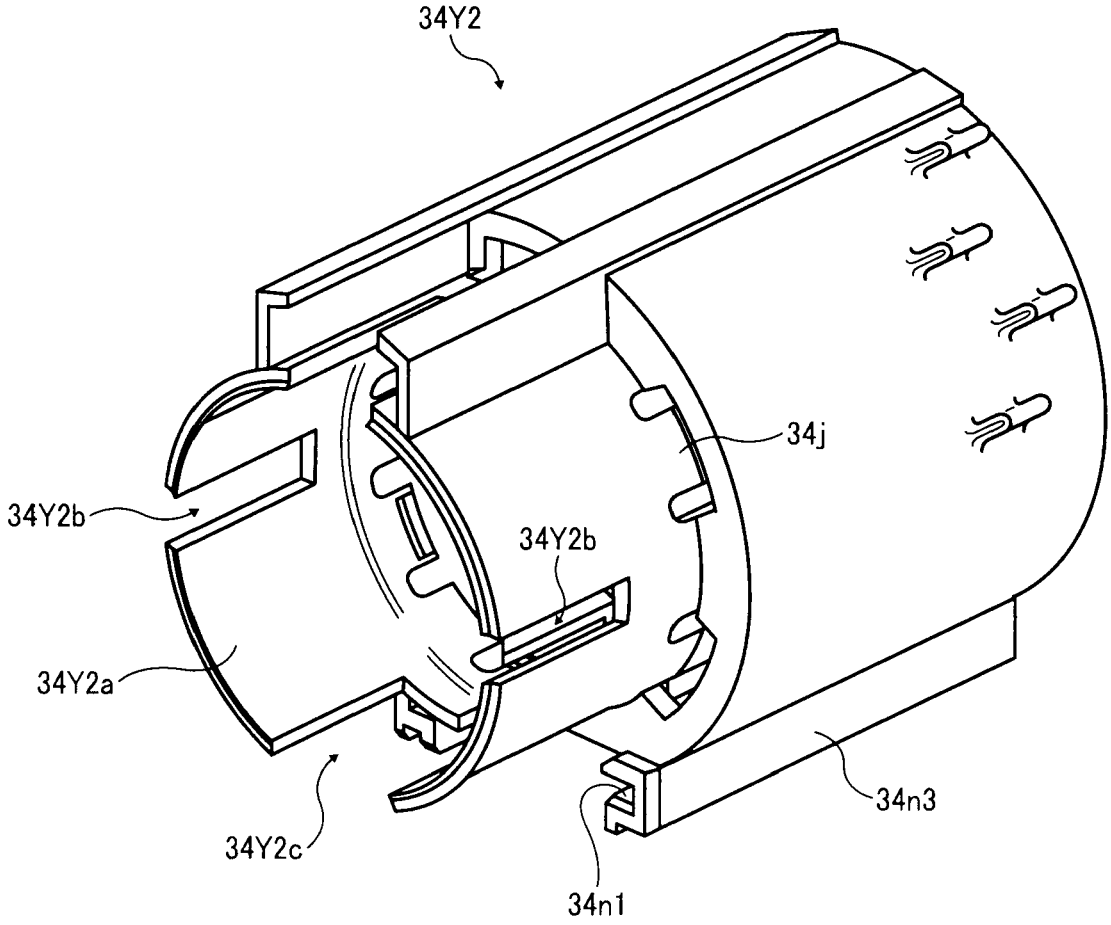
FIG. 25 is a perspective view illustrating a second cap body in the cap shown in FIG. 22.

It is to be noted that, with reference to FIGS. 23 and 24, a circular cap seal 37, serving as a cap seal, is attached to a back side edge of the first cap body 34Y1 (facing the opening A formed in the container body 33Y). The cap seal 37 that is formed of an elastic material (e.g., foam resin), such as foam polyurethane and is for filling a gap between the vicinity of the opening A of the container body 33Y and the backside edge of the first cap body 34Y1.

In addition, with reference to FIG. 23, the mounting section 34*k* in which the RFID chip 35 is set is formed on the front surface of the first cap body 34Y1. The outer rib (wall frame) 34*k*1 that is an outer frame of the mounting section 34 protrudes forward from the front surface of the first cap body 34Y1. Four corner frames 34*k*2 to fix four corners of the rectangular RFID chip 35 are provided at four corners of the outer rib (wall frame) 34*k*1, inside the mounting section 34*k*. Because RFID chip 35 is set on the corner frames 34*k*2, an electronic device formed on a back side of the RFID chip 35, facing the first cap body 34Y1, can be set contactlessly with the front surface of the first cap body 34Y1.

It is to be noted that, in setting process of the RFID chip 35 in the mounting section 34*k*, after the RFID chip 35 is put on the corner frames 34*k*2, the corner frames 34*k*2 are partly jointed with the four corners of the RFID chip 35 by melting the part of the corner frames 34*k*2 with heat and pressure and cooling it to solidify it.

In addition, as shown in FIGS. 23 and 24, the two shutter rails 34*t* (rail members) are provided on the both side faces of the shutter support section 34Y1B (the lowest portion) of the first cap body 34Y1 (cap 34Y). The first cap body 34Y1 is formed by a round body 34Y1A and the shutter support section (bottom portion) 34Y1B in which the toner outlet W is formed. A side rib 34*p* and the shutter rail 34*t* project outward from each of side faces 34*q* of the shutter support section 34Y1B. Each shutter rail 34*t* projects along an bottom surface of the shutter support section 34Y1B and is formed with a part of outer vertical face 34*s* (vertical face) and a part of a horizontal face 32*t*2 that is a upper face of the projection portion of the shutter rail 34*t*.

The shutter 34*d* is movably guided by the shutter rails 34*t* in the longitudinal direction relative to the cap 34Y to open and close the toner outlet W. The shutter rail 34*t* is formed on the two vertical faces 34*s* that extend upward from the lowest surface forming the toner outlet W (see FIG. 28A), that is, the shutter rail 34*t* is constituted of a part of the vertical face 34*s* and the upper face 34*t*2.

Figure 43:
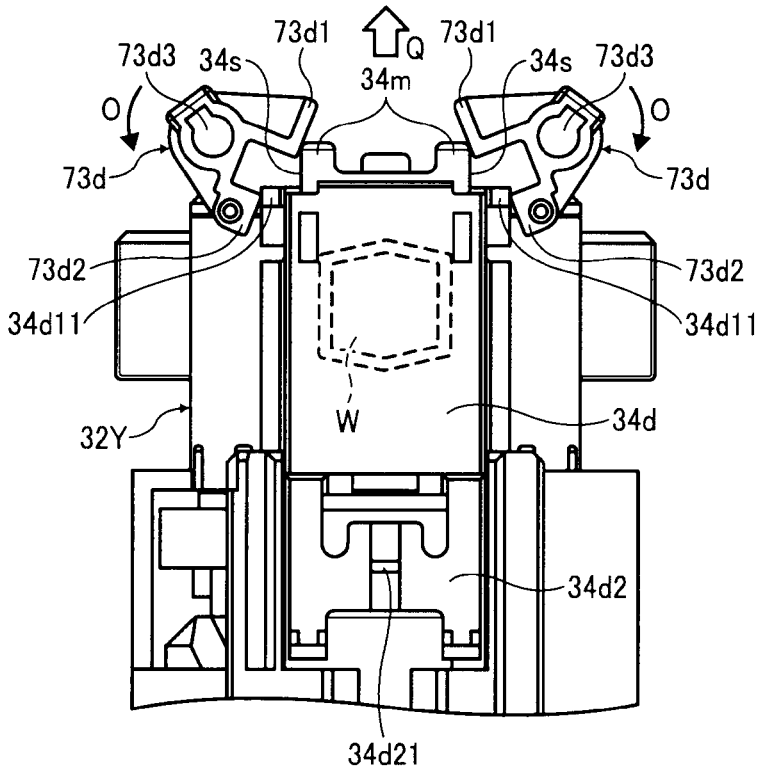
FIG. 43 is a bottom view illustrating a process in which the toner outlet shown in FIG. 20 is opened by the shutter of the cap by engaging the shutter with a shutter closing member in the cap holder.

In addition, the pair of vertical faces 34*s* is continuously formed from a front side end of the shutter rail 34*t* to the projecting portion in the longitudinal direction (also shown in FIG. 43). That is, the two projecting portions 34*m* (shaped like horns) that project forward from the front surface of the cap 34Y are formed. The two projecting portions 34*m* are positioned close to the lower edge of the secondary positioning hole 34*b* and are arranged to sandwich the secondary positioning hole 34*b*. The outer side surfaces of the two projecting members 34*m* are included in the outer vertical surfaces 34*s*. That is, the outer vertical surfaces of the projecting portions 34*m* are substantially aligned with the respective outer side surfaces (vertical surfaces) 34*s*.

Figure 45:
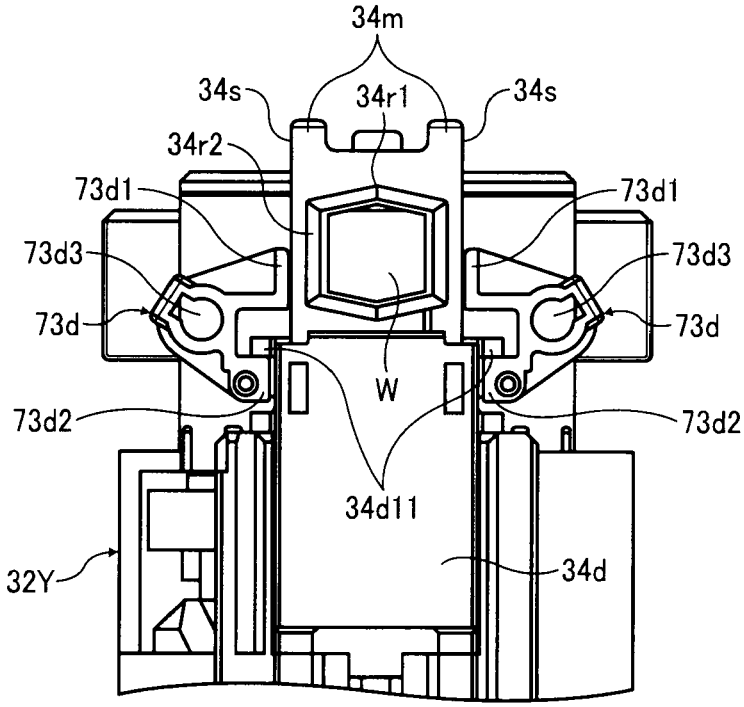

With reference to FIG. 45, the outer side surfaces 34*s* contact first arms 73*d*1 of a pair of shutter closing members 73*d* (shutter retainer) in the cap holder 73. More specifically, the position of the shutter 34*d* in the cap 34Y set in the cap holder 73 is determined by the shutter closing members 73*d* (shutter retainer). Each shutter closing member 73*d* includes the wide long first arm 73*d*1 that contacts the side vertical face 34*s* of the shutter support section 34Y1B, a short second arm 73*d*2, and a rotary shaft 73*d*3 disposed in a center portion thereof.

Herein, each projection portion 34*m* is a member to restrain the shutter closing members 73Y from releasing the shutter 34*d*. In FIG. 45, when the toner container 32Y is released from the toner container frame 70, a timing at which the shutter closing member 73*d* releases the outer vertical faces 34*s* held by the first arms 73*d*1 can be delayed by extending the outer vertical faces 34*s* longer by including the projection portion 34*m* in the direction of insertion, from a timing at which the shutter closing members 73*d* completely close the shutter 34*d*.

Accordingly, the toner container 32Y can be prevented from being released from the image forming apparatus 100 before the shutter 34*d* fully closes the toner outlet W.

In particular, because the two projecting portion 34*m* is positioned to projects from the edge of the primary positioning hole 34*a* in the direction of insertion (longitudinal direction), when the cap 34Y is fully released from the cap holder 73, the hold state of the shutter 34*d* held by the first arm 73*d*1 is finally released, and thus the toner outlet W is reliably closed by the shutter 34*d*.

In addition, in FIGS. 23 and 24, the first cap body 34Y1 includes the primary positioning hole 34*a* (main positioning reference) and the secondary positioning hole 34*b* (sub-positioning reference) for determining the position of the cap 34Y as well as the first engaging member 34*e* and the lateral protrusion 34*c* for restriction of position, in addition to the toner outlet W.

Therefore, when the cap 34Y is formed by jointing the two molded pieces (first cap body 34Y1 and the second cap body 34Y2) by molding or thermal welding, the positional fluctuation of the toner outlet W of the cap 34Y relative to the toner supply opening 73*w* of the cap holder 73 caused by fluctuations in the accuracy of the molding or thermal welding can be prevented. Therefore, shortage of supplied toner caused by the position failure of the toner outlet W can be prevented. It is to be noted that the structure and the operation of the shutter closing (control) member 73*d* (shutter retainer) are described further detail later with reference to FIGS. 43 through 45.

Herein, the shutter 34*d* is attached to the bottom portion of the cap 34Y, and an upper face of the shutter 34*d* facing the toner discharge outlet W is sealed with the shutter seal 36 (seal member).

Next, referring to FIGS. 18 through 21C, 26, and 27, the configuration and operation of the shutter 34*d* is described below.

As shown in FIGS. 18 through 20, the shutter 34*d* opens and closes the toner outlet W in synchronization with the installation of the toner container 32Y into the toner container frame 70.

Figure 26:
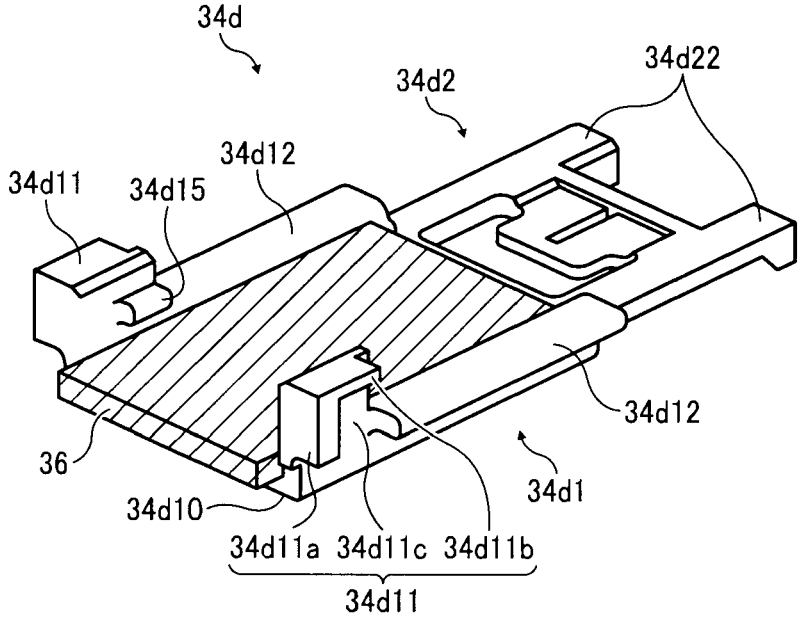
FIG. 26 is a perspective view illustrating the shutter shown in FIG. 18.
Figure 27:
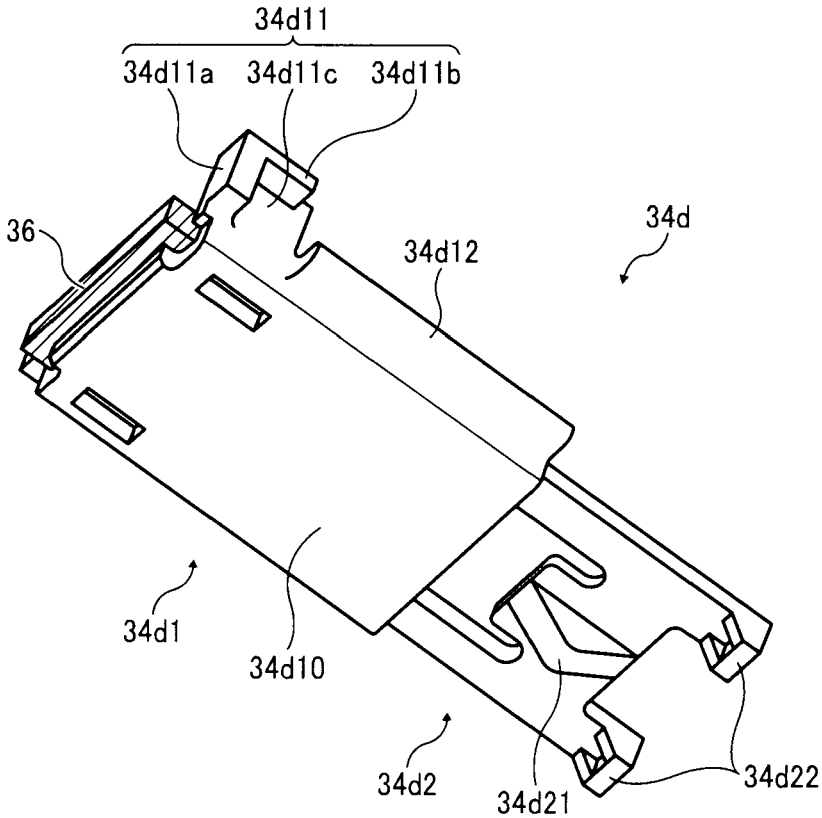
FIG. 27 is a perspective view illustrating the shutter shown in FIG. 26, when viewed from another angle.

FIG. 26 is a perspective view illustrating the shutter 34*d* before attached to the cap 34Y. FIG. 27 shows the shutter 34*d* viewed from another angle different from that shown in FIG. 26 by approximately 90 degrees. As shown in FIGS. 26 and 27, the shutter 34*d* includes the main shutter portion 34*d*1 that is planar and the shutter deformation portion 34*d*2. The shutter deformation portion 34*d*2 is elastic and projects backward from the back end face of the main shutter portion 34*d*1 and the thickness thereof is thinner than that of the main shutter portion 34*d*1.

The main shutter portion 34*d*1 includes a main planar body 34*d*10, the pair of handle parts 34*d*11, the pair of shutter sliders 34*d*12, and a pair of shutter-rail enragement portions 34*d*15. The pair of handle parts 34*d*11 stands upward on front edges of side faces of the main planar body 34*d*10. Each of the shutter sliders 34*d*12 includes stand portions standing upward on a side face of the main planar body 34*d*10 and projecting portions projecting outward from side faces of the side edges of the main planar body 34*d*10 (from top of the stand portion of the standing portion thereof), and the outer projecting faces of the shutter slider 34*d*12 extend in parallel to the direction of insertion of the toner container 32Y. Each shutter-rail enragement portion 34*d*15 is formed on an inner face of the standing portion of the shutter slider 34*d*12 to project inward of the main planar body 34*d*10 (opposite the direction in which the projecting portion of the shutter slider 32Yd12 projects), positioned at a predetermined distance from the shutter seal 36.

In addition, the length of the shutter slider 32Y12 in the direction of insertion of the toner container 32Y is equal or substantially equal to the length from back side end of the shutter rail 34*t* to the shutter projection 34*t*1 formed on the shutter rails 34*t* in the longitudinal direction when the shutter 34*d* is attached to the first cap body 34Y1 (see FIGS. 23 and 24). It is to be noted that the length of the slide groove 34*n*1 formed in the shutter container 34*n* of the second cap body 34Y2 (see FIG. 25) in the direction of insertion is almost equal to the length of the shutter slider 34*d*12.

Then, while the shutter sliders 34*d*12 of the main shutter portion 34*d*1 is fitted into the slide grooves 34*n*1 (outside rail) of the second cap body 34Y2, and the shutter-rail engagement member 34*d*15 engages the shutter rails 34*t* (inside rail) of the first cap body 34Y1 by sandwiching the shutter rail 34*t* (inside rail) between the shutter-rail engagement member 34*d*15 and the shutter seal 36, the shutter 34*d* is moved along the rail members (the slide groove 34*n*1 and the shutter rail 34*t*). Thus, the main shutter portion 34*d*1 of the shutter 34*d* opens and closes the toner outlet W.

Herein, the upper face of the main planar body 34*d*10 of the main shutter portion 34*d*1 that faces the toner outlet W is sealed with the shutter seal 36 (seal member). The shutter seal 36 that is formed of elastic material (e.g., foam resin) is for preventing leakage of the toner between the main shutter portion 34*d*1 and the toner outlet W when the toner outlet W is closed by the main shutter portion 34*d*1 of the shutter 34*d*.

In the present embodiment, as shown in FIGS. 26 and 27, the shutter seal 36 is extended from the backside end of the main shutter portion 34*d*1 to a position projecting forward from the tip face of the shutter 34*d* in the longitudinal direction (direction of insertion). Therefore, when the cap 34Y is installed into the cap holder 73, the tip portion (projecting portion) of the shutter seal 36 closely contacts a wall 73*w*1 (see FIG. 38) surrounding the toner supply opening 73*w*. Thus, leakage of the toner from the vicinity of the toner supply opening 73*w* can be prevented with the shutter seal 36.

As shown FIGS. 21A through 21C, 26, and 27, the shutter deformation portion 34*d*2 is integrally formed with the main shutter portion 34*d*1 and is elastically deformable (pivotable) in a vertical direction around a connection point 34*d*23 between the shutter deformation portion 34*d*2 and the main shutter portion 34*d*1 (see broken circle in FIGS. 21A through 21C), as an pivoting axis. The shutter deformation portion 34*d*2 is positioned on the container body 33Y side in the longitudinal direction relative to the main shutter portion 34*d*1 (see FIG. 18). In FIGS. 21A through 21C, and 27, the shutter deformation portion 34*d*2 includes a pair of stoppers 34*d*22 and a stopper release member 34*d*21. Each stopper 34*d*22 is a wall formed on a back side tip portion of the shutter deformation portion 34*d*2 in a direction in which the shutter 34*d* is opened (provided on the left side in FIGS. 21A through 21C), that is, the stopper 34*d*22 is positioned farthest from the main shutter portion 34*d*1, in the shutter deformation portion 32*d*2.

Because backside faces 34*d*220 of the stoppers 34*d*22 contact a contact face 34*n* 5 of the shutter container 34*n*, the stoppers 34*d*22 restrict the movement of the shutter 34*d* in the direction in which the shutter 34*d* is opened. That is, when the toner container 32Y is not set in the image forming apparatus 100*he* backside face 34*d*220 of the stopper 34*d*22 of the shutter 34*d* contacts the contact face 34*n* 5, and the stopper 34*d*22 can prevent the shutter 34*d* from moving toward the release position of the toner outlet W.

The stopper-release member 34*d*21 (stopper release projection) projects downward from a flat bottom face of the shutter deformation portion 34*d*2. Referring to FIGS. 71A through 71C, the stopper release member 34*d*21 is for moving the stopper 34*d*22 upward as the shutter deformation portion 34*d*2 elastically deforms upward when external force is exerted on the shutter deformation portion 34*d*2, and thus the contact between the backside face 34*d*220 of the stopper 34*d*22 and the contact face 34*n* 5 is released.

The stopper release member 34*d*21 is a mountain-shaped projection formed between the stopper 34*d*22 and the connection point 34*d*23 between the main shutter portion 34*d*1 and the shutter deformation portion 34*d*2. The stopper release member 34*d*21 is sloped on both sides in the direction in which the shutter 34*d* is opened.

Figure 32:
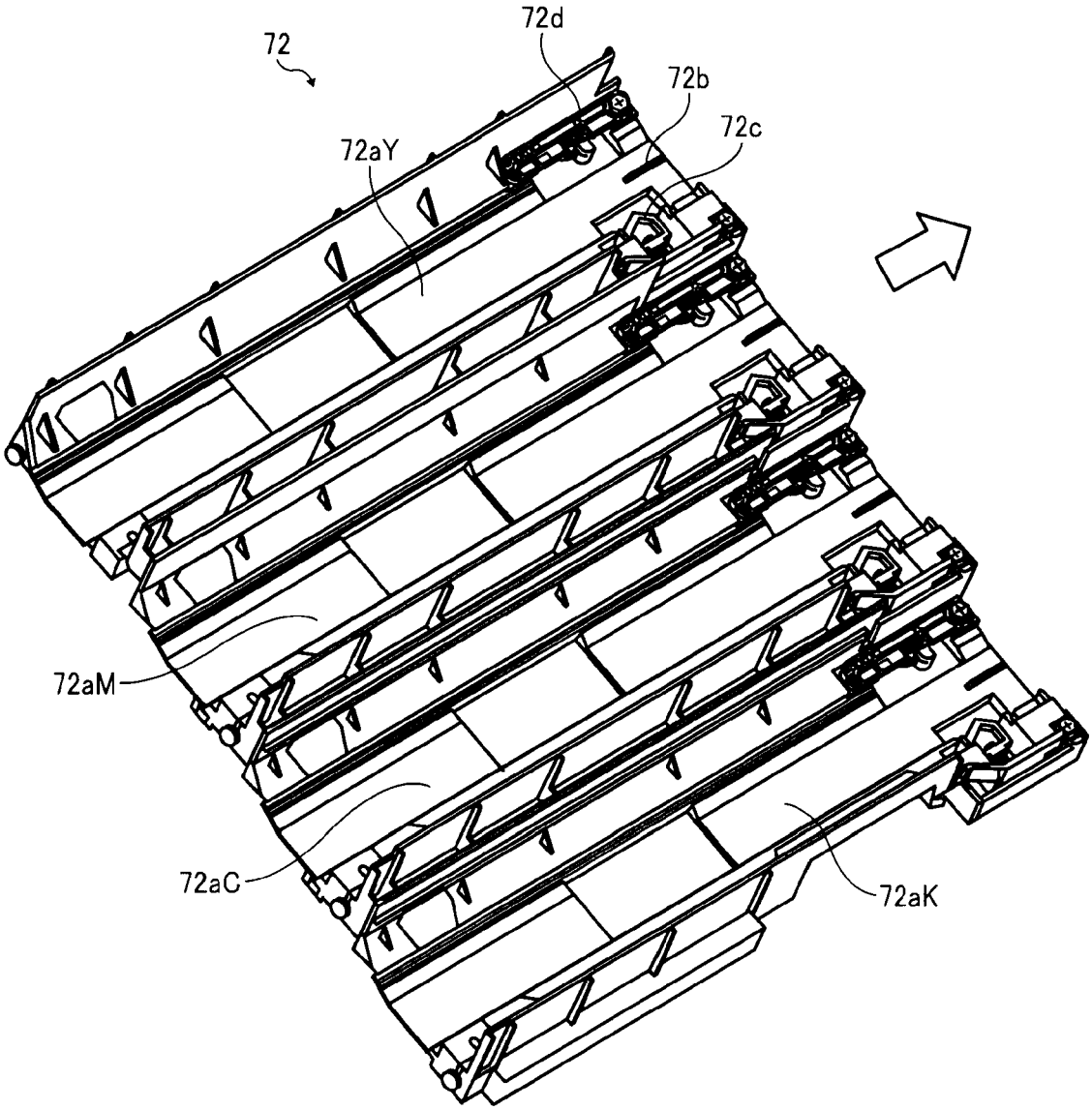
FIG. 32 is a perspective view illustrating a bottle holder in the toner container frame shown in FIG. 4.

Additionally, with reference to FIGS. 32 and 42, a stopper-release pressing member 72*b* that is a trapezoidal rib is provided in the bottle holder 72, in a front end of the bottle receiving face 72*a* (a downstream side in which the toner container 32Y is installed into the bottle holder 72). The stopper-release pressing member 72*b* is for pressing the stopper release member 34*d*21 of the shutter 34*d* to releasing the contact between the stopper 34*d*2 and the contact face 34*n* 5.

With this configuration, in conjunction with insertion of the toner container 32Y into the toner container frame 70, the sloped side of the stopper release member 34*d*21 contacts the stopper-release pressing member 72*b* and then the stopper release member 34*d*21 climbs onto the stopper-release pressing member 72*b*. Thus, with the stopper-release member 34*d*21 pushed up by the stopper-release pressing member 72, that is, with the external force from below, the shutter deformation portion 34*d*2 is deformed upward and the stopper 3422 is moved up. Thus, the contact between the backside face 34*d*220 of the stopper 34*d*22 and the contact face 34*n* 5 is released, and the shutter 34*d* becomes movable in the direction in which the shutter 34*d* is opened.

Next, with reference to FIGS. 21A through 21C, the operation of the shutter 34*d* relative to the shutter container 34*n* of the cap 34Y in synchronization with the installation of the toner container 32Y into the toner container frame 70 is described below. It is to be noted that the positions of the shutter 34*d* shown in FIGS. 21A, 21B, and 21C respectively correspond in respective positions to the shutter member 34*b* those relative to the second cap body 34Y2 shown in FIGS. 18, 19, and 20. When the insertion of the toner container 32Y into the toner container frame 70 is started, the shutter container 34*n* starts moving in the direction of insertion (from left side to right side in FIGS. 21A through 21C).

In a state shown in FIG. 21A, because the stopper release member 34*d*21 does not reach the stopper-release pressing member 72*b* in the bottle holder 72, the movement of the shutter 34*d* in the opening direction is restricted by contacting the backside face 34*d*220 of the stopper 34*d*22 with the contact face 34*n* 5 that is front end face of the shutter container 34*n*.

Then, when the installation process of the toner container 32Y proceeds, in a state shown in FIG. 21B, the stopper release member 34*d*21 is pressed up by the stopper-release pressing member 72*b*, and the shutter deformation portion 34*d*2 elastically deforms (pivots) around the connection point 34*d*23 between the shutter deformation portion 34*d*2 and the main shutter portion 34*d*1, indicated by a broken circle shown in FIG. 21B. As a result, the contact between the backside face 34*d*220 of the stopper 34*d*22 and the contact face 34*n* 5 of the shutter container 32*n* is released, and the shutter 34*d* become movable relative to the opening direction.

Subsequently, the front side tip of the main shutter portion 34*d*1 of f the shutter 34*d* contacts the wall 73*w*1 surrounding the toner supply opening 73*w* in four directions (see FIGS. 38 and 39), and the movement of the shutter 34*d* on the cap holder 73 of the toner container frame 70 is restricted. Namely, the shutter 34*d* is stopped relative to the toner container frame 70 in the longitudinal direction. However, the toner container 32Y is further moved in the direction of insertion, and therefore, the shutter 34*d* is moved relative to the toner container 32Y in the opening direction. That is, the shutter 34*d* is moved relative to the toner container 32Y to the container body 33Y side from the position shown in FIG. 21B to the position shown in FIG. 21C, and then, the shutter 34*d* is accommodated by the shutter container 32*n* (container space).

Then, in the state shown in FIG. 21C, the toner outlet W is fully opened by moving the cap 34Y relative to the cap holder 73, that is, moving the shutter 34*d* relatively to the cap 34Yin the opening direction. At this time, the stopper release member 34*d*21 of the shutter 34*d* is stored in a notch 34*n* 6 formed on bottom face of the shutter container 34*n* (see FIG. 20).

As described above, in the toner container 32Y according to the present embodiment, the shutter 34*d* includes the main shutter portion 34*d*1 and the shutter deformation portion 34*d*2 that elastically pivots around the connection point 34*d*23 therebetween, and the shutter deformation portion 34*d*2 includes the stopper 34*d*21 to restrict the movement of the shutter 34*d* in opening direction when the toner container 32Y is not set in the image forming apparatus 100. Therefore, when the toner container 32Y is not installed, the shutter 34*d* can be prevented from opening the toner outlet W spontaneously. In other words, only when the toner container 32Y is installed into the image forming apparatus 100, the shutter 34*d* opens the toner outlet W in synchronization with the installation thereof.

Herein, the shutter-rail engagement members 34*d*15 (see FIG. 26) also function as second stoppers to restrict the movement of the shutter 34*d* in a closing direction (direction opposite the direction in which the stopper 34*d*22 restricts the movement of the shutter 34*d*) by contacting a second contact face 34*t*3 (front side end wall of the shutter rail 34*t*) indicated by a broken circle shown in FIGS. 22 and 23. More spherically, when the shutter 34*d* changes the state from an opening state in which the shutter 34*d* opens the toner outlet W (see FIG. 20) to a closing state in which the shutter 34*d* closes the toner outlet W (see FIG. 18), the position of the shutter 34*d* in close state is determined by contacting the shutter-rail engagement member 34*d*15 of the shutter 34*d* with the second contact face 34*t*3 on the shutter rail 34*t* on front side of the closing direction and by contacting the backside face 34*d*220 of the stopper 34*d*22 with the contact face 34*n* 5 of the shutter container 34*n* on the back side of the closing direction. At this time, when the shutter-rail engagement portions 34*d*15 contact the second contact faces 34*t*3 immediately after passing over the projection portion 34*t*1 on the shutter rail 34*t* (see FIGS. 23 and 24), the user can feel the click sensation and recognize that the shutter 34*d* fully closes the toner outlet W.

It is to be noted that, as shown in FIGS. 22 through 24, each rib 34*p* extended in the longitudinal direction projects from the vertical face 34*q* and is positioned above the shutter rail 34*t*, and outer side faces of the rib 34*p* are aligned with the outer vertical face 34*s*. Each rib 34*p* prevents the first arm 73*d*1 of the shutter closing member 73*d* from entering a gap between the shutter rail 32*t* and the rib 34*p* when the outer vertical face 34*s* of the shutter rail 34*t* is held by the first arm 73*d*1. That is, the distance between the shutter rail 34*t* and the rib 34*p* (height of the recess) is narrower (lower) than the height of the first arm 73*d*1 (the length in a direction orthogonal to the surface of paper on which FIG. 45 is drawn).

It is to be noted that the rib 34*p* requires to include only a projections projecting laterally (in a direction orthogonal to the surface of paper on which FIG. 28A is drawn.) and a portion extending in the longitudinal direction (lateral direction in FIG. 28A), and therefore, the above-described extending vertical side surface is not always required.

Additionally, referring to FIGS. 26 and 27, the pair of handle parts 34*d*11 is provided on the both side face in the front side of the main shutter portion 34*d*1.

Figure 44:
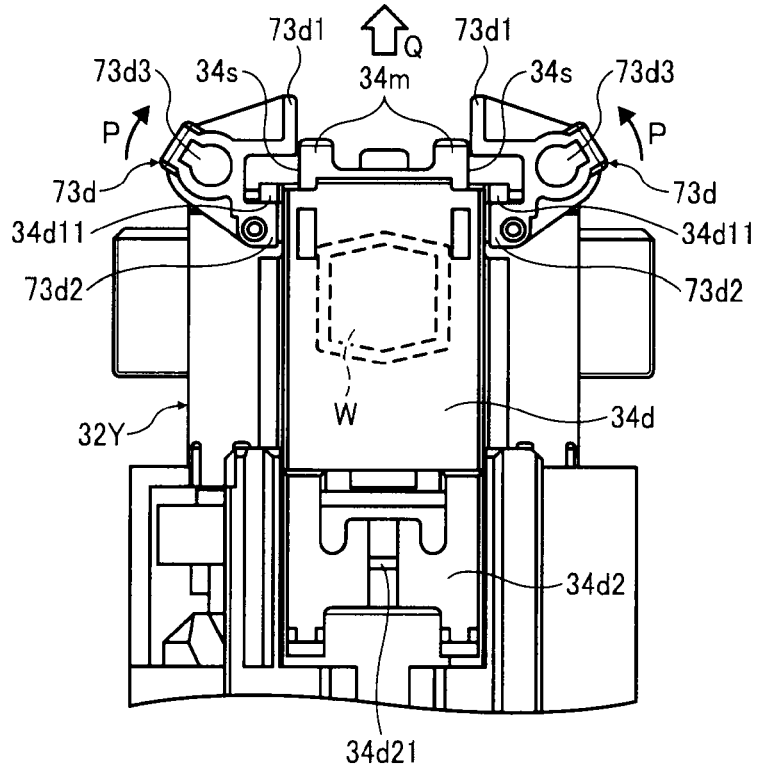
FIGS. 44 and 45 are bottom views illustrating the process in which the toner outlet is further opened by the shutter of the cap by engaging the shutter with a shutter closing member in the cap holder shown in FIG. 43.

As shown in FIGS. 43 through 45, each handle part 34*d*11 is held by the second arm 73*d*2 of the shutter closing members 73*d* (shutter retainer). Each handle part 34*d*11 includes a sidewall 34*d*11*c* standing from a/the side edge of the main planar body 34*d*10 and also function as a sidewall of the main planar body 34*d*10, an engagement wall 34*d*11*a* standing on a/the front end of the main shutter portion 34*d*1, and a movement restriction wall 34*d*11*b* extending in parallel to the direction of insertion and provided in an upper portion of the handle part 34*d*11, above the sidewall 3411*c* in FIG. 26.

As shown in FIGS. 38 and 42, the shutter closing member 73*d* (shutter retainer) is provided on the inner bottom face of the cap holder 73 and is disposed upstream from the toner supply opening 73*w* in the direction of insertion of the toner container 32Y. The pair of shutter closing members 73*d* each of which is hoof-shape is arranged so as to face each other in a lateral direction in FIG. 43, and is rotatable around the rotary shaft 73*d*3 in which a torsion coil spring 73*f* (see FIG. 42) is provided.

With this configuration, when the shutter 34*d* opens and closes the toner outlet W, the handle part 34*d*11 is held by the second arm 73*d*2 of the shutter closing member 73*d* (shutter retainer), and the outer vertical face 34*s* of the shutter support section 34Y1B of the cap 34Y is held by the first arm 73*d*1, thus determining the positions of the shutter 34*d* and the cap 34Y. Therefore, the position of the shutter 34*d* and the cap 34Y in the cap holder can be determined, and opening and closing operation of the shutter 34*d* can be smoothly performed.

At this time, the second arm 73*d*2 of each shutter closing members 73*d* (shutter retainer) holds the sidewall 34*d*11*c* of the handle part 34*d*11 in the main shutter portion 34*d*1, and the movement restriction wall 34*d*11*b* prevents the handle part 34*d*11 from moving relative to the second arm 73*d*2. The engagement wall 34*d*11*a* engages a recessed portion of the second arm 73*d*2, which is described in further detail later.

Herein, with reference to FIGS. 20, 45, and 47, the shape of the toner outlet W is described below.

In FIGS. 20 and 45, the toner outlet W, formed in the cap 34Y, is opened and closed by the above-described shutter 34*d* and is hexagonal when viewed from the lower side of the cap 34Y. More specifically, a rim 34*r* that projects downward from a lowest face of the shutter support section 34Y1B in the cap 34Y is positioned forms enclosure of the hexagonal toner outlet W. The enclosure of the rim 34*r* is sharpened toward both ends away from a center position of the toner outlet W in the direction of insertion and includes tips 34*r*1 positioned on both sides of the rim 34*r* in the longitudinal direction (vertical direction in FIG. 45) of the toner container 32Y. That is, the width of the toner outlet W is reduced with increases in the distance from the center position of the toner outlet W. Specifically, when viewed from the lower side, the rim 34*r* is hexagonal and includes two pairs of side rims 34*r*10 that form apexes (tips 34*r*1) and a pair of parallel-side rims 34*r*2 extending in the longitudinal direction (vertical direction in FIG. 45). Then, the toner outlet W is hexagonal in conformity with the shape of the hexagonal rib 34*b*.

As described above, the width (length in the direction perpendicular to the longitudinal direction of the of the toner container 32Y) of the rim 34*r* surrounding the toner outlet W is gradually narrowed toward the tips 34*r*1 in the longitudinal direction (open and close direction of the shutter 34*d*). Therefore, when the shutter 34*d* closes the toner outlet W, sliding contact between the shutter seal 36 attached to the shutter 34*d* and the rim 34*r* of the toner outlet W is started at the tip 34*r*1 having a smaller area. Then, the contact area between the shutter seal 36 and the side rims 34*r*10 of the rim 34*r* is gradually increased as the width of the enclosure of the rim 34*r* increases. With this configuration, although the shutter seal 36 contacts the rim 34*r*, peeling the shutter seal 36 from the shutter 34*d* or damage to the shutter seal 36 can be prevented. Conversely, when the shutter 34*d* opens the toner outlet W, the contact area between the shutter seal 36 and the side rims 34*r*10 is gradually decreased, and therefore, the damage to the shutter seal 36 caused by the contact with the rim 34*r* can be reduced.

Figure 47:
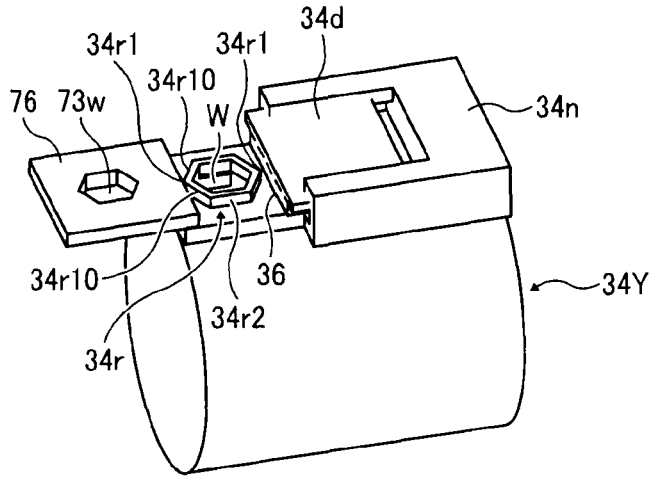
FIG. 47 is a perspective diagram illustrating vicinity of the toner outlet shown in FIG. 20 in the cap placed upside down and a seal member of the cap holder.

In addition, referring to FIG. 47, the surroundings of the toner supply opening 73*w* of the cap holder 73 (see FIG. 42) is sealed with a seal member 76 formed of elastic material (e.g., foam resin). Therefore, toner scattering in the vicinity of the toner supply opening 73*w* communicating with the toner outlet W of the toner container 32Y can be prevented. Therefore, similarly, in installation of the cap member 34Y into the cap holder 73 in the longitudinal direction, when the rim 34*r* of the cap 34Y contacts the seal member 76 on the vicinity of the toner supply opening 73*w*, initially, sliding contact between the rim 34*r* and the seal member 76 is started at the tip 34*r*1 having a smaller area. Then, the contact area between the seal member 76 and the side rims 34*r*10 of the rim 34*r* is gradually increased as the width of the enclosure of the rim 34*r* increases.

Accordingly, the peeling the seal member 76 from the toner supply opening 73*w* and damage to the seal member 76 can be alleviated. Conversely, in releasing the cap 34Y from the cap holder 73 in the longitudinal direction, the contact area (sliding area) between the side rim 34*r*10 of the rim 34*r* and the seal member 76 on the toner supply opening 73*w* is gradually decreased, and therefore, the damage to the seal member 76 surrounding the toner supply opening 73*w* caused by the contact with the rim 34*r* can be reduced.

It is to be noted that in FIG. 47, the cap 34Y and the seal member 76 are illustrated upside down so as to clearly show the relative positions of the seal member 76 surrounding the toner supply opening 73*w* and the toner outlet W.

Undergoing these processes, the toner contained in (retained in) the toner container 32Y can be reliably prevented from being scattered outside as the toner container 32Y is installed in or released from the image forming apparatus 100.

It is to be noted that, although not clearly shown in the drawings, in the present embodiment, the projecting amount of the rim 34*r* shown in FIG. 20 of the cap 34Y gradually decreases in the longitudinal direction (vertical direction in FIG. 45) with increases in the distance from the center position of the toner outlet W, that is, the height of the rim 34*r* of the cap 34Y decreases toward the tips 34*r*1 on both sides in the longitudinal direction.

In this configuration, when the shutter seal 36 attached to the shutter 34*d* slides on the rim 34*r* in synchronization with the installation of the toner container 32Y in the longitudinal direction, peeling the shutter seal 36 from the shutter 34*d* can be prevented, and the shutter seal 36 is less likely to be damaged. Similarly, when the rim 34*r* slides on seal member 76 (see FIG. 42) surrounding the toner supply opening 73*w* in synchronization with the installation of the toner container 32Y in the longitudinal direction, peeling the seal member 76 from the toner supply opening 73*w* can be prevented, the seal member 76 is less likely to be damaged.

Figure 48A:
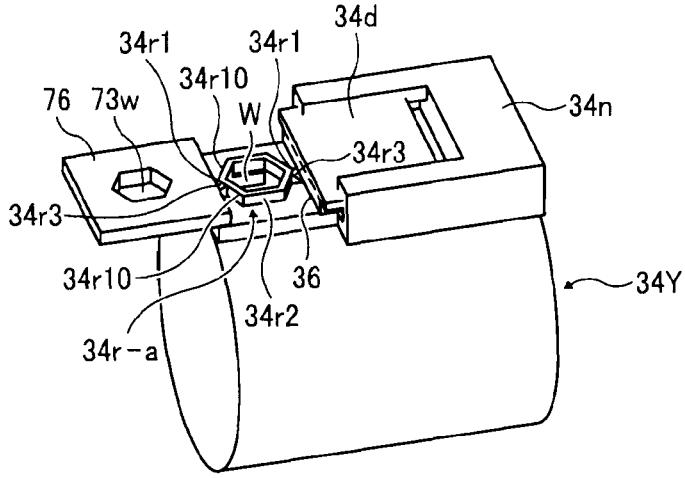
FIGS. 48A and 48B are perspective diagrams illustrating variations of the vicinity of the toner outlet in the cap shown in FIG. 47 placed upside down and the seal member of the cap holder.
Figure 48B:
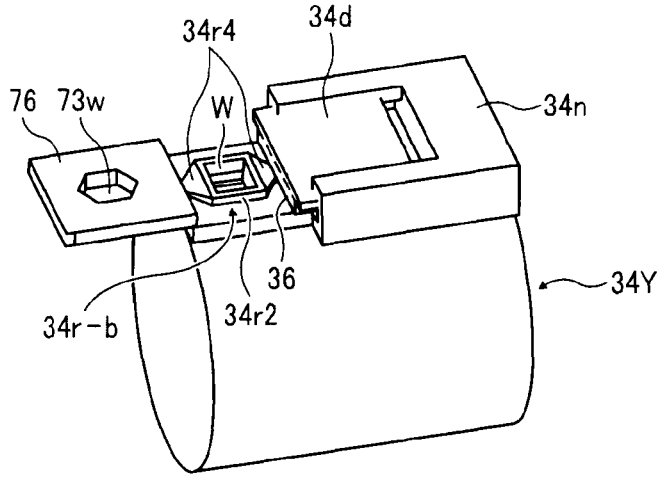

It is to be noted that the shape of the rim 34*r* and the toner outlet W is not limited the above-described configuration. FIGS. 48A and 48B illustrate variations of the shape of the rim 34*r* and the toner outlet W. For example, as shown in FIG. 48A, a projection amount of a tip portions in the longitudinal direction of a rim 34*r-a* gradually decreases with increases in the distance from the center position of the toner outlet W. More specifically, tapered tips 34*r*3 sloped in the vertical direction are provided outside the tips 34*r*1 on both sides of the rim 34*r-a*.

In addition, as shown in FIG. 48B, a toner outlet W-b formed on the bottom surface of the cap 34Y is rectangular although a rim 34*r-b* that surround the rectangular toner outlet W-b is hexagonal. In this configuration, in order to form apexes of the rim 34*r-b*, the rim 34*r-b* includes a pair of triangular portions 34*r*4 positioned both end portions of the rim 34*r-b* in the longitudinal direction, and the triangle rim 34*r*4 is tapered, that is, sloped in the vertical direction.

Similarly to the configuration shown in FIG. 47, in a variation shown in FIGS. 48A and 48B, when the shutter 34*d* closes the toner outlet W, sliding contact between the rim 34*r* surrounding the toner outlet W and the shutter seal 36 attached to the shutter 34*d* or the seal member 76 attached to the toner supply opening 73*w* is started at the tip 34*r*1 having smaller area. Then, the contact area between the side rims 34*r*10 of the rim 34*r* and the seal member 76 or the shutter seal 36 is gradually increased as the width of the enclosure of rim 34*r* increases, and vice versa. With this configuration, because the seal member 76 or the shutter seal 36 can smoothly slide on the rim 34*r*, peeling the shutter seal 36 from the shutter 34*d* or peeling the seal member 76 from the toner supply opening 73*w* and the damage to the shutter seal 36 or the seal member 76 can be prevented.

Herein, the respective color toners contained in the toner container 32Y, 32M, 32C, and 32K according to the embodiments of the present invention have a volume average particle diameter of 3 μm to 8 μm. Additionally, the ratio of Dv/Dn is 1.00 to 1.40 when Dv represents a volume average particle diameter and Dn represents a number average particle diameter.

Accordingly, the high quality image can be kept, and suitable developing ability can be kept even when the toner is agitated in the development device 5 for a relatively long time. In addition, the above-described toner particles can be effectively and reliably transported without clogging the toner supply path such as the toner conveying tube 63Y. It is to be noted that volume average particle diameter Dv, and number average particle diameter Dn of the toner particles can be measured by COULTER Counter TA-II (COULTER ELECTRONIC COMPANY) and COULTER Multisizer II (COULTER ELECTRONIC COMPANY).

In addition, as for the toner contained in the toner container 32Y, 32M, 32C, and 32K, substantially spherical toner that desirably has a first shape factor SF1 and a second shape factor SF2 both within a range of 100 to 180 is used.

Therefore, higher transfer effectiveness can be kept while preventing degradation of cleaning performance. Further, the toner can be supplied effectively and reliably without clogging the toner supply path, such as the toner conveying tube 63.

Herein, referring to FIG. 7, the first shape factor "SF-1" is a parameter representing the roundness of a particle and can be calculated by the following formula:

$$SF1=\{M^2/S\}\times(100\pi/4) \quad \text{(Formula 1)}$$

wherein M represents the maximum particle diameter of a spherical shaped figure obtained by projecting a toner particle on a two dimensional plane, and "S" represents the projected area of elliptical-shaped figure.

The toner particle is a perfect sphere when the first shape factor SF1 is 100. The larger the SF1 becomes, the more the toner particle becomes amorphous.

In addition, the second shape factor "SF-2" is a value representing irregularity (i.e., a ratio of convex and concave portions) of the shape of the toner particle. The shape factor "SF-2" of a particle is calculated by the following Formula 2:

$$SF2=\{N^2/S\}\times(100\pi/4) \quad \text{(Formula 2)}$$

wherein N is a peripheral length of a toner particle projected on a two-dimensional surface and d "S" represents the projected area of elliptical-shaped figure.

The toner particle is flat when the first shape factor SF1 is 100. The larger the first shape factor SF1 becomes, the more the toner particle has irregularities.

The first shape factor SF1 and second shape factor SF2 can be measured by taking a photograph using a scanning electron microscope, S-800 (Hitachi, Ltd.) and analyzing the photograph using an image analyzer, LUSEX3 (NIRECO CORPORATION).

Next, turning now to FIGS. 32 through 46, structures and operations of the bottle holder 72 and the cap holder 73 in the toner container frame 70 are described below.

As described with reference to FIG. 4, the toner container frame 70 includes the bottle holder 72, the cap holder 73, and the insertion portion 71. The user installs the toner container 32Y into the toner container frame 70 from the insertion portion 71 while holding the handle part 33*d* with the longitudinal side of the toner container 32Y in the horizontal direction and with the cap 34Y forming the front end of the toner container 32Y. The toner container 32Y inserted through the insertion opening 710 is pressed into the cap holder 73 while sliding on a bottle receiving face 72*a*Y (see also FIGS. 34 and 35).

Herein, with reference to FIGS. 32 and 33, bottle receiving faces 72*a*Y, 72*a*M, and 72*a*C, and 72*a*K (hereinafter also collectively "bottle receiving faces 72*a*") for respective colors are formed on the bottle holder 72, and the toner containers 32Y 32M, 32C, and 32K are inserted into the corresponding portions of the bottle holder 72 in a direction indicated by an arrow shown in FIGS. 32 and 33. Thus, the bottle receiving face 72*a* functions as a sliding face on which the toner container 32 slides when the toner container 32 is installed into or released from the toner container frame 70 and also functions as a holder to hold the rotating container body 33Y after the toner container 32Y is fully set.

Figure 33:
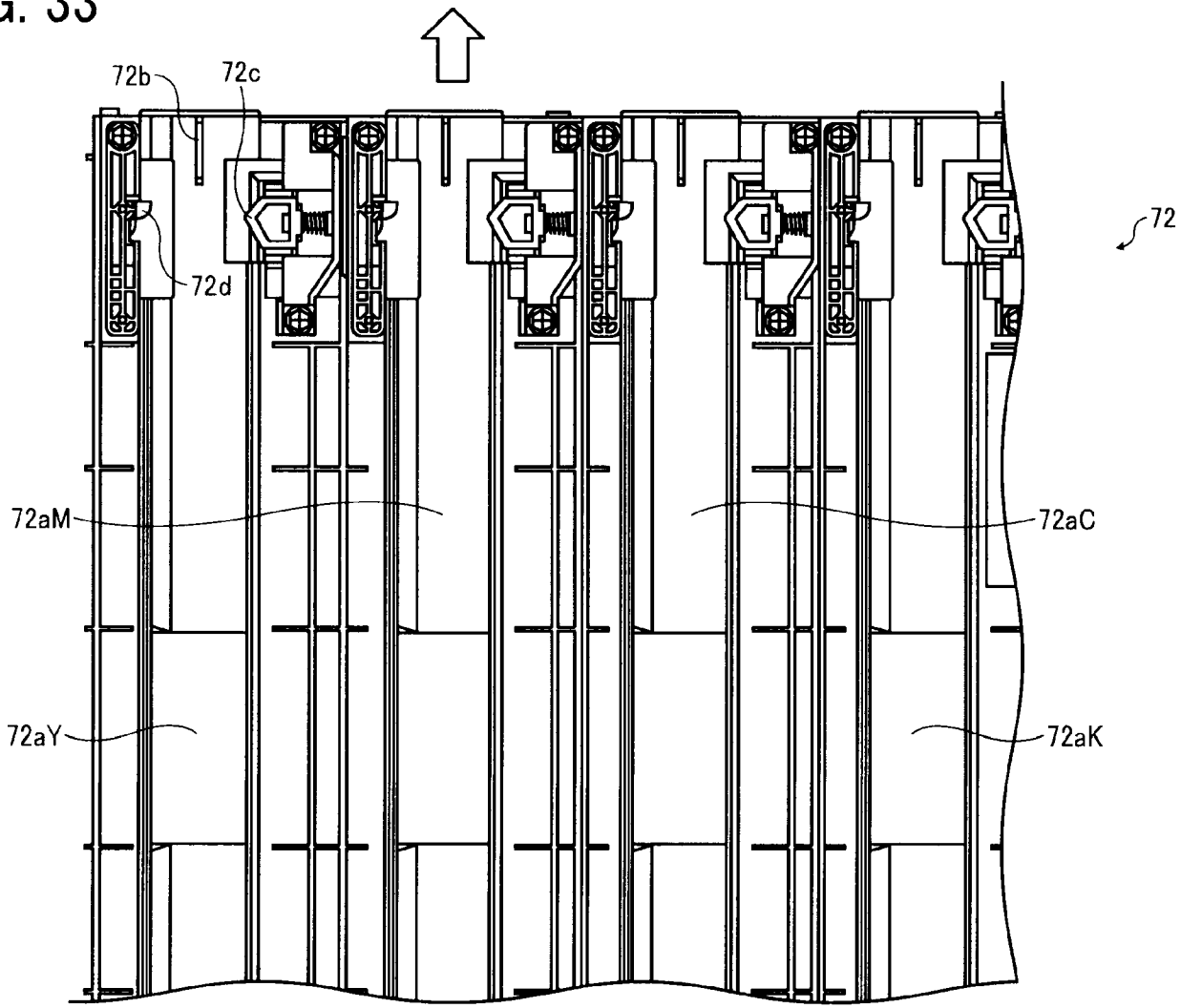
FIG. 33 is a top view illustrating the bottle holder in the toner container frame shown in FIG. 32.
Figure 37:
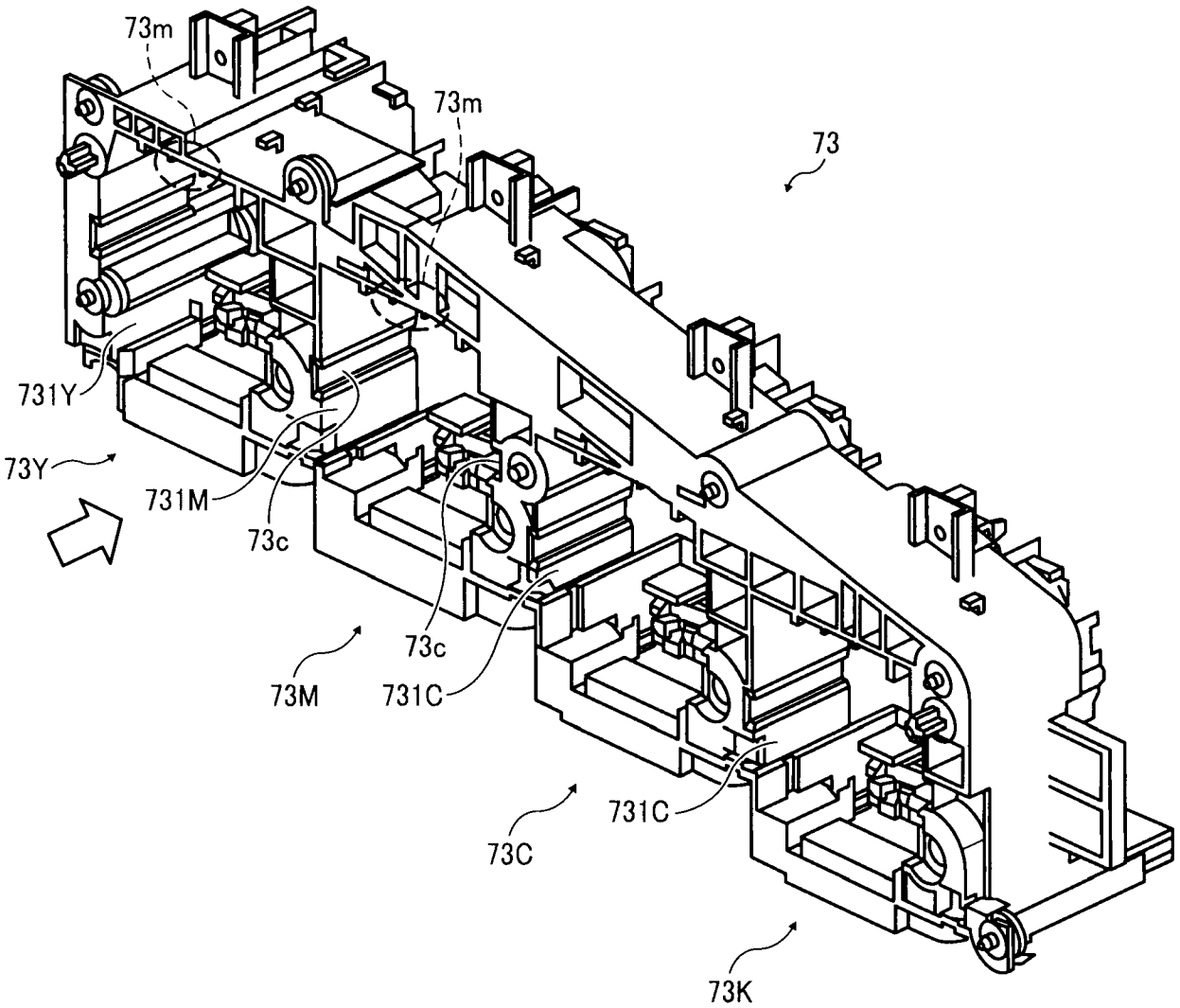
FIG. 37 is a perspective view illustrating a cap holder in the toner container frame shown in FIG. 4.

Further, in FIG. 37, the bottle holders 730Y, 730M, 730C, and 730K for respective color toners are formed in the cap holder 73, and, when the toner containers 32Y, 32M, 32C, and 32K are inserted into the toner container frame 70 in the direction indicated by the arrow shown in FIGS. 32 and 33, the caps 34Y, 34M, 34C, and 34K are held in position not to rotate by the respective cap holders 73Y, 73M, 73C, and 73K.

Referring to FIGS. 32 through 36, the bottle holder 72 of the toner container frame 70 further includes, for each color, a torsion coil spring 72*f* in addition to the bottle receiving face 72*a*, the stopper-release pressing member 72*b*, a pressing member 72*c*, the pressure receiving member 72*d*, and the compression spring 72*e*.

Figure 36:
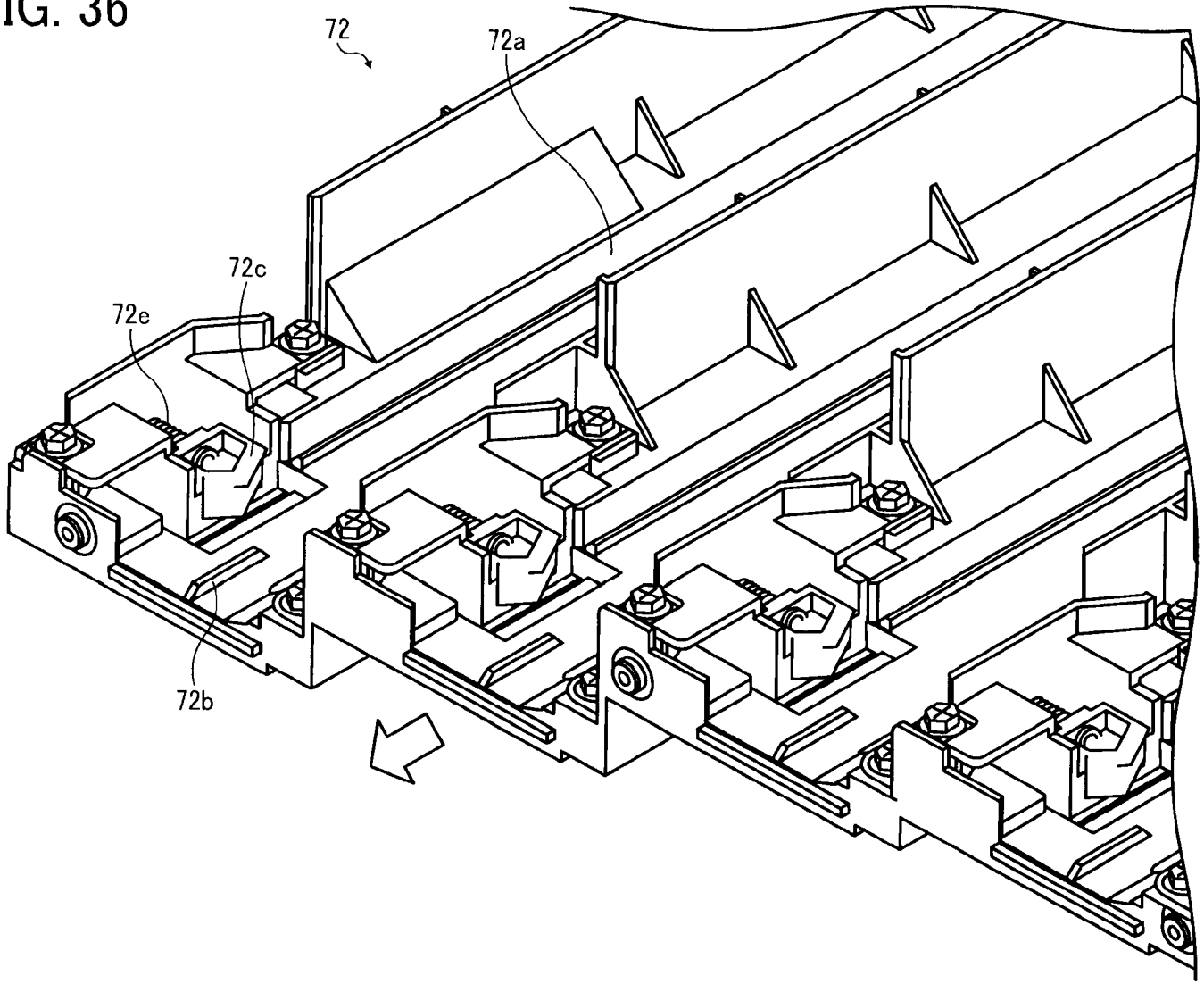
FIG. 36 is an enlarged perspective view illustrating the bottle holder close to front end shown in FIG. 34 when viewed from another angle.

In FIG. 33, the pressing member 72*c* is provided in the right side sidewall of the bottle holder 71*a* and disposed on the downstream side in the direction of insertion of the toner container 32Y. As shown in FIGS. 34 and 36, a tip of the pressing member 72*c* is mountain-shaped or trapeziform, and the bottom portion of the pressing member 72*c* is connected to the one side of the compression spring 72*e*. The pressing member 72*c* is biased leftward in FIG. 33 by the compression spring 72*e*.

Figure 35:
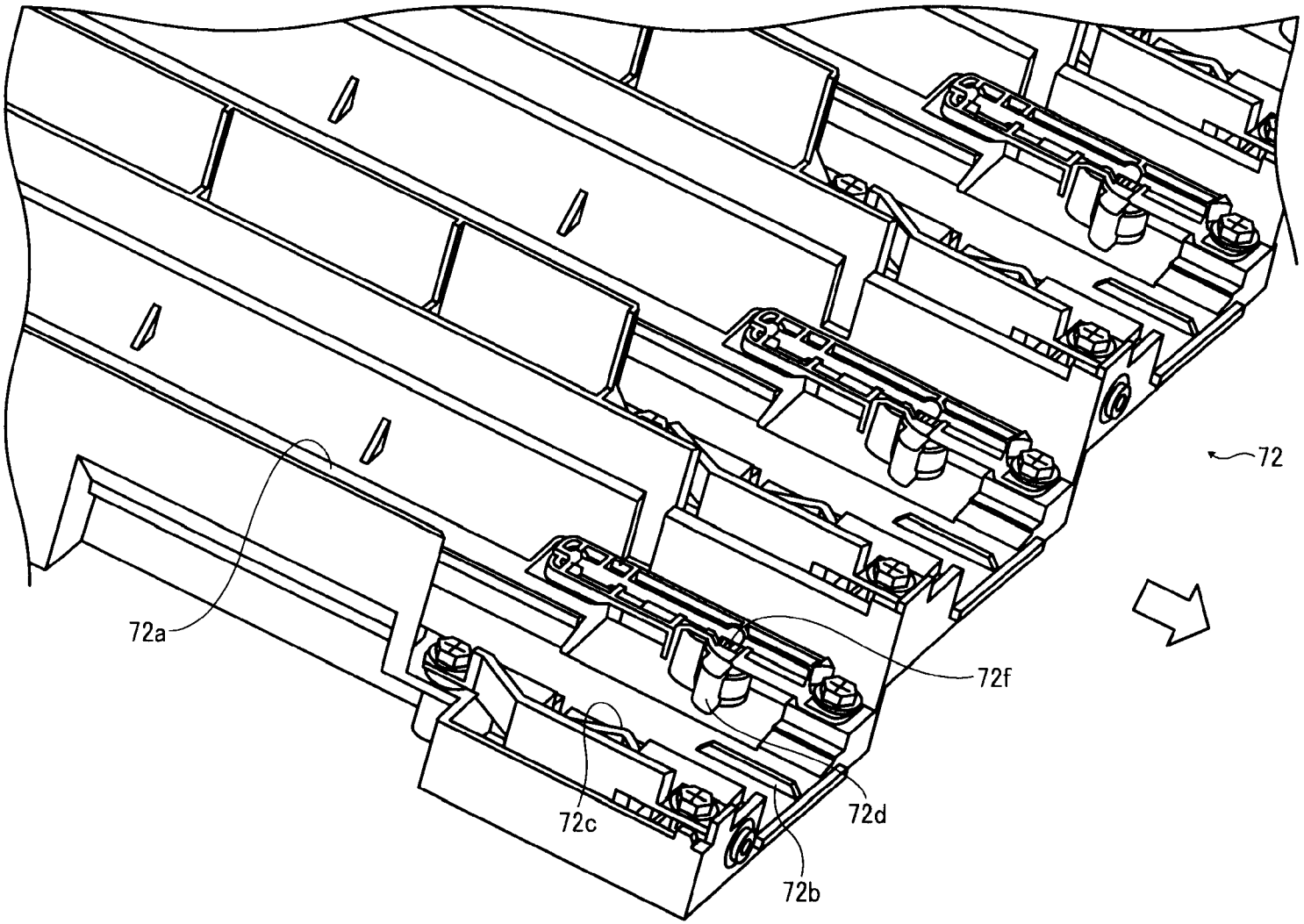
FIG. 35 is an enlarged perspective view illustrating the bottle holder close to front end shown in FIG. 34 when viewed from another angle.

By contrast, in FIG. 33, the pressure receiving member 72*d* is provided on the left side sidewall of the bottle receiving face 72*a* facing the pressing member 72*c* and is positioned on the downstream side in the direction of insertion of the toner container 32Y. As shown in FIG. 35, the pressure receiving member 72*d* is curved V-shaped whose valley portion faces a right lower side in FIG. 33, and the torsion coil spring 72*f* is connected to the valley portion. The pressure receiving member 72*d* can pivot around a shaft of the coil portion of the torsion coil spring 72*f*.

Then, the position of the cap 34Y is determined by the above-configured the pressing member 72*c* and the pressure receiving member 72*d* just before the cap 34Y is inserted into the cap holder 73 in installation of the toner container 32Y into the toner container frame 70. More specifically, the cap 34Y is pressed leftward in FIG. 33 by the pressing member 72*c* while the pressing rail 34*n*2 (see FIG. 15) of the cap 34Y engages the pressing member 72*c*. Then, while the pressure receiving face 34*n*3 (see FIG. 14) slides on the pressure receiving member 72*d*, the pressure receiving member 72*d* receives the pressing force thus exerted on the cap 34Y by the pressing member 72*c*. Thus, the position of the cap 34Y in the bottle holder 72 can be determined on the right side and the left side in FIG. 33.

With reference to FIGS. 37 through 41, the cap holder 73 of the toner container frame 70 includes the main-reference pin 73*a*, the sub-reference pin 73*b*, the engaged portion 73*m*, the pair of lateral grooves 73*c*, the pair of shutter closing members 73*d* (shutter retainer), the toner supply opening 73*w* surrounded by the wall 73*w*1, an escape portion 73*k*, the antenna 73*e* dedicated for the RFID chip 35, and the driving gear 81.

As described-above using FIG. 14, the main-reference pin 73*a* and the sub-reference pin 73*b* are respectively fitted into the primary positioning hole 34*a* and the secondary positioning hole 34*b*. Thus, the position of the cap 34Y in the cap holder 73 is determined.

Figure 41:
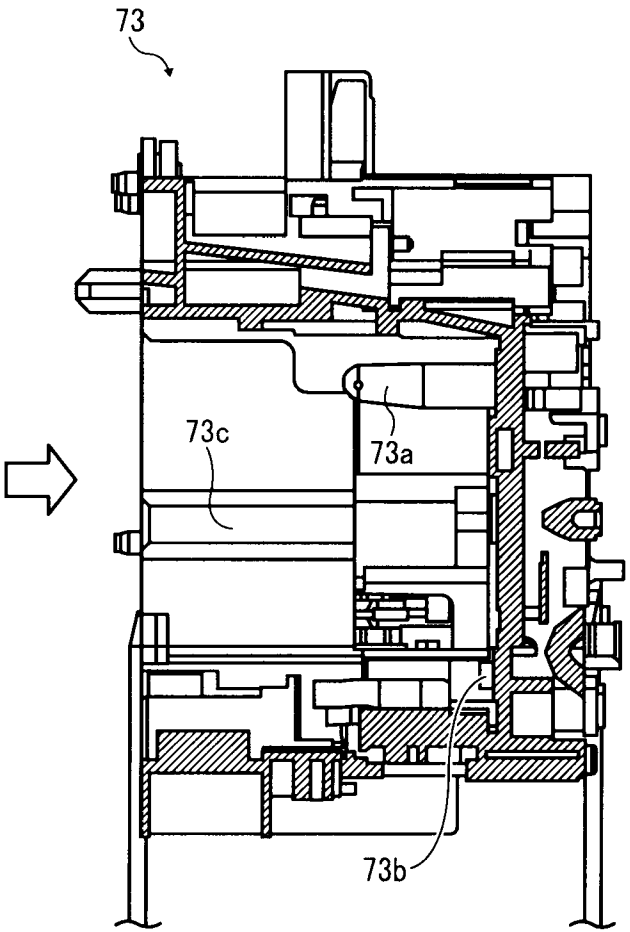
FIG. 41 is a cross sectional view illustrating the cap holder shown in FIG. 37.
Figure 40:
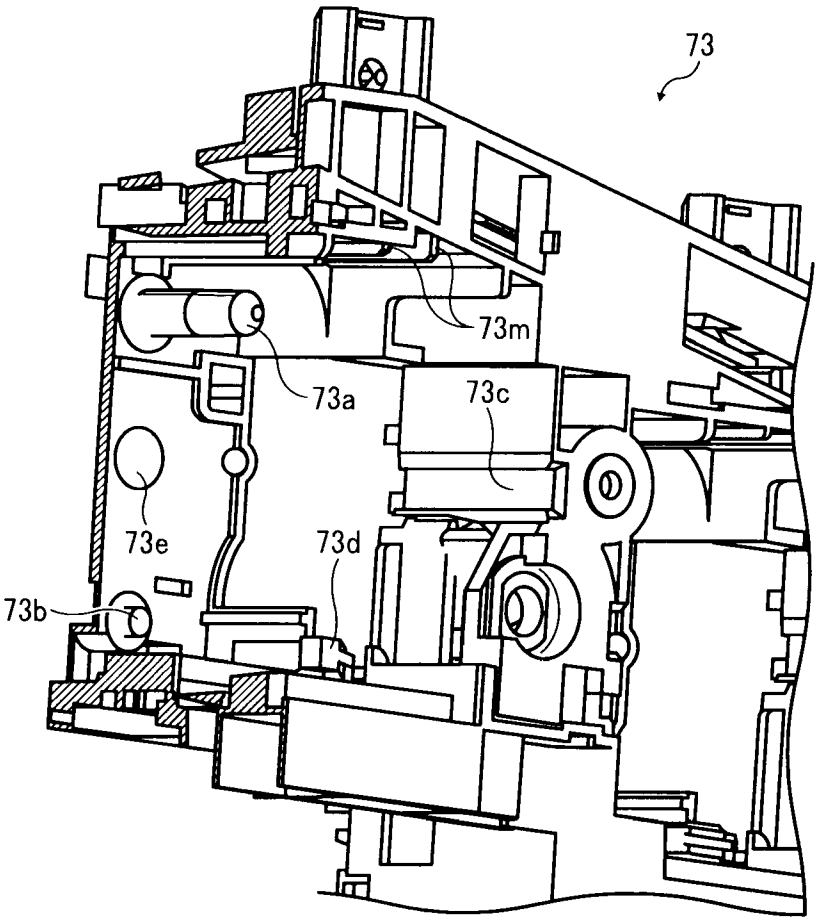
FIG. 40 is an enlarged perspective view illustrating the vicinity of the front wall of the cap holder shown in FIG. 38 when viewed from another angle.

Herein, with reference to FIG. 41, the main-reference pin 73*a* has a length longer than that of the sub-reference pin 73*b* in the longitudinal direction. The positions of bases (reference faces) of the pins 73*a* and 73*b* are on the same plane. In addition, the main reference pin 73*a* is tapered whose diameter decreases toward a tip thereof. Thus, the cap 34Y can be smoothly inserted into the cap holder 73 in the longitudinal direction in the installation process of the toner container 32Y into the container fame 70.

In addition, the engaged portions 73*m* engage the first engaging member 34*e* and the second engaging member 34*f*, serving as the first restriction members, formed in the cap 34Y of the toner container 32Y. Therefore, the cap 34Y is inserted into or released from the cap holder 73 while the horizontal position of the cap 34Y is restricted by the first engaging member 34*e* and the second engaging members 34*f* respectively engaged with the engaged portions 73*m*. Then, in the state in which the cap 34Y is set in to the cap holder 73, the horizontal position of the cap 34Y is restricted.

In addition, the lateral grooves 73*c* engage the lateral protrusions 34*c* (second restriction member) formed in the cap 34Y of the toner container 32Y. With this configuration, the cap 34Y is installed into the cap holder 73 while the position of the cap 34Y in the rotation direction is restricted by the two lateral protrusions 34*c* (second restriction members) engaged with the lateral grooves 71*c* (groove) of the cap holder 73 shown in FIG. 38.

Next, operation of the shutter closing member 73*d* in conjunction with the opening and closing operation of the shutter 34*d* is described in further detail below with reference to FIGS. 43 through 45.

Referring to FIG. 43, in the opening operation of the shutter 34*d*, initially, as the cap 34Y of the toner container 32Y is installed into the cap holder 73 in a direction indicated by an arrow in FIG. 43, the first arms 73*d*1 contact the outer vertical surface 34*s* of the projection members 34*m*, and the second arm 73*d*2 contact the handle parts 34*d*11.

Referring to FIG. 44, when the toner container 32Y is further inserted into the toner container frame 70 from the state shown in FIG. 43, because the outer vertical faces 34*s* of the cap 34Y press the long arms 73*d*1 of the shutter closing members 73*d*, the shutter closing members 73*d* (shutter retainer) are rotated around the rotation shaft 73*d*3 as indicated by arrow ○ shown in FIG. 43. Subsequently, the first arms 73*d*1 hold the outer vertical faces 34*s* of the projection portions 34*m*, and the second arms 73*d*2 hold the side walls 34*d*11*c* of the handle parts 34*d*11 in the main shutter portion 34*d* 1 of the shutter 34*d* while engaging the engagement wall 34*d*11*a* of the handle part 34*d*11 of the shutter 34*d*.

Subsequently, when the toner container 32Y is further inserted into the toner container frame 70 from the state shown in FIG. 44, the shutter 34*d* contacts the wall 73*w*1 surrounding the toner supply opening 73*w* in the cap holder 73 (see FIG. 38) and is sandwiched between the wall 73*w*1 and the second arm 73*d*2. In this state, the shutter 34*d* cannot proceed any further in the direction of insertion. That is, the absolute movement of the shutter 34*d* is stopped and the shutter 34*d* does not move in the cap holder 73. However, because the cap 34Y of the toner container 32Y can further move forward in the direction of insertion with the shutter 34*d* fixed in position in the cap holder 73, the shutter 34*d* moves relative to the cap 34Y of the toner container 32Y.

More specifically, in the state shown in FIG. 45, as the shutter support portion 34Y1B of the cap 34Y further moves in the cap holder 73 in the direction of insertion while the shutter 34*d* is stopped in the cap holder 73, the shutter 34*d* can open the toner outlet W by moving relative from the cap 34Y side to the container body 33Y side. At this time, in FIG. 45, the shutter 34*d* opens the toner outlet W while the first arms 73*d*1 hold both sides of the outer vertical faces 34*s* of the shutter support section 34Y1B of the cap 34Y, and the second arms 73*d*2 hold the handle part 34*d*11 of the shutter 34*d*.

Therefore, the state of the shutter 34*d* and the cap 34Y in the cap holder 73 is determined, and the shutter 34*d* can be smoothly opened.

On the other hand, in detachment of the cap 34Y of the toner 32Y from the cap holder 73 of the toner container frame 70, the above-described operation is performed in the reverse sequence (vise versa). That is, when the toner container 32Y is pulled out from the toner container from 73, the shutter closing members 73*d* are moved from the state shown in FIG. 45 to the state shown in FIG. 43, via the state shown in FIG. 44 as the shutter 34*d* closes the toner outlet W.

As described above, in the present embodiment, because the outer vertical faces 34*s* is longer in the direction of insertion (upward in FIG. 44, the timing at which the shutter closing member 73*d* releases the outer vertical faces 34*s* held by the first arms 73*d*1 can be delayed from when the shutter closing members 73*d* completely closes the shutter 34*d*. More specially, because the outer vertical face 34*s* of the projection portion 34*m* is lengthened to project upward in FIG. 44, when the shutter 34*d* closes from the state shown in FIG. 45 to the state shown in FIG. 44, with the first arms 73*d*1 holding the outer vertical faces 34*s* of the projection portions 34*m* and the second arms 73*d*2 holding the handle parts 34*d*11 of the shutter 34*d*, the shutter 34*d* can fully closed while preventing the shutter closing member 73*d* from rotating in the direction indicated by arrow P in FIG. 44 (to a state shown in FIG. 43).

Namely, if the outer vertical faces 34*s* are not extended to project forward (upward in FIG. 44), the first arms 73*d*1 release the holding outer vertical face 34*s* earlier than in the configuration shown in FIGS. 43 through 45, and accordingly the shutter closing members 73*d* are relatively early rotated in the arrow P direction in FIG. 43 although the shutter 34*d* has not yet fully closed the toner outlet W.

By contrast, in the present embodiment, because the cap 34Y includes the projection portions 34*m*, the toner container 32Y is not released from the image forming apparatus before the shutter 34*d* fully closes the toner outlet W.

It is to be noted that, with reference to FIGS. 38 and 39, because the projection portion 34*m* projects forward from the reference wall face 34*a*, in order not to hit an inner front wall of the cap holder 73, escape portions 73 constituted as holes or concave portions are formed in the inner surface of the cap holder 73, in portions facing the projection portion 34*m*, and therefore, the projection portion 34*m* is fitted into the escape portion 73*k*.

Next, with reference to FIGS. 35 and 46A through 46D, the states of the cap 34Y in the cap holder 73 and bottle holder 72 in insertion of the toner container 32Y are described below.

Initially, referring to FIG. 35, in the insertion of the toner container 32Y into the bottle holder 72, the cap 34Y slides on the bottle receiving face 72*a* and is held by the pressing member 72*c* and pressure-receiving member 72*d*, jolting of the cap 34Y immediately before the cap 34Y is inserted into the cap holder 73 is inhibited.

Subsequently, the first engaging member 34*e* and the second engaging members 34*f* engage the engaged portion 73*m*, and the lateral protrusions 34*c* are fitted into the lateral grooves 73*c*, thus fixing the position of the cap 34Y in the lateral direction and vertical direction in the cap holder 73. At this time, the state of the cap 34Y is shifted from the position shown in FIG. 46A to the position shown in FIG. 46B.

Figure 46A:
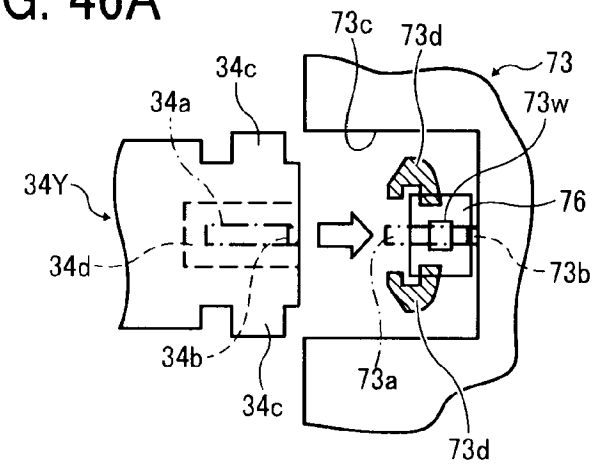
FIGS. 46A through 46D are schematic diagrams illustrating a process in which the cap of the toner container shown in FIG. 14 is inserted into the cap holder shown in FIG. 37.
Figure 46B:
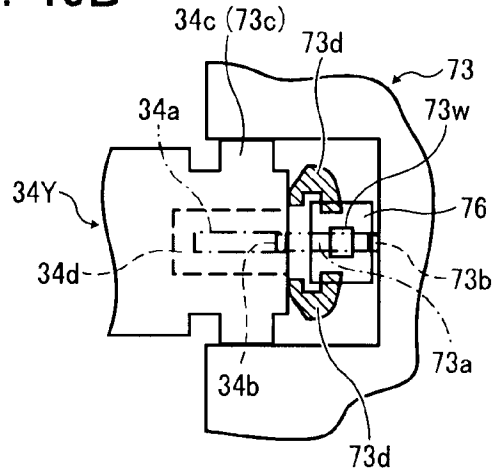
Figure 46C:
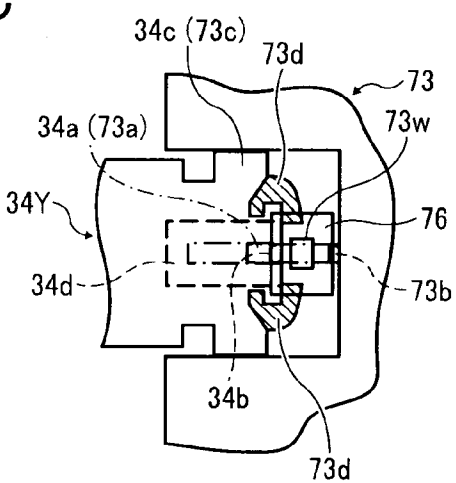

Subsequently, as shown in FIG. 46C, the main-reference pin 73*a* of the cap holder 73 is fitted into the primary positioning hole 34*a* of the cap 34Y, and then the sub-reference pin 73*b* is fitted into the secondary positioning hole 34*b* of the cap 34Y. The step-by step positioning of the cap 34Y in the cap holder 73 is completed.

In addition, while the positioning is performed (before engagement between the sub-reference pin 73*b* and the secondary positioning hole 34*b* is completed), the stopper-release pressing members 72*b* release the contact between the stopper 34*d*22 of the shutter 34*d* and the contact face 34*n* 5 of the shutter container 34*n* in the cap 34Y, and then, the shutter closing members 73*d* (shutter retainer) determine the position of the shutter 34*d* and the cap 34Y in the cap holder 73 (see FIG. 46C). Thus, the shutter 34*d* is opened by the shutter closing members 73*d*.

Additionally, before the engagement between the secondary positioning hole 34*b* and the sub-reference pin 73*b* is completed, the rim (wall) 72*w*1 surrounding the toner outlet W of the cap 34Y slides on the seal member 76 surrounding the toner supply opening 73*w* in the cap holder 73.

Figure 46D:
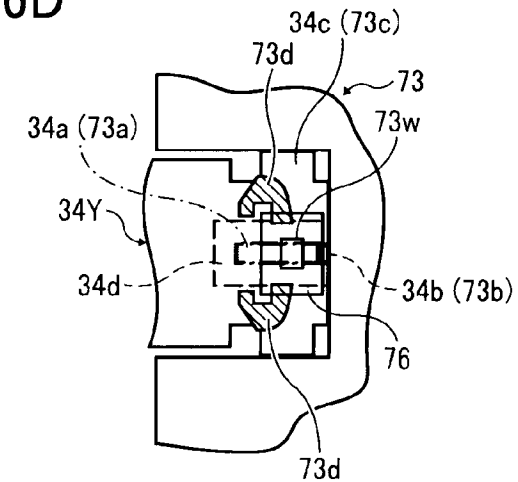

Then, the opening toner outlet W of the cap 34Y communicates with the toner supply opening 73*w*, and consequently, the setting of the cap 34Y of the toner container 23Y in the cap holder 73 in the toner container holder 70 is completed (see FIG. 46D). At this time, the gear 33*c* of the container body 33Y engages the driving gear 81 in the image forming apparatus 100, and the RFID chip 35 of the cap 34Y is set to a position suitable for communication with the antenna 73*e* in the image forming apparatus 100.

As described above, in the present embodiment, in the installation of the toner container 32Y into the toner container frame 70, because the position of shutter 34*d* of the cap 34Y is determined in the cap holder 73 by the shutter closing member 73*d*, opening the shutter 34*d* in a tilted state can be prevented. In addition, in the installation of the toner container 32Y, after the main-reference pin 73*a* in the cap holder 73 is fitted into the primary positioning hole 34*a* of the cap 34Y, that is, main positioning is finished, the position of the shutter 34*d* in the cap holder 73 is determined by the shutter closing member 73*d* (shutter retainer). Then, the sub-reference pin 73*b* of the cap holder 73 is fitted into the secondary positioning hole 34*b* of the cap 34Y, that is, sub-positioning is finished, and thus, step by step positioning is completed. Therefore, the positions of the shutter 34*d* and cap 34Y can be corrected before step-by step positioning is completed.

In addition, before the position of the cap 34Y is determined by fitting the main-reference pin 73*a* into the primary positioning hole 34*a*, the lateral position as well as vertical position of the cap 34Y is restricted by fitting the lateral protrusions 34*c* of the cap 34Y into the lateral grooves 73*c* in the cap holder 73 and the like, and therefore, the cap 34Y can be smoothly inserted into the cap holder 73.

Further, after the shutter closing members 73*d* determine the position of the shutter 34*d* and the cap 34Y in the cap holder 73, the seal member 76 surrounding the toner supply opening 73*w* slides on the rim 34*r* surrounding the toner outlet W in the cap 34Y. Subsequently, the secondary positioning hole 34*b* of the cap 34Y engages the sub-reference pin 73*b*, thus step-by-step positioning is completed. Therefore, the position of the shutter 34*d* of the cap 34Y can be corrected without receiving the sliding resistance caused between the seal member 76 and the toner outlet W. In addition, in the present embodiment, because the shutter closing members 73*d* are provided close to not the main-reference pin 73*a* but the sub-reference pin 73*b*, the position of the shutter 34*d* and the cap 34Y in the cap holder 73 can be easily corrected.

Conversely, in the removal of the toner container 32Y from the toner container frame 70, after the engagement between the secondary positioning hole 34*b* of the cap 34Y and the sub-reference pin 73*b* of the cap holder 73 is released, the engagement state between the primary positioning hole 34*a* of the cap 34Y and the main-reference pin 73*a* is kept until the closing process of the shutter 34*d* is completed. Therefore, closing the shutter 34*d* in the cap 34Y in a tilted state can be prevented.

It is to be noted that, in FIG. 42, because the seal member 76 is provided around the toner supply opening 73*w* in the cap holder 73 to prevent the leakage of the toner from a gap between the opening toner outlet W in the cap 34Y and the toner supply opening 73*w* in the cap holder 73 as described above, when the cap 34Y is in the cap holder 73, a reaction force generated by the elastic deformation of the seal member 76, which is an upward force in FIG. 28A, is exerted on the cap 34Y. However, as shown in FIG. 27, in the cap 34Y according to the present embodiment, the primary positioning hole 34*a* that engages the main-reference pin 73 is formed just above the toner outlet W, at the position on which the reaction force from the seal member 76 is exerted. Therefore, floating and tilt of the cap 34Y caused by the reaction force can be prevented.

Further, referring to FIG. 28A, in the cap 34Y according to the present embodiment, the primary positioning hole 34*a* that engages the main-reference pin 73*a* is at a farthest position (ceiling) from the toner outlet W connected to the toner supply opening 73*w*, above the toner outlet W. Therefore, if backlash is present in the engagement between the main-reference pin 73*a* and the primary positioning hole 34*a*, thereby causing the cap 34Y to tilt, the tilt of the cap 34Y is less likely to cause the positional deviation of the toner outlet W relative to the toner supply opening 73*w* in the cap 34Y according to the present embodiment.

As described above, in the image forming apparatus 100 according to the present embodiment, besides opening and closing the main body cover 110, users can complete insertion and removal of the toner container 32Y from the image forming apparatus 100 with a single action of moving the toner container 32Y in the longitudinal direction while handling the handle part 33*d* because the shutter 34*d* opens and closes the toner outlet W in synchronization with the movement of the toner container 32Y.

In addition, in the toner container 32Y according to the present embodiment, because the toner outlet W opens downward and has a relatively large opening area, the toner can be discharged from the toner outlet W directly under its own weight.

Further, the toner container 32Y is installed in the toner container frame 70 in the image forming apparatus 100 not from above but from a front side of the toner container frame 70 in the image forming apparatus 100. Therefore, design flexibility in layout above the toner container frame 70 can be enhanced. For example, even when a scanner (document reader) is positioned just above the toner supply device 60, the workability and operability of installation and removal of the toner container 32Y in/from the toner container frame 70 in the image forming apparatus 100 is not degraded.

In addition, because the toner container 32Y is installed in the image forming apparatus 100 with its long side horizontal, toner capacity of the toner container 32Y can be increased without sacrificing the design flexibility in vertical layout of the entire the image forming apparatus 100, and frequency of replacement of the toner container 32Y can be reduced.

As described above, the toner container 32Y according to the present embodiment includes the shutter 34*d* that moves in the longitudinal direction to open and close the toner outlet W formed in the bottom surface of the cap 34Y, the primary positioning hole 34*a* and the secondary positioning hole 34*b* disposed at suitable positions, respectively serving as the main-positioning reference and the sub-positioning reference, and the first restriction member including the first engaging member 34*e* and the second engaging members 34*f* both disposed close to the primary positioning hole 34*a*. Thereby, the setting space for the toner container 32Y in the image forming apparatus 100 can be secured and installation and removal of the toner container in/from the toner container frame 70 in the image forming apparatus 100 can be facilitated. Therefore, when the toner is discharged from the toner outlet under its own weight, the position of the cap 34Y is reliably determined in the image forming apparatus 100 at a suitable position without any adverse effect to discharge of the toner.

Second Embodiment

A second embodiment is described below with reference to FIGS. 49 through 51.

Figure 49:
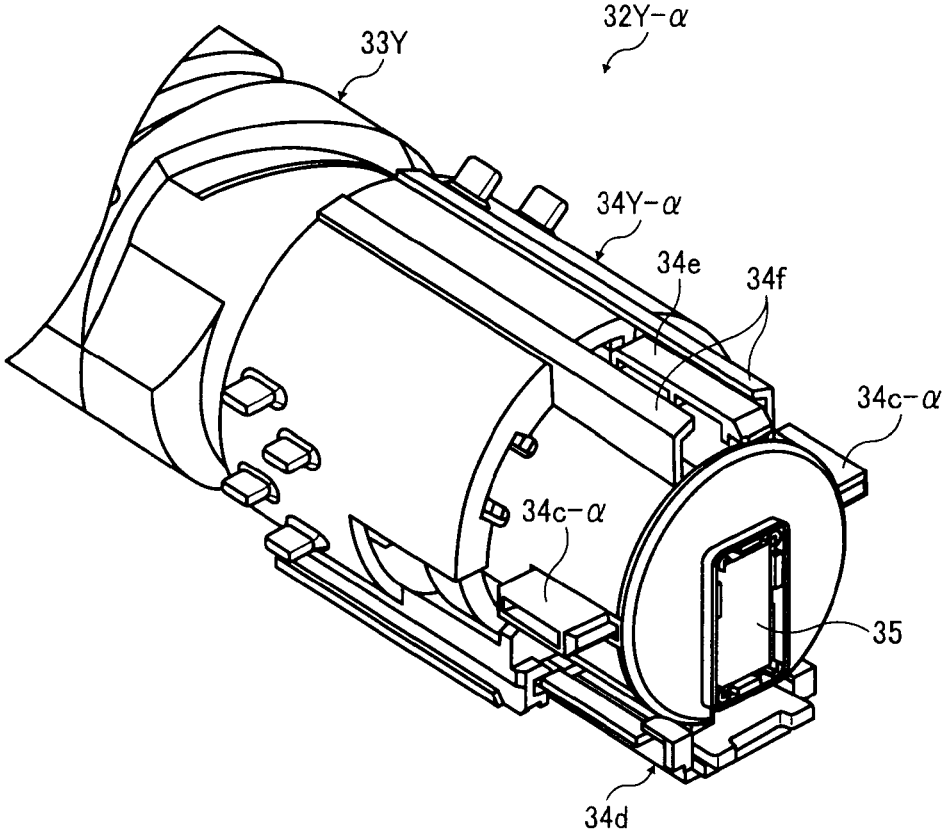
FIG. 49 is a perspective view illustrating a cap of a toner container according to a second illustrative embodiment of the present invention.

FIG. 49 is a schematic perspective diagram illustrating vicinity of a cap 34Y-α of a toner container 32Y-α according to the second embodiment and corresponds to FIG. 15 of the first embodiment. FIG. 50 is a front vied illustrating the cap 34Y-α and corresponds to FIG. 8 that illustrates the cap 34Y according to the first embodiment FIG. 51 is a schematic perspective diagram illustrating a cap-surrounding portion 731Y-α in the cap holder 73-α in which the cap 34Y-α is inserted.

The configuration of lateral protrusions 34*c*-α in this embodiment is different from the lateral protrusions 34*c* in the first embodiment.

Figure 50:
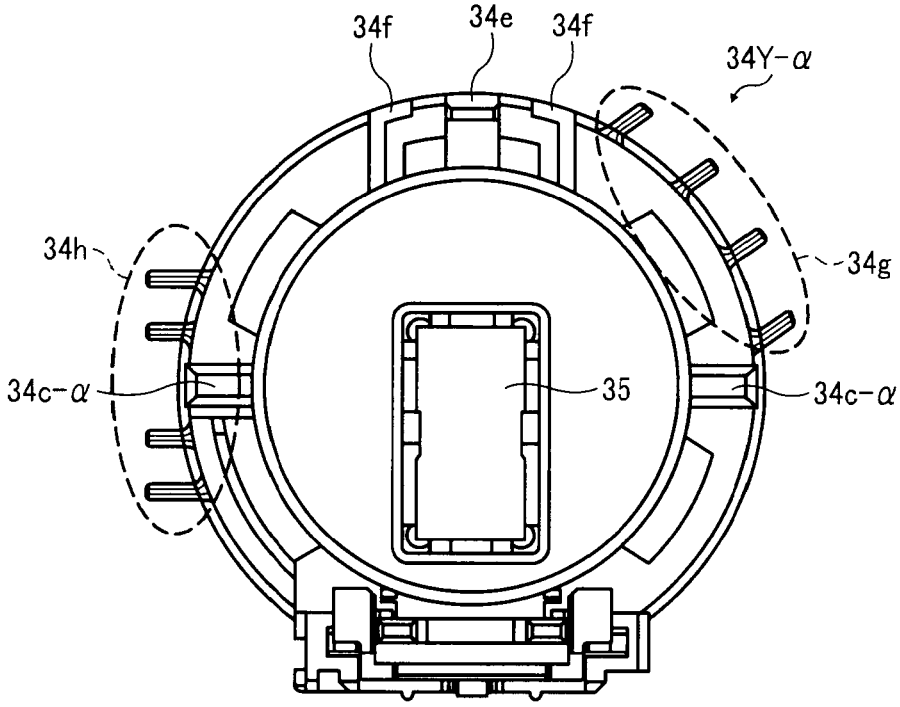
FIG. 50 is a front view illustrating the cap of the toner container shown in FIG. 49.

With reference to FIGS. 49 and 50, similarly to the toner container 32Y in the first embodiment, the toner container 32Y-α also includes the container body 33Y and the cap 34Y-α in the present embodiment. It is to be noted that, for ease of illustration and description, the primary positioning hole 34*a* (main-positioning reference) and the secondary positioning hole 34*b* (sub-positioning reference) are omitted in FIGS. 49 and 50, and components of the toner container 32Y-α similar to those of the toner container 32Y in the first embodiment are given identical numerals and the description thereof is omitted below.

Figure 51:
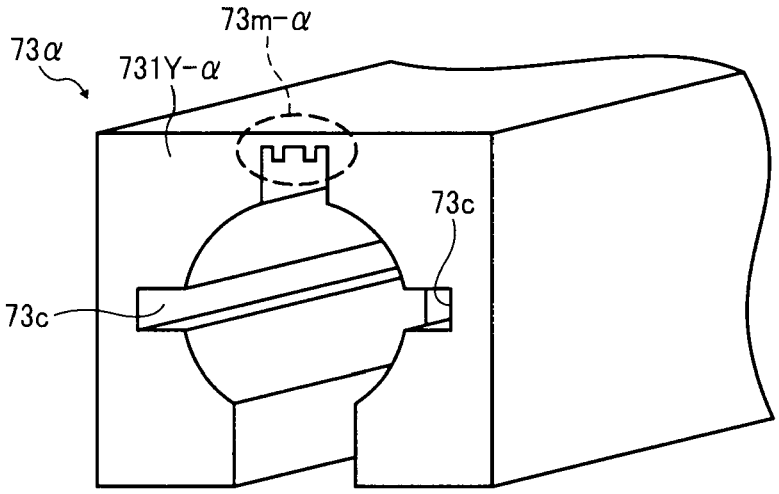
FIG. 51 is a schematic perspective view illustrating a cap holder in which the cap shown in FIG. 49 is inserted.

With reference to FIG. 51, similarly to the cap holder 73 in the first embodiment, a cap holder 73Y-α includes a pair of lateral grooves 73-α and engaged portions 73*m*-α. Each of cap-surrounding portions 731Y-α, 731M-α, 731C-α, and 731K-α in the cap holder 73-α is rectangular parallelepiped including a cylindrical hollow so as to surround the respective first cap bodies 34Y1-α, 34M-α, 34C-α, and 34K-α. It is to be noted that, in FIG. 51, although the cap holder 73Y-α is simplified with the main-reference pin 73*a* and the sub-reference pin 73*b* omitted for simplicity, the main-reference pin 73*a* and the sub-reference pin 73*b* are provided extreme downstream in the inner wall of the cap holder 73Y-α (backside in FIG. 51).

In addition, in the cap 34Y-α according to the second embodiment, the first engaging member 34*e* and the second engaging members 34*f* engage corresponding engaged portions 73*m* (projecting portions) in the cap holder 73 (see FIGS. 49 and 50). Therefore, the cap 34Y-α is inserted into or released from the cap holder 73 while the horizontal position of the cap 34Y-α is restricted by the first engaging member 34*e* and the second engaging members 34*f* respectively engaged with the engaged portions 73*m*. Then, in the state in which the cap 34Y-α is set in to the cap holder 73, the horizontal position of the cap 34Y-α is restricted.

With this configuration, the cap 34Y-α is installed into the cap holder 73-α while the position of the cap 34Y-α in the rotation direction is restricted by the two lateral protrusions 34*c*-α (second restriction members) shown in FIG. 49 engaged with lateral grooves 73c-α (groove) of the cap holder 73-α shown in FIG. 51. Then, in the state in which the cap 34Y is set in the cap holder 73-α, the position of the cap 34Y-α in the rotation direction is restricted by the engagement between the lateral protrusions 34Y-α and the lateral grooves 71c-α.

The lateral protrusions 34c-a (second restriction member) protruding from lateral sides of the cap 34Y-α horizontally are arranged symmetrically on a virtual horizontal line passing through a center position of the line, at positions away the center position. Each lateral protrusions 34c-α extends in the direction of insertion. Therefore, the cap 34Y-α can be inserted into the cap holder 73-α in balanced manner, guided by the lateral groove 73c-α of the cap holder 73-α.

In addition, with reference to FIGS. 49 and 50, the pair of lateral protrusions 34c-α is provided in a small (small outer) diameter portion of the cap 34Y-α in the front side of the direction of insertion, that is, the lateral protrusion 34c-α is formed on the first cap body 34Y1-α shown in FIG. 24. Moreover, as shown in FIG. 50, the lateral protrusions 34c-α are formed so as not to project from the outer diameter of the second cap body 34Y2 when viewed in a cross sectional view perpendicular to the direction of insertion, that is, a direction orthogonal to the surface of paper on which FIG. 50 is drawn. Accordingly, the lateral protrusions 34c-α can be formed by using the space effectively without increasing the size of the cap 34Y-α, that is, the outer diameter of the cap 34Y-α.

As described above, similarly to the toner container 32Y-α in the first embodiment, the toner container 32Y-α further includes the shutter 34d that moves in the longitudinal direction to open and close the toner outlet W formed in the bottom surface of the cap 34Y-α, the primary positioning hole 34a and the secondary positioning hole 34b disposed at suitable positions, respectively serving as the main-positioning reference, and the secondary positioning hole 34b serving as the sub-positioning reference, and the first restriction member including the first engaging member 34e and the second engaging members 34f both disposed close to the primary positioning hole 34a. Thereby, the setting space for the toner container 32Y-α in the image forming apparatus 100 can be secured and the installation and removal of the toner container in/from the toner container frame 70 in the image forming apparatus 100 can be facilitated. Therefore, when the toner is discharged from the toner outlet W under its own weight, the position of the cap 34Y-α is reliably determined in the image forming apparatus 100 at a suitable position without any adverse effect to discharge of the toner.

Third Embodiment

A third embodiment is described below with reference to FIGS. 52 and 53.

Figure 52:
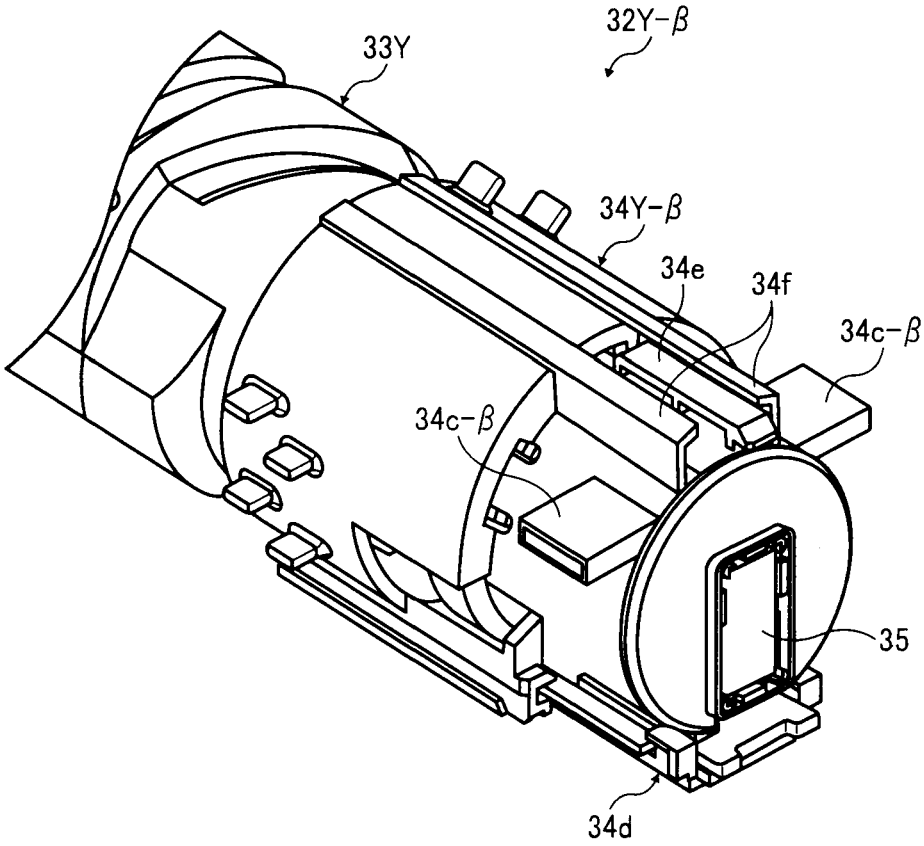
FIG. 52 is a perspective view illustrating a cap of a toner container according to a third illustrative embodiment of the present invention.

FIG. 52 is a schematic perspective diagram illustrating vicinity of a cap 34Y-β of the toner container 32Y-β according to the third embodiment and corresponds to FIG. 49 of the second embodiment. FIG. 53 is a schematic perspective diagram illustrating a cap-surrounding portion 731Y-β in the cap holder 73-β in which the cap 34Y-β is inserted, and corresponds to the cap-surrounding portion 731Y-α in the cap holder 73-α according to the second embodiment shown in FIG. 51.

The configuration of lateral protrusions 34c-β in this embodiment is different from the lateral protrusions 34c-α in the second embodiment.

Figure 53:
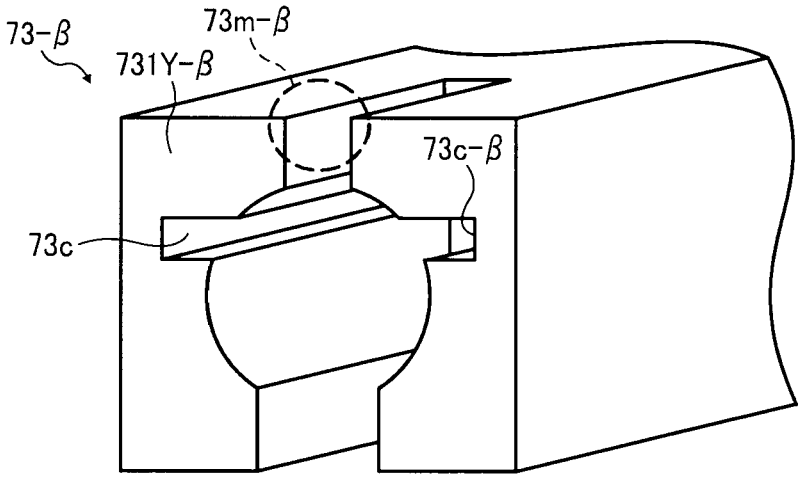
FIG. 53 is a schematic perspective view illustrating a cap holder in which the cap shown in FIG. 52 is inserted.

With reference to FIG. 53, similarly to the toner container 32Y in the first embodiment, the toner container 32Y-β also includes the container body 33Y-β and a cap 34Y-β in the present embodiment. It is to be noted that for ease of illustration and description, the primary positioning hole 34a (main reference) and the secondary positioning hole 34b (sub reference) are omitted in FIG. 52, and components of the toner container 32Y-β similar to those of the toner container 32Y in the first embodiment are given identical numerals and the description thereof is omitted below.

With reference to FIG. 53, similarly to the toner container 32Y in the first embodiment, a cap holder 73Y-β includes a pair of lateral grooves 73-β and engaged portions 73m-β. Each of cap-surrounding portion 731Y-β, 731M-β, 731C-β, and 731K-β in the cap holder 73-β is rectangular parallelepiped including a cylindrical hollow in surrounding portion of the first cap bodies 34Y1-β, 34M1-β, 34C1-β, and 34K1-β. It is to be noted that, in FIG. 53, although the cap holder 73d is simplified with the figure of the main-reference pin 73a and the sub-reference pin 73b omitted for simplicity, the main-reference pin 73a and the sub-reference pin 73b are provided extreme downstream in the inner wall of the cap holder 73-β (backside in FIG. 53).

In addition, in the cap 34Y-β according to the third embodiment, the first engaging member 34e and the second engaging members 34f shown in FIG. 52 engage corresponding engaged portions 73m (projecting portions) in the cap holder 73-β (see FIG. 53). Therefore, the cap 34Y-β is inserted into or released from the cap holder 73-β while the horizontal position of the cap 34Y-β is restricted by the first engaging member 34e and the second engaging members 34f respectively engaged with the engaged portions 73m. Then, in the state in which the cap 34Y-β is set in to the cap holder 73-β, the horizontal position of the cap 34Y-β is restricted.

With this configuration, the cap 34Y-β is installed into the cap holder 73-β while the position of the cap 34Y-β in the rotation direction is restricted by the two lateral protrusions 34c-β (second restriction members) shown in FIG. 52 engaged with lateral grooves 73c-β (groove) of the cap holder 73-β shown in FIG. 53. Then, in the state in which the cap 34Y-β is set in the cap holder 73-β, the position of the cap 34Y-β in the rotation direction is restricted by the engagement between the lateral protrusions 34Y-β and the lateral grooves 71c-β.

The lateral protrusions 34c-β (second restriction member) protruding from lateral sides of the cap 34Y-β horizontally are arranged above a virtual horizontal plane passing through a center position of the cap 34Y-β, at positions away the center position. That is, the lateral protrusions 34c-β is disposed far from the toner outlet W.

Further, as shown in FIG. 53, each of the lateral grooves 73c-β of the cap holder 73-β is provided at an upper position facing the lateral protrusions 34c-β, compared with the position of the lateral grooves 73c-α in the second embodiment shown in FIGS. 49 and 50. In this configuration, in the cap 73Y-β, because the distance between the outer ends of the lateral grooves 73c-β in the width direction (horizontal direction) can be reduced, the width (horizontal length in the direction perpendicular to the longitudinal direction) of the cap holder 73Y-β can be narrowed, that is, the respective cap-surrounding portion 731Y of the cap holder 73-β can be made more compact.

In addition, compared with a comparative configuration in which lateral positions 34c-β are arranged beneath the virtual horizontal plane (closer to the toner outlet W), in the configuration the lateral protrusions 34c-β are positioned above the virtual horizontal plane passing through the center position of the cap 34Y-β, even when the width (horizontal direction) of the lateral protrusions 34c-β are relatively small, floating and the tilt of the toner container 32Y-β can be prevented by the reaction force caused by the seal member 76 provided between the toner outlet W and the toner supply opening 73*w*.

As described above, similarly to the toner container 32Y in the first embodiment, the toner container 32Y-β includes the shutter 34*d* that moves in the longitudinal direction to open and close the toner outlet W formed in the bottom surface of the cap 34Y-β, the primary positioning hole 34*a* and the secondary positioning hole 34*b* disposed at suitable positions, respectively serving as the main-positioning reference, and the sub-positioning reference, and the first restriction member including the first engaging member 34*e* and the second engaging members 34*f* both disposed close to the primary positioning hole 34*a*. Thereby, the setting space for the toner container 32Y-β in the image forming apparatus 100 can be secured and the installation and removal of the toner container in/from the toner container frame 70 in the image forming apparatus 100 can be facilitated. Therefore, when the toner is discharged from the toner outlet W under its own weight, the position of the cap 34Y-β is reliably determined in the image forming apparatus 100 at a suitable position without any adverse effect to discharge of the toner.

Fourth Embodiment

A fourth embodiment is described below with reference to FIGS. 54 through 56.

Figure 54:
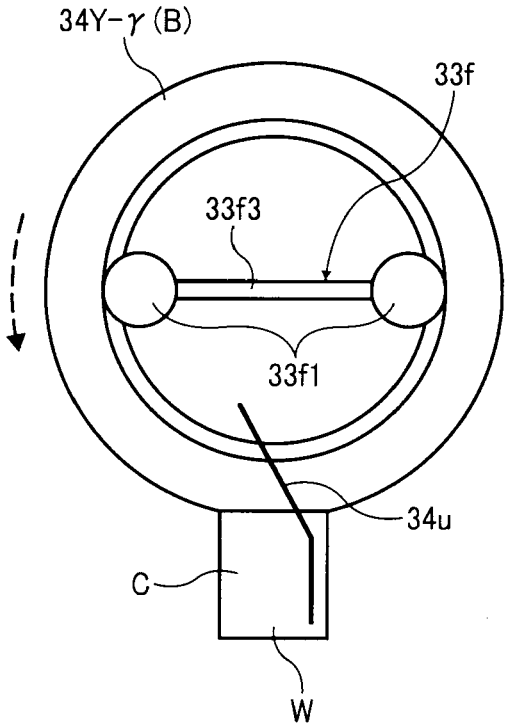
FIG. 54 is a cross sectional view illustrating a toner container according to a fourth illustrative embodiment of the present invention, when viewed from front side.

FIG. 54 is a schematic cross sectional view illustrating a cap 34Y-γ of a toner container 32Y-γ when viewed in the longitudinal direction of a toner container 32Y-γ and illustrates a cross section of the cap 34Y-γ perpendicular to the longitudinal direction, at the position of a toner outlet W. FIG. 55 is a cross sectional view illustrating the vicinity of the cap 34Y-γ of the toner container 32Y-γ and corresponding to FIG. 28A that illustrates the vicinity of the cap 34Y according to the first embodiment. FIG. 56 is a perspective view illustrating a flexible member 34*u* provided close to the toner outlet W of the toner container 32Y-γ.

This embodiment is different from the first embodiment in that the toner container 32Y-γ includes the flexible member 34*u* disposed close to the toner outlet W.

With reference to FIG. 54, similarly to the toner container 32Y in the first embodiment, the toner container 32Y includes the container body 33Y and the cap 34Y-γ. More specifically, with reference to FIG. 55, which is an exploded view illustrating the toner container 32Y-γ, the toner container 32Y-γ includes cap seal 37, the shutter 34*d*, a shutter seal 36 serving as a seal member, and the RFID chip 35 serving as the electronic data storage, in addition to the container body 33Y-γ and the cap 34Y-γ.

Further, with reference to FIG. 54, similarly to the toner container 32Y in the first embodiment, in the toner container 32Y-γ, the agitator 33*f*-γ that rotates together with the container body 33Y-γ is fitted in the opening A enclosed by the edge face 33*a* (see FIGS. 10 through 12). In addition, the agitator 33*f* includes the pair of stick member 33*f*1 that protrudes from the circular engagement edge 33*f*2 to the hollow B in the cap 34Y.

Figure 55:
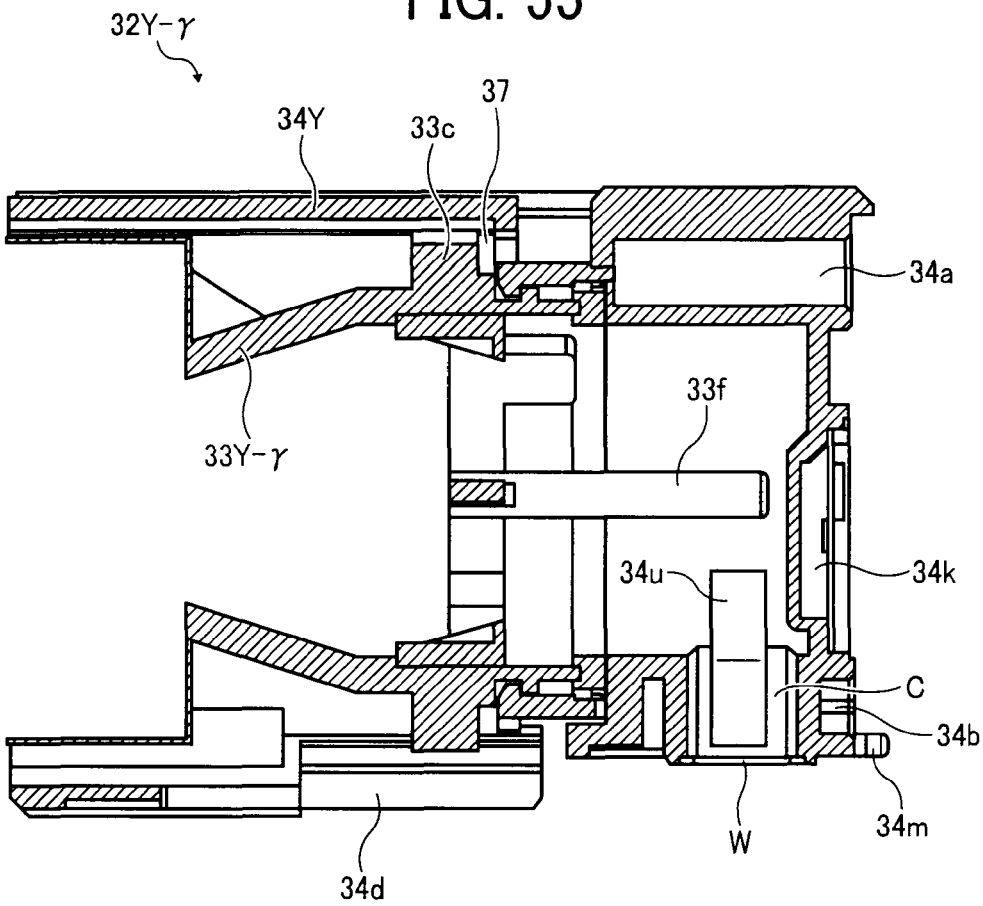
FIG. 55 is a cross sectional view illustrating vicinity of a cap of the toner container shown in FIG. 54.

Herein, with reference to FIGS. 54 and 55, different from other embodiments, the flexible member 34*u* that is constructed of a flexible member such as Mylar (registered trademark) having a thickness ranging from 0.188 mm to 0.500 mm extends from the toner drop route C to the hollow B in the cap 34Y-γ.

Figure 56:
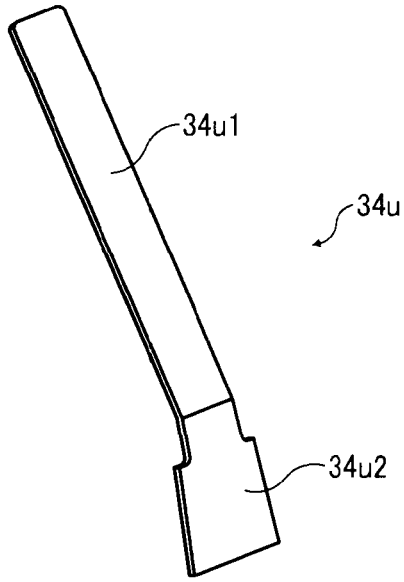
FIG. 56 is a perspective view illustrating a flexible member provided close to a toner outlet in the cap of the toner container shown in FIG. 54.

More specifically, as shown in FIG. 56, the flexible member 34*u* that is a strip having a single bent portion like a boomerang, and is divided by the bent portion into a fixing portion 34*u*1 and a flexible portion 34*u*2. The fixing portion 34*u*1 that is wider than the flexible portion 34*u*2 functions as an attachment face and is attached to (glued to) an interior wall of the toner dropping route C positioned close to the interior wall of the toner outlet W, that is, positioned close to the interior wall on the downstream side in the rotation direction of the agitation member 33*f*. Further, the fixing portion 34*u*2 is bonded to the interior wall of the toner dropping route C so that the bending portion of the flexible member 34*u* is positioned in the toner dropping route C.

Further, a tip of the flexible portion 34*u*1 of the flexible member 34*u* is a free end and the flexible portion 34*u*1 extends from the toner dropping route C to the hollow B. In addition, the tip of the flexible portion 34*u*1 vibrates by contacting the rotating stick members 33*f*1 of the agitation member 33*f*. Therefore, when the toner dropping route C is clogged with toner close to the toner outlet W), the toner accumulated in the vicinity of the toner outlet W can be separated by the flexible member 34*u*, and accordingly the toner can be further smoothly discharged from the toner outlet W.

It is to be noted that the configuration of the flexible member 34*u* is not limited to the shape according to the present embodiment, and, for example, the flexible member 34*u* can adopt shapes without a bending portion or the shape of the fixing portion can be changed.

Herein, similarly to the toner container 32Y-α in the first embodiment, the toner container 32Y-γ further includes the shutter 34*d* that moves in the longitudinal direction to open and close the toner outlet W formed in the bottom surface of the cap 34Y-γ, the primary positioning hole 34*a* and the secondary positioning hole 34*b* disposed at suitable positions, respectively serving as the main-positioning reference and the sub-positioning reference, at suitable position, and the first restriction member including the first engaging member 34*e* and the second engaging members 34*f* both disposed close to the primary positioning hole 34*a*. Thereby, the setting space for the toner container 32Y-γ in the image forming apparatus 100 can be secured and the installation and removal of the toner container in/from the toner container frame 70 in the image forming apparatus 100 can be facilitated. Therefore, when the toner is discharged from the toner outlet W under its own weight, the position of the cap 34Y-γ is reliably determined in the image forming apparatus 100 at a suitable position without any adverse effect to discharge of the toner.

It is to be noted that although including single-component developer consisting essentially of only toner in the above-described embodiments, the toner container 32Y, 32M, 32C, and 32K can also contain two component developer including toner and carrier to suitably supply a two-component development device. In this case, the effects described above can be achieved.

In addition, in the above-described embodiments, part or all of each of the image forming units 6Y, 6M, 6C, and 6K can be housed in a common unit casing and thus be formed as a process cartridge. In this case, the similar effects as those in the above-described embodiments can be attained.

Fifth Embodiment

Figure 57:
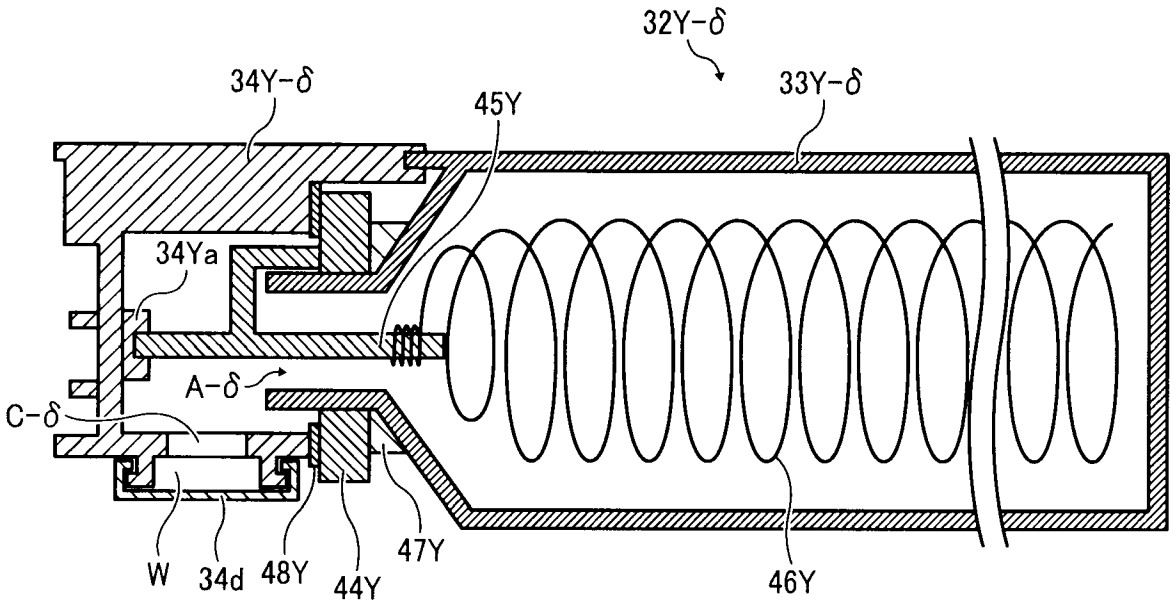
FIG. 57 is a cross sectional view illustrating a structure of a toner container according to a fifth illustrative embodiment of the present invention, when viewed from longitudinal side of the toner container.

FIG. 57 is a cross sectional view illustrating a container body 33 according to a fifth embodiment.

Although the container body 33Y is rotatable relative to the cap 34Y to convey the toner contained in the container body 33Y to the opening A in the above-described embodiments, in the present embodiment neither a container body 33Y-δ nor a cap 34Y-δ are rotatable when installed in the toner container holder 70. Instead, the container body 34Y-δ includes a conveyance member 46Y to convey the toner contained in the container body 33Y-δ to the opening A. For example, a conveyance member is a rotary member to rotate in a predetermined direction and includes a rotary shaft 45Y and a conveyance coil or multiple conveyance blades.

More specifically, as shown in FIG. 57, the toner container 32Y-δ mainly includes the container body 33Y-δ, a gear 44Y, and the cap 34Y-δ (bottle cap). The opening A-δ is formed on the top of the container body 33Y-δ and the outer surface of the opening A-δ, and the gear 44Y is rotatably attached around the outer surface of the opening A-δ.

The gear 44Y engages the driving gear 81 in the image forming apparatus 100 and rotates around the opening A-δ of the container body 33Y-δ for rotating a coil 46Y around a rotary shaft 45Y. Further, the toner contained in the container body 33Y-δ is discharged from the opening A-δ to space B-δ in the cap 34Y-δ. The gear 44Y and the rotary shaft 45Y together form a single member, and the rotary shaft 45Y is connected to the spiral shaped coil 46Y serving as the conveyance member. The one end of the rotary shaft 45Y is supported by a bearing 34Y-δ of the cap 34Y-δ. The coil 46Y extends from the opening W to the backside portion of the (bottom portion) of the container body 33Y-5. With this configuration, as the gear 44Y rotates around the container body 33Y-δ, the rotary shaft 45Y and the coil 46Y are rotated. Thus, the toner contained in the container body 33Y-δ is conveyed to the opening A by the conveyance force from the coil 46Y.

It is to be noted that the gear 44Y is provided around the outer circumferential surface of the container body 33Y-δ so that the gear is sandwiched between the inner face of the cap 34Y-δ and the outer surface of the container body 33Y-δ.

An elastic member 47Y is provided between the gear 44Y and the container body 33Y-δ, and a seal member 48Y is formed between the gear 44Y and the cap 34Y-δ. In this configuration, the entire toner container 32Y-δ can be sealed reliably. That is, leakage of the toner from the gaps between the gear 44Y and the container body 33Y-δ or the gear 44Y and the cap 34Y-δ can be prevented.

Further, the above-described features of the first embodiment to the fourth embodiment can be adapted in the toner container 32Y-δ according to the present embodiment. Accordingly, the similar effect can be achieved.

In addition, with reference to FIG. 1, entire toner conveyance route formed of the toner tank 61Y, the toner conveyance path 63Y including the toner conveying screw 62Y, and the toner dropping route 64Y included in the toner supply device 60Y is И -shaped when viewed from a direction orthogonal to the surface of paper on which FIG. 1 is drawn. In addition, in FIG. 1, the toner dropping route 64Y and the downstream side of the toner conveyance path 63Y in the toner conveyance direction is provided immediately above the image forming unit 6Y (process cartridge), that is, the toner dropping route 64Y and the downstream side of the toner conveyance path 63Y are provided immediately above an attachment/detachment opening in the image forming apparatus 100 in which the image forming unit 6Y (process cartridge) is installed.

Further, the toner container 32, the toner tank 61, and the upstream side of the toner conveyance path 63 including the toner conveying screw 62 for each color are provided not the image forming section 6 for that color that above the adjacent image forming section 6 for another color (in FIG. 1, the image forming section 6 on the left). That is, for example, the toner container 32M, and a toner tank 61M and the upstream side of a toner conveyance path 63M for magenta are not positioned immediately above the image forming section 6M, but above the image forming section 6Y.

Thus, in a tandem-type image forming apparatus in which multiple image forming units are arranged in parallel, when the image forming units 6 (process cartridge) is attached to or detached from the image forming apparatus 100, the image forming units 6 and the toner supply devices 60 do not interfere with each other. Therefore, in the image forming apparatus 100, the length in the vertical direction from the toner containers 32Y, 32M, 32C, and 32K to the image forming unit 6Y, 6M, 6C, and 6K can be shortened, and as a result, the fluctuation in the amount of toner supplied to the corresponding development devices 5Y, 5M, 5C, and 5K can be prevented.

Further, the present invention is not limited to the specifically disclosed embodiments, and variations and modifications may be made without departing from the scope of the present invention. That is, in the embodiments of the present invention, the number of elements, the positions of the corresponding elements, and the shapes of the corresponding elements are not limited to the specifically disclosed embodiments.

Numerous additional modifications and variations are possible in light of the above teachings. It is therefore to be understood that, within the scope of the appended claims, the disclosure of this patent specification may be practiced otherwise than as specifically described herein.

What is claimed:

1. A toner container, removably installable in an image forming apparatus, the toner container comprising:

a cylindrical container body, having an opening in one end thereof, to convey toner contained in the container body to the opening;

a cap, into which the end of the container body having the opening is inserted, having a toner outlet to discharge the toner discharged from the opening of the container body vertically downward; and a shutter, slidably held in a bottom portion of the cap, to open the toner outlet by movement from the cap side to the container body side when the toner container is installed in the image forming apparatus, and to close the toner outlet by movement from the container body side to the cap side when the toner container is removed from the image forming apparatus, the cap comprising:

a primary positioning hole, formed in an upper front surface perpendicular to a longitudinal direction of the toner container, extending in the longitudinal direction, to function as a main positioning reference to determine an installation position of the cap relative to the image forming apparatus;

a secondary positioning hole, formed in a lower front surface perpendicular to the longitudinal direction of the toner container opposite the primary positioning hole, extending in the longitudinal direction forward the toner outlet, to function as a sub positioning reference to determine the installation position of the cap relative to the image forming apparatus; and at least one first restriction member that positions the cap in a horizontal direction perpendicular to the longitudinal direction of the cap, projecting vertically upward from an outer circumferential surface of the cap and symmetrical about a virtual perpendicular line passing through a cross-sectional center position of the primary positioning hole in perpendicular to the long direction of the toner container.

2. The toner container according to claim 1, wherein the first restriction member of the cap comprises a projecting portion that projects forward from a tip of a wall surrounding the primary positioning hole.

3. The toner container according to claim 2, wherein the projecting portion of the first restriction member of the cap has a tapered tip.

4. The toner container according to claim 1, wherein the cap further comprises a pair of second restriction members to position the cap in the image forming apparatus in a rotation direction, protruding horizontally from lateral sides of the cap, the pair of second restriction members arranged in a virtual horizontal line passing through a center position of the line connecting the center position of the primary positioning hole and the center position of the secondary positioning hole, when viewed in a cross sectional view perpendicular to the longitudinal direction.

5. The toner container according to claim 4, wherein the second restriction members of the cap have tapered tips.

6. The toner container according to claim 1, wherein the cap further comprises:

a lateral cylindrical hollow formed inside the cap, extending in the longitudinal direction; and a toner dropping route that is a cylindrical hollow, extending from a lower circumference of the lateral cylindrical hollow toward the toner outlet and having a predetermined cross-sectional area.

7. The toner container according to claim 1, wherein the secondary positioning hole of the cap is elliptical and has a vertical diameter longer than a horizontal diameter thereof.

8. The toner container according to claim 1, wherein the cap further comprises an electronic data storage storing electronic data disposed on the front surface of the toner container perpendicular to the longitudinal direction of the toner container, positioned between the primary positioning hole and the secondary positioning hole.

9. The toner container according to claim 1, wherein the container body comprises a spiral protrusion protruding inward from an inner circumferential face of the container body, and the container body is rotatably held by the cap.

10. An image forming apparatus, comprising:

a toner container frame, provided in a main body of the image forming apparatus; and at least one toner container, removably installable in the toner container frame, the toner container comprising:

a cylindrical container body, having an opening in one end thereof, to convey toner contained in the container body to the opening;

a cap, into which the end of the container body having opening is inserted, including a toner outlet to discharge the toner discharged from the opening of the container body vertical downward; and a shutter, slidably held on a bottom side of the cap, to open the toner outlet as the cap moves in the toner container frame in a direction in which the toner container is inserted into the toner container frame while the shutter is stopped in the toner container frame, and to close the toner outlet as the cap moves in the toner container frame in a direction in which the toner container is removed from the toner container frame while the shutter is stopped in the toner container frame;

the cap comprising:

a primary positioning hole, formed in an upper front surface perpendicular to the longitudinal direction of the toner container and extended in the longitudinal direction, to function as a main positioning reference to determine an installation position of the cap relative to the container frame of the image forming apparatus;

a secondary positioning hole, formed in a lower front surface perpendicular to the longitudinal direction of the toner container and extended in the longitudinal direction not to reach the toner outlet, to function as a main positioning reference to determine an installation position of the cap relative to the image forming apparatus; and a first restriction member to position the cap in a horizontal direction perpendicular to the longitudinal direction of the cap, projecting vertically upward from an outer circumferential surface of the cap symmetrically relative to a virtual perpendicular line passing through the center position of the primary positioning hole in cross sectional view perpendicular to the longitudinal direction, and extended in the longitudinal direction, the toner container frame comprising:

an insertion portion in which an inserting opening is formed to insert the toner container into the toner container frame;

a container holder to hold the container body of the toner container; and a cap holder to hold the cap of the toner container, provided in an extreme downstream portion of the toner container frame in a direction in which the toner container is inserted into the toner container frame;

the cap holder comprising:

a first reference pin to engage the first hole of the cap of the toner container, projecting inward from an extreme downstream portion of an interior wall of the cap holder in the direction in which the toner container is inserted into the toner container frame;

a second reference pin to engage the second hole of the cap of the toner container, projecting inward from extreme downstream interior wall of the cap holder in the direction in which the toner container is inserted into the toner container frame; and an engaged portion to engage the first restriction member of the cap of the toner container, projecting downward from a ceiling of the cap holder, extending in the direction in which the toner container is inserted into the toner container frame.

11. The image forming apparatus according to claim 10, wherein the first restriction member of the cap of the toner container comprises a projecting portion that projects forward from a tip of a surrounding wall of the primary positioning hole.

12. The image forming apparatus according to claim 11, wherein a front-end tip in the longitudinal direction of the projecting portion of the first restriction member of the cap of the toner container is tapered.

13. The image forming apparatus according to claim 10, wherein the cap of the toner container further comprises a pair of second restriction members to position the cap in a rotation direction of the image forming apparatus, protruding from lateral sides of the cap horizontally so as to be arranged in a virtual horizontal line passing through a center position of the line connecting the center position of the primary positioning hole and the center position of the secondary positioning hole, when viewed in a cross sectional view perpendicular to the longitudinal direction.

14. The image forming apparatus according to claim 13, wherein front-end tips of the second restriction members of the cap of the toner container in the longitudinal direction are tapered.

15. The image forming apparatus according to claim 13, wherein the cap holder of the toner container frame further comprises:

a cap-surrounding portion to surround the cap of the toner container;

a pair of lateral grooves to engage the pair of second restriction members of the cap of the toner container, formed in both side walls of the corresponding cap-surrounding portion in the cap holder, extending in the direction in which the toner container is inserted into the toner container frame.

16. The image forming apparatus according to claim 10, wherein the cap of the toner container further comprises:

a lateral cylindrical hollow formed inside of the cap, extending in the longitudinal direction; and a dropping route that is a cylindrical hollow, extending from a lower face of the lateral cylindrical hollow to the outermost face of the toner outlet and having a predetermined cross-sectional area.

17. The image forming apparatus according to claim 10, wherein the secondary positioning hole of the cap of the toner container is elliptical and its vertical diameter is longer than the horizontal diameter thereof.

18. The image forming apparatus according to claim 10, wherein the cap of the toner container further comprises an electronic data storage storing electronic data on the front surface perpendicular to the longitudinal direction of the toner container, positioned between the primary positioning hole and the secondary positioning hole.

19. The image forming apparatus according to claim 18, wherein the cap holder of the toner container frame further comprises an antenna to communicate with the electronic data storages of the cap of the toner container, provided on the extreme downstream interior wall of the cap holder in the direction in which the toner container is inserted into the toner container frame, positioned between the first reference pin and the second reference pin.

20. A toner container removably installable in an image forming apparatus, the toner container comprising:

a cylindrical container body having an opening in one end thereof; and a cap into which the one end of the container body having the opening is inserted, the cap including a primary positioning hole, formed in an upper front surface perpendicular to a longitudinal direction of the toner container, extending in the longitudinal direction, a secondary positioning hole, formed in a lower front surface perpendicular to the longitudinal direction of the toner container, extending in the longitudinal direction, and a pair of first restriction members, positioned on both sides of the primary positioning hole, projecting vertically upward from an outer circumferential surface of the cap, extending in the longitudinal direction.

21. The toner container according to claim 20, wherein the cylindrical container body conveys toner contained in the container body to the opening, and the cap has a toner outlet to discharge the toner discharged from the opening of the container body vertically downward, the toner container further comprising:

a shutter, slidably held in a bottom portion of the cap, to open the toner outlet by movement from the cap side to the container body side when the toner container is installed in the image forming apparatus, and to close the toner outlet by movement from the container body side to the cap side when the toner container is removed from the image forming apparatus, wherein the secondary positioning hole extends in the longitudinal direction forward of the toner outlet.

22. The toner container according to claim 20, wherein the cap further comprises a pair of second restriction members arranged in a virtual horizontal plane perpendicular to a line connecting a center position of the primary positioning hole and a center position of the secondary positioning hole, when viewed in a cross-sectional view perpendicular to the longitudinal direction.

* * * * *